US010809645B2

(12) United States Patent
Ono

(10) Patent No.: US 10,809,645 B2
(45) Date of Patent: Oct. 20, 2020

(54) LIGHT EMITTER, LIGHT SOURCE DEVICE, PRINT HEAD, AND IMAGE FORMING APPARATUS

(71) Applicant: FUJI XEROX CO., LTD., Tokyo (JP)

(72) Inventor: Seiji Ono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/546,378

(22) Filed: Aug. 21, 2019

(65) Prior Publication Data

US 2020/0096895 A1 Mar. 26, 2020

(30) Foreign Application Priority Data

Sep. 26, 2018 (JP) ..... 2018-179698

(51) Int. Cl.
*H01L 33/00* (2010.01)
*G03G 15/043* (2006.01)
*G03G 15/04* (2006.01)

(52) U.S. Cl.
CPC ..... *G03G 15/043* (2013.01); *G03G 15/04036* (2013.01)

(58) Field of Classification Search
CPC ..... G03G 15/043; G03G 15/04036
See application file for complete search history.

(56) References Cited

U.S. PATENT DOCUMENTS 5,969,744 A * 10/1999 Sakashita ..... B41J 2/45 347/130
6,392,615 B1 * 5/2002 Shiraishi ..... B41J 2/45 345/60
2015/0097908 A1 4/2015 Ono
2015/0097911 A1 4/2015 Ono

FOREIGN PATENT DOCUMENTS

JP 2015-074178 A 4/2015
JP 2015-074180 A 4/2015

* cited by examiner

*Primary Examiner* — Clayton E. LaBalle
*Assistant Examiner* — Michael A Harrison
(74) *Attorney, Agent, or Firm* — Oliff PLC

(57) ABSTRACT

A light emitter includes: plural light emitting thyristors that each have an anode, a cathode, and a gate and are connected in parallel between a reference voltage line to which a reference voltage is supplied and a lighting voltage line to which a lighting start voltage for starting lighting is supplied, in which the anode and the cathode are connected respectively to the reference voltage line and the lighting voltage line; and a gate voltage setting section that, when at least one of the plural light emitting thyristors transitions from an off-state to an on-state, sets a voltage on the gate of each of the plural light emitting thyristors to a voltage between the lighting start voltage and an on-state voltage of the light emitting thyristor.

13 Claims, 20 Drawing Sheets

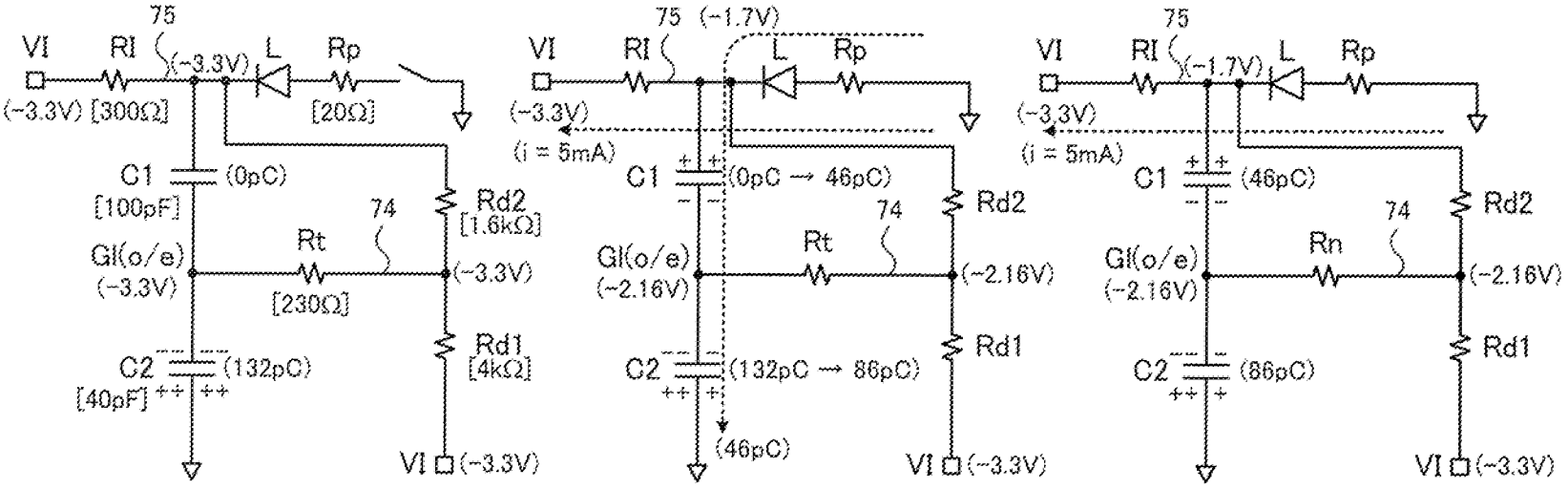
FIG. 12A
FIG. 12B
FIG. 12C
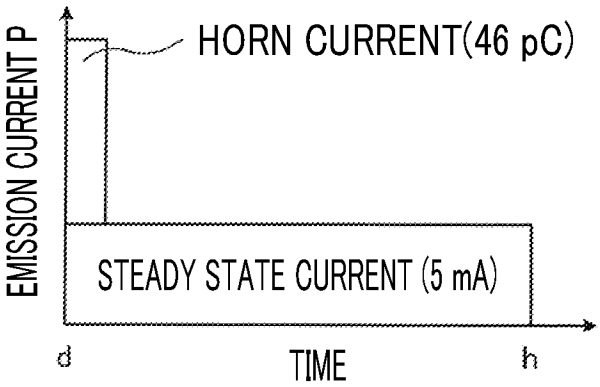
FIG. 12D

LIGHT EMITTER, LIGHT SOURCE DEVICE, PRINT HEAD, AND IMAGE FORMING APPARATUS

CROSS-REFERENCE TO RELATED APPLICATIONS

This application is based on and claims priority under 35 USC 119 from Japanese Patent Application No. 2018-179698 filed Sep. 26, 2018.

BACKGROUND

(i) Technical Field

The present disclosure relates to a light emitter, a light source device, a print head, and an image forming apparatus.

(ii) Related Art

JP-A-2015-074178 describes a light emitting component including plural light emitting elements each of which is lit in an on-state; plural transfer thyristors each having an anode, a cathode, a first gate, a second gate, which are turned on to designate light emitting elements to be lit among the plural light emitting elements, and are sequentially turned on; plural serially connected three-terminal switching elements and resistors which are provided between the second gate of the previous transfer thyristor and the first gate of the subsequent transfer thyristor, in adjacent previous and subsequent transfer thyristors in order in which the transfer thyristors are turned on, among the plural transfer thyristors, and when the previous transfer thyristor is turned on, are turned on to set the subsequent transfer thyristor to a state of being able to transition to the on-state; and N transfer signal lines, the plural transfer thyristors being selected to be circulated in order in which the on-state is transferred, and divided into N (N is an integer of 2 or more) sets, the N transfer signal lines to each of which any one of the cathode or the anode of the transfer thyristor belonging to each of the N sets are connected.

JP-A-2015-074180 describes a light emitting component including plural light emitting thyristors each of which has an anode and a cathode, and lights in an on-state; a lighting signal line to which either the cathodes or the anodes of the plural light emitting thyristors are connected, and that supplies a current for lighting the plural light emitting thyristors; and a shunt thyristor that has an anode and a cathode, either the cathode or the anode being connected to the lighting signal line, and shunts a current flowing to the light emitting thyristors that are lit in the plural light emitting thyristors in an on-state, in which the lighting signal line voltage is set such that the shunt thyristor and at least one light emitting thyristor of the plural light emitting thyristors are turned on in parallel.

In a case where plural light emitting thyristors are connected in parallel in which a predetermined light emitting thyristor is lit and used as a light source, the amount of light from the light emitting thyristors is controlled by controlling the lighting time period in a time region where the amount of emitted light is stabilized. However, the parasitic capacitance of the light emitting thyristors connected in parallel has an influence to increase the time required to stabilize the amount of emitted light after the start of lighting.

SUMMARY

Aspects of non-limiting embodiments of the present disclosure relate to reducing the time required to stabilize the amount of light emitted from light emitting thyristors as compared to a case where the voltage on the gate is not changed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of present disclosure, there is provided a light emitter including: plural light emitting thyristors that each have an anode, a cathode, and a gate and are connected in parallel between a reference voltage line to which a reference voltage is supplied and a lighting voltage line to which a lighting start voltage for starting lighting is supplied, in which the anode and the cathode are connected respectively to the reference voltage line and the lighting voltage line; and a gate voltage setting section that, when at least one of the plural light emitting thyristors transitions from an off-state to an on-state, sets a voltage on the gate of each of the plural light emitting thyristors to a voltage between the lighting start voltage and an on-state voltage of the light emitting thyristor.

BRIEF DESCRIPTION OF THE DRAWINGS

Exemplary embodiments of the present invention will be described in detail based on the following figures, wherein:

FIG. 6A is an equivalent circuit, and FIG. 6B is a cross-sectional structure;

FIG. 9A is an equivalent circuit individually showing light emitting thyristors, and FIG. 9B is an equivalent circuit in which light emitting thyristors are integrated;

FIG. 10A shows a state before lighting, FIG. 10B shows a state immediately after lighting, FIG. 10C shows a steady state, and FIG. 10D shows a change of an emission current over time;

FIG. 11A is an equivalent circuit individually showing light emitting thyristors, and FIG. 11B is an equivalent circuit in which light emitting thyristors are integrated;

FIGS. 12A to 12D are diagrams for explaining operations before and after lighting the light emitting thyristors in the light emitting chip to which the first exemplary embodiment is applied; FIG. 12A shows a state before lighting, FIG. 12B shows a state immediately after lighting, FIG. 12C shows a steady state, and FIG. 12D shows a change of an emission current over time;

FIG. 13A is a case of a light emitting chip to which the first exemplary embodiment is applied, and FIG. 13B is a case of a light emitting chip shown as a comparative example;

FIG. 19A shows a state before lighting, FIG. 19B shows a state immediately after lighting, FIG. 19C shows a steady state, and FIG. 19D shows a change of an emission current over time;

FIG. 20A shows a state before lighting, FIG. 20B shows a state immediately after lighting, FIG. 20C shows a steady state, and FIG. 20D shows a change of an emission current over time.

DETAILED DESCRIPTION

In the image forming apparatus employing an electrophotographic method, such as a printer, a copier, and a facsimile, after an electrostatic latent image is obtained by irradiating a charged photosensitive member with light of a predetermined wavelength having image information by an optical recording section, an image is formed by adding toner to the electrostatic latent image to be visualized, and transferring and fixing the toner on a recording sheet. As the optical recording section, in addition to an optical scanning method in which a laser is used and exposure is performed by applying a laser beam in a main scanning direction for scanning, in recent years, in response to a request for downsizing of the device, a recording apparatus using an LED print head (LPH) is employed in which plural light emitting diodes (LEDs) as light emitting elements are arranged in a main scanning direction to form a light emitting element array.

In addition, in a light emitting chip on which plural light emitting elements are provided in a row on a substrate, and a self-scanning light emitting element array (SLED) of which lighting is controlled sequentially is mounted, light emitting thyristors are used as light emitting elements.

The thyristor described below is an element which has an anode, a cathode, and at least one gate, is turned on by applying a voltage between the anode and the cathode in a state where a voltage of a certain level or more is applied to the gate, and maintains the on-state while a current equal to or higher than a holding current flows between the anode and the cathode.

Hereinafter, an exemplary embodiment of the present disclosure will be described in detail with reference to the accompanying drawings.

First Exemplary Embodiment

Figure 1:
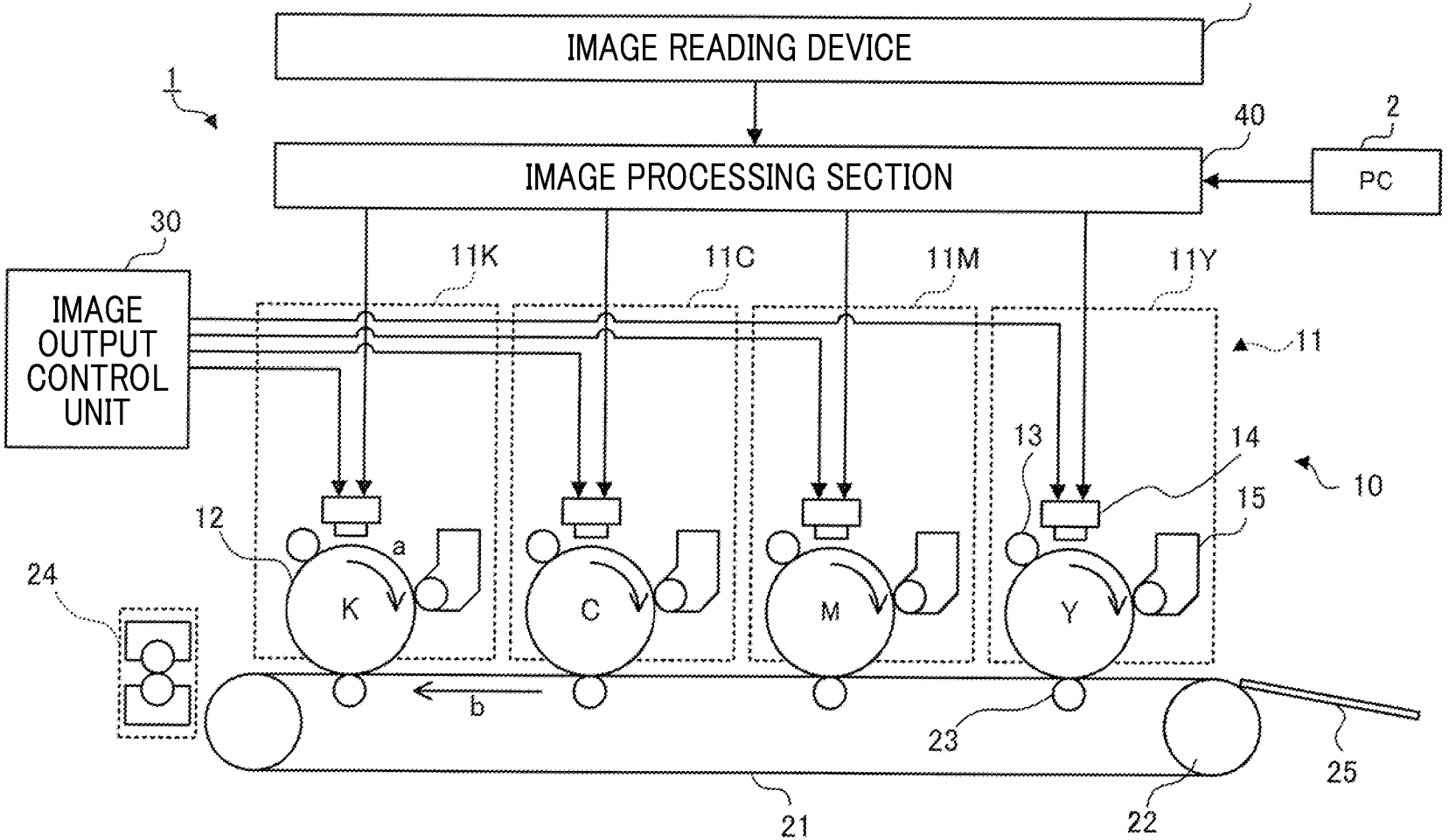
FIG. 1 is a diagram showing an example of the entire configuration of an image forming apparatus to which a first exemplary embodiment is applied.

Image Forming Apparatus 1 FIG. 1 is a diagram showing an example of the entire configuration of an image forming apparatus 1 to which a first exemplary embodiment is applied. The image forming apparatus 1 shown in FIG. 1 is an image forming apparatus generally called a tandem type.

The image forming apparatus 1 includes an image forming process unit 10, an image output control unit 30, and an image processing section 40. The image forming process unit 10 forms an image corresponding to the image data of each color. The image output control unit 30 controls the image forming process unit 10. The image processing section 40 is connected to, for example, a personal computer (PC) 2 or an image reading device 3, and performs predetermined image processing on the image data received from them.

The image forming process unit 10 includes an image forming unit 11 including plural engines arranged in parallel at predetermined intervals. The image forming unit 11 includes, for example, four image forming units 11Y, 11M, 11C, 11K. The image forming units 11Y, 11M, 11C, 11K each include a photosensitive drum 12, a charger 13, a print head 14, and a developer 15. The photosensitive drum 12, which is an example of an image carrier, forms an electrostatic latent image to hold a toner image. The charger 13, which is an example of a charging unit, charges the surface of the photosensitive drum 12 with a predetermined voltage. The print head 14, which is an example of an exposure unit, exposes to light the photosensitive drum 12 charged by the charger 13. The developer 15, which is an example of a developing unit, develops the electrostatic latent image obtained by the print head 14.

The image forming units 11Y, 11M, 11C, 11K form toner images of yellow (Y), magenta (M), cyan (C), black (K), respectively.

The image forming process unit 10 also includes a sheet transport belt 21, a drive roll 22, a transfer roll 23, and a fixing unit 24. The sheet transport belt 21 transports the recording sheet 25 such that the toner images of the respective colors formed on the photosensitive drums 12 of the image forming units 11Y, 11M, 11C, 11K are multiple transferred onto the recording sheet 25 as an example of the transfer receiver. The drive roll 22 is a roll that drives the sheet transport belt 21. The transfer roll 23 transfers the toner image of the photosensitive drum 12 onto the recording sheet 25. The fixing unit 24, which is an example of a transfer unit, fixes a toner image on the recording sheet 25.

In the image forming apparatus 1, the image forming process unit 10 performs an image forming operation based on various control signals supplied from the image output control unit 30. The image data received from the personal computer (PC) 2 or the image reading device 3 is subjected to image processing by the image processing section 40 and supplied to the image forming unit 11 under the control of the image output control unit 30. Then, for example, in the image forming unit 11K of black (K) color, the photosensitive drum 12 is charged to a predetermined voltage by the charger 13 while rotating in the direction of arrow a, and is exposed by the print head 14 which emits light, based on the image data supplied from the image processing section 40. Thus, an electrostatic latent image related to a black (K) color image is formed on the photosensitive drum 12. Then, the electrostatic latent image formed on the photosensitive drum 12 is developed by the developer 15, and a toner image of black (K) is formed on the photosensitive drum 12. Even in the image forming units 11Y, 11M, 11C, toner images of respective colors of yellow (Y), magenta (M) and cyan (C) are formed respectively.

Each color toner image on the photosensitive drum 12 formed by each image forming unit 11 is sequentially electrostatically transferred to the recording sheet 25 supplied as the sheet transport belt 21 moves in the direction of the arrow b, by the transfer electric field applied to the transfer roll 23 to form a composite toner image in which the toners of the respective colors are superimposed on the recording sheet 25.

Thereafter, the recording sheet 25 on which the composite toner image is electrostatically transferred is transported to the fixing unit 24. The composite toner image on the recording sheet 25 transported to the fixing unit 24 is subjected to fixing processing by heat and pressure by the fixing unit 24, fixed on the recording sheet 25 and discharged from the image forming apparatus 1.

Print Head 14

Figure 2:
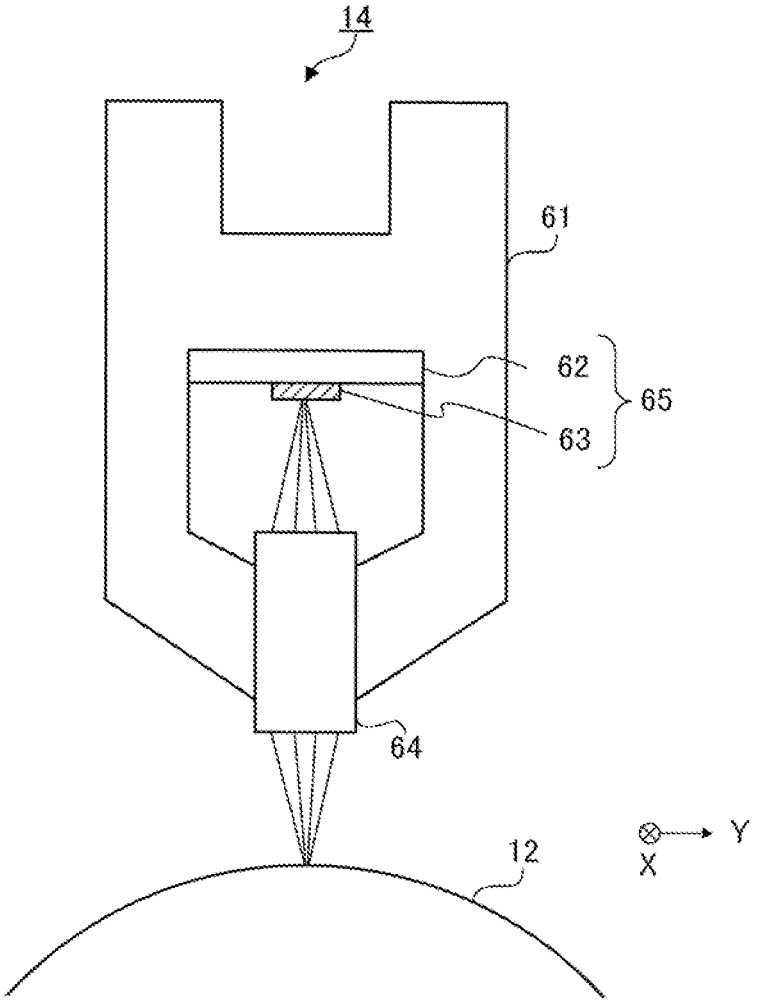
FIG. 2 is a cross-sectional view showing a configuration of a print head.

FIG. 2 is a cross-sectional view showing a configuration of the print head 14. The print head 14 includes a housing 61, a light emitting device 65, and a rod lens array 64. The light emitting device 65 is an example of a light emitting section, and includes a light source unit 63 having plural light emitting elements (in the first exemplary embodiment, light emitting thyristors). The rod lens array 64 is an example of an optical unit, and focuses the light emitted from the light source unit 63 on the surface of the photosensitive drum 12 to expose the photosensitive drum 12.

The light emitting device 65 includes a circuit board 62 on which the above-described light source unit 63 and a signal generation circuit 110 (see FIG. 3 to be described later) for driving the light source unit 63 are mounted.

The housing 61 is formed of, for example, metal, supports the circuit board 62 and the rod lens array 64, and is set such that the light emitting surface of the light emitting element in the light source unit 63 coincides with the focal plane of the rod lens array 64. The rod lens array 64 is disposed along the axial direction of the photosensitive drum 12 (the main scanning direction, which is the X direction in FIGS. 3 and 4B described later).

Light Emitting Device 65

Figure 3:
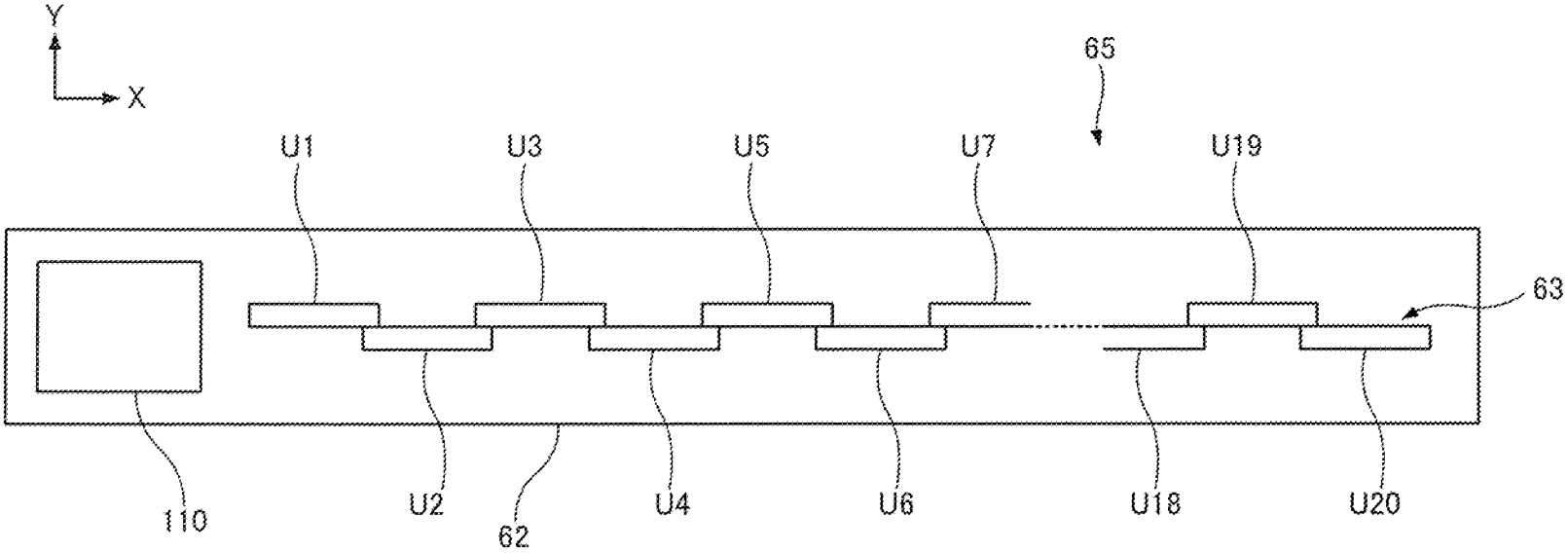
FIG. 3 is a top view of an example of a light emitter to which the first exemplary embodiment is applied.

FIG. 3 is a top view of an example of the light emitting device 65 to which the first exemplary embodiment is applied.

The light source unit 63 in the light emitting device 65 shown in FIG. 3 includes, for example, twenty light emitting chips U1 to U20 on the circuit board 62. The light emitting chips U1 to U20 are arranged in a staggered manner in two rows in the X direction which is the main scanning direction. The light emitting chip U is an example of a light source device.

As used herein, "to" refers to plural components that are each distinguished by numbers, and is meant to include those described before and after "to" and those between the numbers. For example, the light emitting chips U1 to U20 include the light emitting chips U1 to the light emitting chips U20 in numerical order.

The configurations of the light emitting chips U1 to U20 may be the same. Therefore, the light emitting chips U1 to U20 are denoted as the light emitting chip U when not distinguished from one another. In the first exemplary embodiment, a total of twenty light emitting chips U are used, but the present disclosure is not limited thereto.

The light emitting device 65 includes a signal generation circuit 110 that drives the light source unit 63. The signal generation circuit 110 is formed of, for example, an integrated circuit (IC). The light emitting device 65 may not have the signal generation circuit 110 mounted thereon. At this time, the signal generation circuit 110 is provided outside the light emitting device 65, and supplies control signals for controlling the light emitting chips U1 to U20 through a cable or the like. Here, the light emitting device 65 is described as including the signal generation circuit 110.

Details of the arrangement of the light emitting chips U1 to U20 will be described later.

Figure 4A:
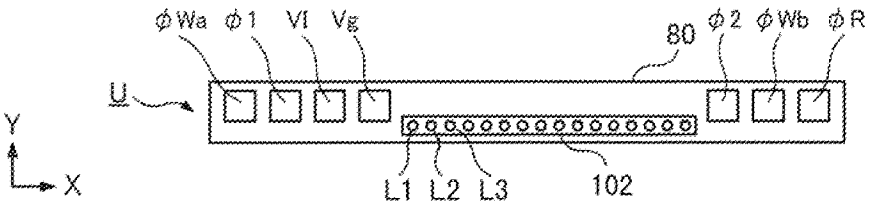
FIGS. 4A and 4B are views showing an example of a configuration of a light emitting chip to which the first exemplary embodiment is applied, a configuration of a signal generation circuit of the light emitter, and a configuration of wirings (lines) on a circuit board.
Figure 4B:
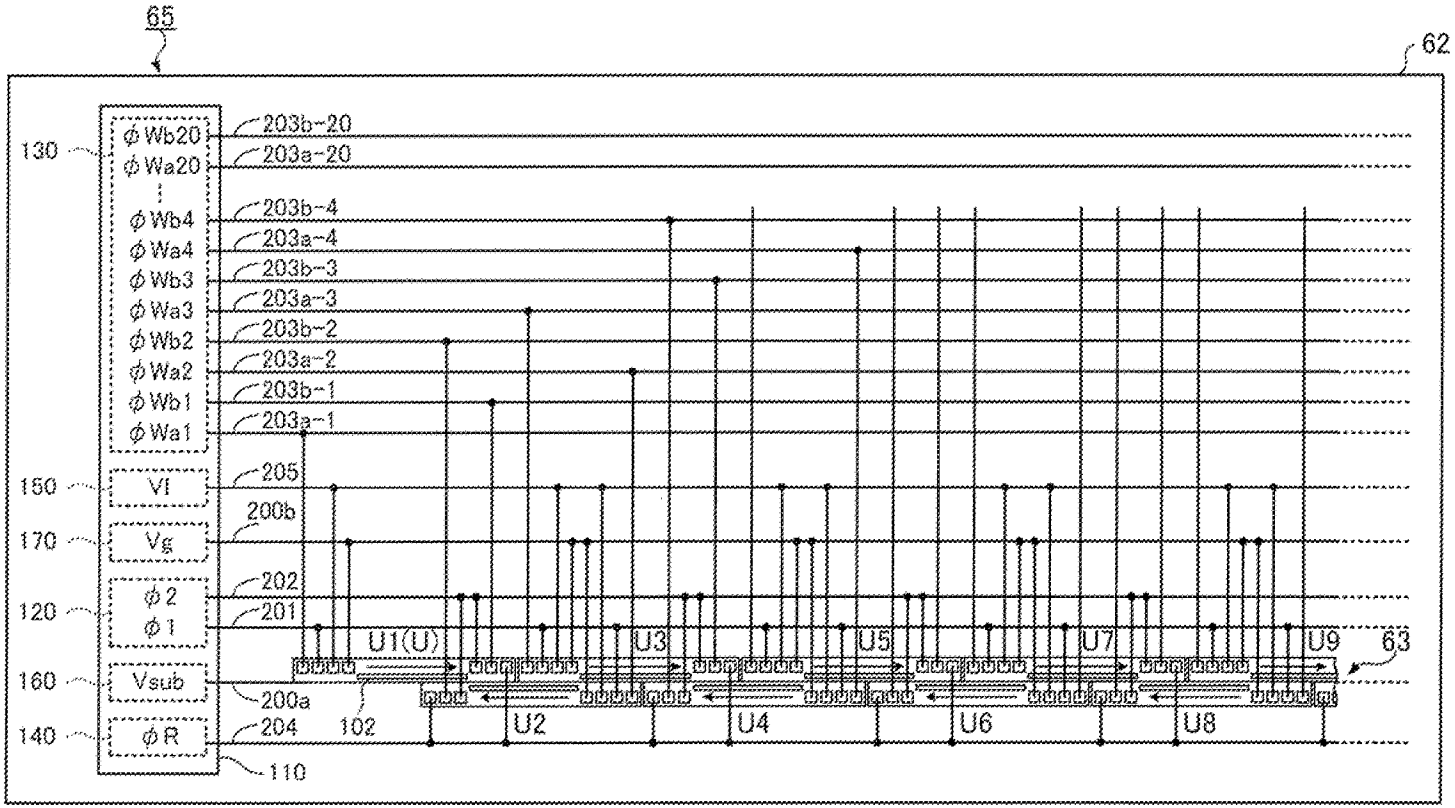

FIGS. 4A and 4B are views showing an example of a configuration of the light emitting chip U to which the first exemplary embodiment is applied, a configuration of the signal generation circuit 110 of the light emitting device 65, and a configuration of wirings (lines) on the circuit board 62. FIG. 4A shows the configuration of the light emitting chip U, and FIG. 4B shows the configuration of the signal generation circuit 110 of the light emitting device 65, and the configuration of wirings (lines) on the circuit board 62.

First, the configuration of the light emitting chip U shown in FIG. 4A will be described.

The light emitting chip U is formed of, for example, a semiconductor stacked body (see FIGS. 6A and 6B described later) provided on the semiconductor substrate 80 having a rectangular surface shape. On the surface of the substrate 80, a light emitting unit 102 including plural light emitting elements (light emitting thyristors L1, L2, L3, . . . in the first exemplary embodiment) provided in a row along the long side is provided. Further, the light emitting chip U has terminals which are plural bonding pads for receiving various control signals (φ1 terminal, φ2 terminal, Vg terminal, VI terminal, φWa terminal, φWb terminal, and φR terminal) are provided at both ends in the longitudinal direction of the surface of the substrate 80. Among these terminals, the φWa terminal, the φ1 terminal, the VI terminal, and the Vg terminal are provided in order from one end of the substrate 80, and the φR terminal, the φWb terminal, and the φ2 terminal are provided in order from the other end of the substrate 80. The light emitting unit 102 is provided between the Vg terminal and the φ2 terminal. Further, a back electrode 85 (see FIG. 6B described later) is provided as a Vsub terminal on the back surface of the substrate 80.

Note that "in a row" is not limited to the case where plural light emitting elements are arranged on a straight line as shown in FIG. 4A, and the respective plural light emitting elements may be arranged with different deviation amounts from each other in a direction orthogonal to the row direction. For example, when the light emitting surface of the light emitting element is a pixel, respective light emitting elements may be arranged with a deviation amount of several pixels or several tens of pixels in a direction orthogonal to the row direction. Further, adjacent light emitting elements may be alternately arranged, or plural light emitting elements may be arranged in a zigzag manner.

Next, FIG. 4B shows the configuration of the signal generation circuit 110 of the light emitting device 65, and the configuration of wirings (lines) on the circuit board 62.

As described above, the signal generation circuit 110 and the twenty light emitting chips U are mounted on the circuit board 62 of the light emitting device 65, and the wiring (line) connecting the signal generation circuit 110 and each light emitting chip U is provided. FIG. 4B shows the light emitting chips U1 to U9.

First, the configuration of the signal generation circuit 110 will be described.

The signal generation circuit 110 receives image data subjected to image processing and various control signals from the image output control unit 30 and the image processing section 40 (see FIG. 1). The signal generation circuit 110 rearranges the image data and corrects the light amount, based on the image data and various control signals.

Then, the signal generation circuit 110 includes a transfer signal generation unit 120, a setting signal generation unit 130, a light-off signal generation unit 140, a lighting voltage supply unit 150, a reference voltage supply unit 160, and a power voltage supply unit 170.

The transfer signal generation unit 120 transmits the transfer signals φ1, φ2 to the respective light emitting chips U, based on various control signals. The transfer signals φ1, φ2 are transmitted in common to all light emitting chips U. That is, the twenty light emitting chips U operate in parallel. The transfer signals φ1, φ2 are denoted as the transfer signal when not distinguished from one another.

The setting signal generation unit 130 transmits setting signals φWa1, φWb1, φWa2, φWb2, . . . , φWa20, φWb20 for setting the light emitting elements in the light emitting chips U1 to U20 as the lighting targets, to the light emitting chips U1 to U20, based on the image data and various control signals. Here, two setting signals φWa1, φWb1 are transmitted to the light emitting chip U1. The same applies to other light emitting chips U2 to U20. In a case where the light emitting chips U are not distinguished from one another, the setting signals are denoted as setting signals φWa, φWb. Thus, the setting signal generation unit 130 transmits twenty setting signals φWa and twenty setting signals φWb. Further, the setting signal φWa and the setting signal φWb may be denoted as the setting signal φW when not distinguished from one another.

The light-off signal generation unit 140 transmits a light-off signal φR for setting the light emitting element in the light-on state (sometimes referred to as light-emitting state or on-state) to the light-off state (sometimes referred to as light-off state, non-light-emitting state, or off-state). The light-off signal φR is transmitted in common to each light emitting chip U. In other words, the twenty light emitting chips U transition to the light-off state all at once.

The lighting voltage supply unit 150 commonly supplies a lighting voltage VI for supplying a current for lighting to the light emitting element to each light emitting chip U.

The reference voltage supply unit 160 commonly supplies a reference voltage Vsub, which is a reference for the voltage, such as a ground voltage (GND), to the light emitting chips U.

The power voltage supply unit 170 commonly supplies a power voltage Vg for driving each light emitting chip U to each light emitting chip U.

Next, the arrangement of the light emitting chips U1 to U20 will be described.

The odd-numbered light emitting chips U1, U3, U5, . . . are arranged in a row at intervals in the longitudinal direction of the substrates 80 thereof (upper side in FIG. 4B). Similarly, the even-numbered light emitting chips U2, U4, U6, . . . are arranged in a row at intervals in the longitudinal direction of the substrates 80 thereof (lower side in FIG. 4B). The odd numbered light emitting chips U1, U3, U5, . . . and the even numbered light emitting chips U2, U4, U6, . . . are arranged in a staggered manner in a state of being rotated by 180° mutually such that the long sides of the light emitting units 102 provided in the light emitting chips U face each other. Further, the light emitting elements are also set to be arranged at predetermined intervals in the main scanning direction (X direction) in the light emitting chips U. In the light emitting chips U1, U2, U3, . . . of FIG. 4B, the direction of arrangement of the light emitting elements of the light emitting unit 102 shown in FIG. 4A (number order of the light emitting thyristors L1, L2, L3, . . . in the first exemplary embodiment) is indicated by an arrow.

Wirings (lines) connecting the signal generation circuit 110 and the light emitting chips U1 to U20 will be described.

The circuit board 62 is provided with a power supply line 200*a* for connecting the reference voltage supply unit 160 and the back electrode 85 (see FIGS. 6A and 6B described later) which is a Vsub terminal provided on the back surface of the substrate 80 of each light emitting chip U. The power supply line 200*a* supplies the reference voltage Vsub from the reference voltage supply unit 160 to each light emitting chip U.

In addition, the circuit board 62 is provided with a power supply line 200*b* for connecting the power voltage supply unit 170 and the Vg terminal provided in each light emitting chip U. The power supply line 200*b* supplies the power voltage Vg to each light emitting chip U from the power voltage supply unit 170.

Then, on the circuit board 62, the transfer signal line 201 connected to the transfer signal generation unit 120 and the φ1 terminal of each light emitting chip U, and the transfer signal line 202 connected to the transfer signal generation unit 120 and the φ2 terminal of each light emitting chip U are provided. The transfer signal line 201 transmits the transfer signal φ1 from the transfer signal generation unit 120 to each light emitting chip U, and the transfer signal line 202 transmits the transfer signal φ2 from the transfer signal generation unit 120 to each light emitting chip U.

Further, the circuit board 62 is provided with setting signal lines 203*a*-1, 203*b*-1 which respectively connect the setting signal generation unit 130 and the φWa terminal and the φWb terminal of the light emitting chip U1. The setting signal lines 203*a*-1, 203*b*-1 transmit setting signals φWa1, φWb1 from the setting signal generation unit 130 to the light emitting chip U1. The same applies to other light emitting chips U2 to U20. That is, setting signal lines 203*a*-1 to 203*a*-20 for transmitting setting signals φWa1 to φWa20 and setting signal lines 203*b*-1 to 203*b*-20 for transmitting setting signals φWb1 to φWb20 are provided.

The circuit board 62 is provided with a light-off signal line 204 connected to the light-off signal generation unit 140 and the φR terminal of each light emitting chip U. The light-off signal line 204 transmits the light-off signal φR from the light-off signal generation unit 140 to each light emitting chip U.

Further, the circuit board 62 is provided with a lighting voltage supply line 205 for connecting the lighting voltage supply unit 150 and the VI terminal of each light emitting chip U. The lighting voltage supply line 205 supplies the lighting voltage VI to the respective light emitting chips U from the lighting voltage supply unit 150.

The reference voltage Vsub, the power voltage Vg, and the lighting voltage VI are commonly supplied to the respective light emitting chips U on the circuit board 62. The transfer signals φ1, φ2 and the light-off signal φR are also transmitted to the respective light emitting chips U in common (in parallel).

Meanwhile, the setting signals φWa, φWb are individually transmitted to the respective light emitting chips U.

In a case where the light emitting device 65 does not include the signal generation circuit 110, the power supply lines 200*a*, 200*b*, the transfer signal lines 201, 202, the setting signal lines 203*a*-1 to 203*a*-20 and 203*b*-1 to 203*b*-20, the light-off signal line 204, and the lighting voltage supply line 205, provided on the circuit board 62, are connected to a connector or the like provided instead of the signal generation circuit 110. These lines are connected to a signal generation circuit 110 provided outside the circuit board 62 by a cable connected to a connector or the like.

Light Emitting Chip U

Figure 5:
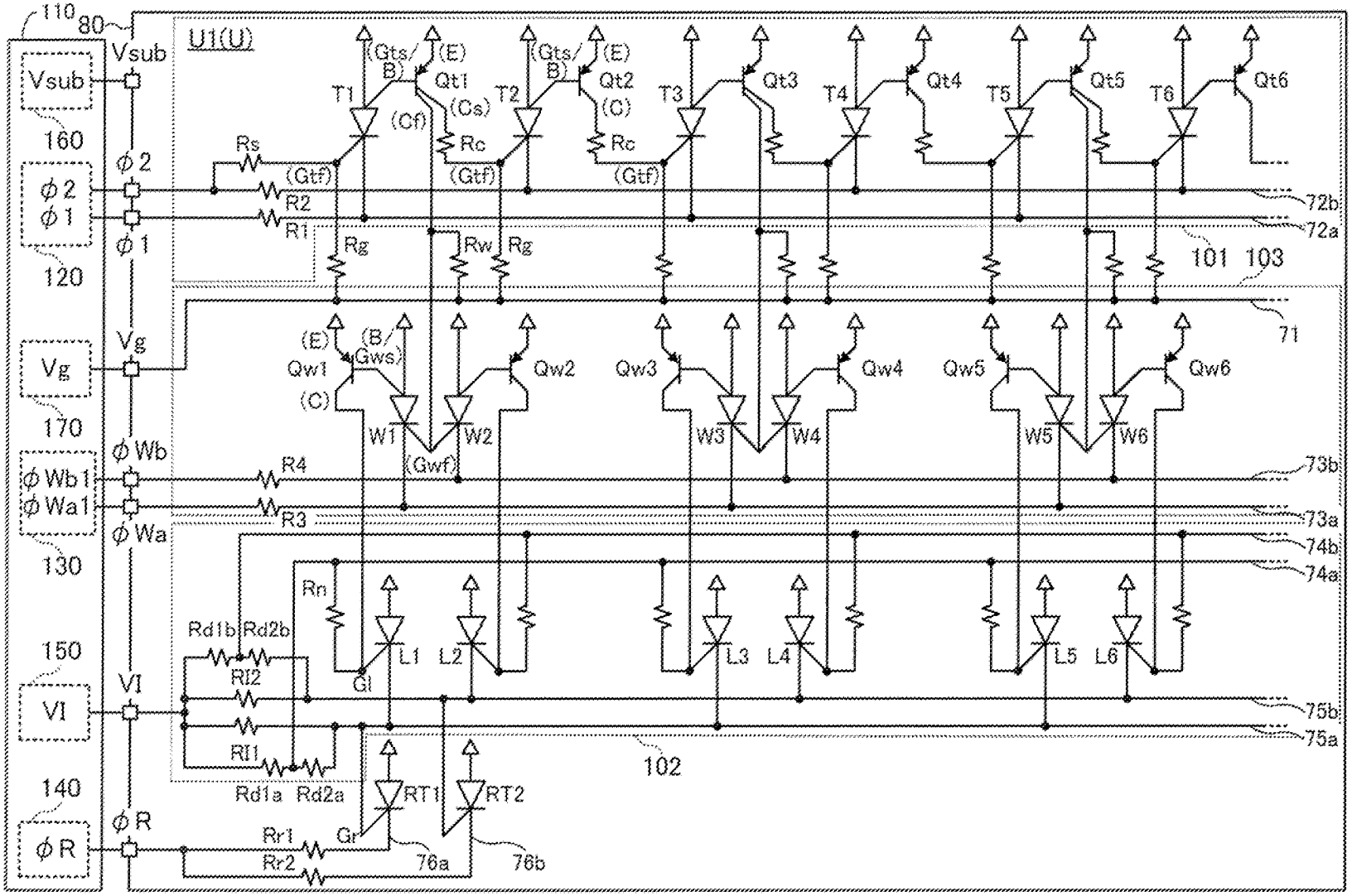
FIG. 5 is an example of an equivalent circuit diagram for explaining a configuration of the light emitting chip to which the first exemplary embodiment is applied.

FIG. 5 is an example of an equivalent circuit diagram for explaining the configuration of the light emitting chip U to which a first exemplary embodiment is applied. In FIG. 5, each element described below is denoted as a widely used circuit symbol. The positions of the respective terminals (φ1 terminal, φ2 terminal, φWa terminal, φR terminal, VI terminal, and Vg terminal) are different from the positions in FIG. 4A, but are shown at the left end in FIG. 4A for convenience of explanation. The Vsub terminal is provided on the back surface of the substrate 80 as the back electrode 85.

Here, the light emitting chip U will be described by using the light emitting chip U1 as an example in relation to the signal generation circuit 110. Therefore, in FIG. 5, the light emitting chip U1 (U) is denoted, but hereinafter, the light emitting chip U is denoted. The configuration of the other light emitting chips U2 to U20 is the same as that of the light emitting chip U1.

The light emitting chip U includes light emitting thyristors L1, L2, L3, . . . , transfer thyristors T1, T2, T3, . . . , coupling transistors Qt1, Qt2, Qt3, . . . , setting thyristors W1, W2, W3, . . . , and setting transistors Qw1, Qw2, Qw3, . . . . In FIG. 5, numbers are assigned from the left side. The light emitting thyristors L1, L2, L3, . . . are denoted as the light emitting thyristor L when not distinguished from one another. The same applies to other elements. The transfer thyristor T, the coupling transistor Qt, the setting thyristor W, and the setting transistor Qw are arranged following the arrangement of the light emitting thyristor L (see FIG. 4A).

A portion including the transfer thyristor T and the coupling transistor Qt is a transfer unit 101, a portion including the light emitting thyristor L is a light emitting unit 102, and a portion including the setting thyristor W and the setting transistor Qw is a setting unit 103. The transfer thyristor T is an example of a transfer element, and the setting thyristor W is an example of a setting element. In the first exemplary embodiment, a light emitter includes the light emitting thyristor L in the light emitting unit 102, the resistors RI1, RI2, Rd1*a*, Rd2*a*, Rd1*b*, Rd2*b*, and the resistor Rn.

The light emitting chip U includes the light-off thyristors RT1, RT2. The light-off thyristors RT1, RT2 are denoted as the light-off thyristor RT when not distinguished from one another.

Further, the light emitting chip U includes plural resistors. Numbers to distinguish elements such as the light emitting thyristors L1, L2, L3, . . . are not assigned to the resistors.

The light emitting thyristor L, the transfer thyristor T, the setting thyristor W, and the light-off thyristor RT are thyristors having a pnpn structure. The transfer thyristor T is a four-terminal element having an anode, a first gate Gtf, a second gate Gts, and a cathode, as shown in the transfer thyristor T1. In FIG. 5, the first gate Gtf is denoted as (Gtf). The same is applied to other things. Further, other equivalent elements are not assigned by reference numerals. The same is applied to other things.

The setting thyristor W is a four-terminal element having an anode, a first gate Gwf, a second gate Gws, and a cathode, as shown in the setting thyristor W1. On the other hand, the light emitting thyristor L is a three-terminal element having an anode, a gate G1, and a cathode, as shown in the light emitting thyristor L1. Similarly, the light-off thyristor RT is a three-terminal element having an anode, a gate Gr, and a cathode, as shown in the light-off thyristor RT1.

The coupling transistor Qt and the setting transistor Qw are pnp bipolar transistors. The odd-numbered coupling transistor Qt is a four-terminal element having an emitter E, a base B, a first collector Cf, and a second collector Cs, as shown in the coupling transistor Qt1. The even-numbered coupling transistor Qt is a three-terminal element having an emitter E, a base B, and a collector C, as shown in the coupling transistor Qt2. That is, the odd-numbered coupling transistors Qt are multi-collectors, and the even-numbered coupling transistors Qt are single-collectors.

Further, the setting transistor Qw is a three-terminal element having an emitter E, a base B, and a collector C, as shown in the setting transistor Qw1. Therefore, the setting transistor Qw is also a single collector.

The light emitting chip U includes plural wirings connecting the above elements.

The light emitting chip U includes the power supply line 71 connected to the Vg terminal. The power supply line 71 is supplied with the power voltage Vg from the power voltage supply unit 170 through the Vg terminal connected by the power supply line 200*b*.

The light emitting chip U includes transfer signal lines 72*a*, 72*b* connected to the φ1 terminal and the φ2 terminal respectively through the resistors R1, R2. Transfer signals φ1, φ2 are respectively transmitted from the transfer signal generation unit 120 to the φ1 terminal and the φ2 terminal through the transfer signal lines 201, 202. The light emitting chip U includes setting signal lines 73*a*, 73*b* connected to the φWa terminal and the φWb terminal respectively through the resistors R3, R4. The setting signals φWa1, φWb1 are transmitted from the setting signal generation unit 130 to the φWa terminal and the φWb terminal through the setting signal lines 203*a*-1 and 203*b*-1.

The resistors R1, R2, R3, R4 are current limiting resistors provided to maintain the voltage.

The light emitting chip U includes voltage setting lines 74*a*, 74*b* connected to the gate of each light emitting thyristor L through the resistor Rn. The voltage setting lines 74*a*, 74*b* are connected to the power supply line 71 and lighting signal lines 75*a*, 75*b* described later through plural resistors. The voltages of the gates of the light emitting thyristor L in the off-state are set by the voltage setting lines 74*a*, 74*b*.

The light emitting chip U includes lighting signal lines 75*a*, 75*b* connected to the VI terminal through the resistors RI1, RI2, respectively. The lighting voltage VI is supplied from the lighting voltage supply unit 150 to the VI terminal.

The lighting signal lines 75*a*, 75*b* are examples of lighting voltage lines, and the lighting voltage VI is an example of a lighting start voltage.

Further, the light emitting chip U includes light-off signal lines 76*a*, 76*b* connected to the φR terminal through the resistors Rr1, Rr2, respectively. The light-off signal φR is transmitted from the light-off signal generation unit 140 to the φR terminal through the light-off signal line 204.

Then, the light emitting chip U includes the Vsub terminal on the back electrode 85 of the substrate 80. The reference voltage Vsub is supplied from the reference voltage supply unit 160 to the Vsub terminal through the power supply line 200*a*. The Vsub terminal is an example of a reference voltage line.

Next, the connection relationship will be described.

The coupling transistor Qt is provided between a pair of two of transfer thyristors T arranged in numerical order. First, the odd-numbered coupling transistors Qt connected to the odd-numbered transfer thyristors T will be described as the transfer thyristor T1 and the coupling transistor Qt1. The odd-numbered coupling transistors Qt are multi-collectors as described above.

The transfer thyristor T1 will be described. The anode is set to the reference voltage Vsub. The first gate Gtf is connected to the power supply line 71 through a resistor Rg. Further, the second gate Gts is connected to the base B of the coupling transistor Qt1. Therefore, in FIG. 5, the denotation (Gts/B) is used. The cathode is connected to the transfer signal line 72*a*.

The coupling transistor Qt1 will be described. The emitter E is set to the reference voltage Vsub. The first collector Cf is connected to the power supply line 71 through the resistor Rw, and is connected to the first gate Gwf of the setting thyristors W1, W2. The second collector Cs is connected to the first gate Gtf of the transfer thyristor T2 through the coupling resistor Rc.

Next, the even-numbered coupling transistors Qt connected to the even-numbered transfer thyristors T will be described as the transfer thyristor T2 and the coupling transistor Qt2. The even-numbered coupling transistors Qt are single collectors.

The transfer thyristor T2 will be described. The anode is set to the reference voltage Vsub. The first gate Gtf is connected to the power supply line 71 through a resistor Rg. The second gate Gts is connected to the base B of the coupling transistor Qt2. The cathode is connected to the transfer signal line 72*b*.

The coupling transistor Qt2 will be described. The emitter E is set to the reference voltage Vsub. The collector C is connected to the first gate Gtf of the transfer thyristor T3 through the coupling resistor Rc.

A repeated description will be provided. The anode of the transfer thyristor T is set to the reference voltage Vsub. The first gate Gtf is connected to the power supply line 71 through a resistor Rg. The second gate Gts is connected to the base B of the coupling transistor Qt. The odd-numbered transfer thyristor T has a cathode connected to the transfer signal line 72*a*, and the even-numbered transfer thyristor T has a cathode connected to the transfer signal line 72*b*.

The emitter E of the coupling transistor Qt is set to the reference voltage Vsub. The odd-numbered coupling transistor Qt which is the multi-collector has the first collector Cf connected to the power supply line 71 through the resistor Rw, and connected to the first gates Gwf of the two setting thyristors W. Then, the second collector Cs is connected to the first gate Gtf of the next-numbered (even-numbered) transfer thyristor T adjacent thereto through the coupling resistor Rc.

On the other hand, the even-numbered coupling transistor Qt which is a single collector has the collector C connected to the first gate Gtf of the next-numbered (odd-numbered) transfer thyristor T adjacent thereto through the coupling resistor Rc.

As described above, two setting thyristors W (odd numbered setting thyristor W and even numbered setting thyristor W) are connected to the odd-numbered coupling transistor Qt. Each setting thyristor W is provided with a setting transistor Qw. That is, one setting thyristor W and one setting transistor Qw are paired. The setting transistor Qw is a single collector.

First, the setting thyristor W will be described. The anode is set to the reference voltage Vsub. As described above, the first gate Gwf is connected to the first collector Cf of the odd-numbered coupling transistor Qt and is connected to the power supply line 71 through the resistor Rw. Then, the second gate Gws is connected to the base B of the setting transistor Qw forming a set. The cathodes of the odd-numbered setting thyristors W are connected to the setting signal line 73*a*, and the cathodes of the even-numbered setting thyristors W are connected to the setting signal line 73*b*.

Next, the setting transistor Qw will be described. The emitter E is set to the reference voltage Vsub. The base B is connected to the second gate Gws of the setting thyristor W as described above. The collector C is connected to the gate G1 of the light emitting thyristor L.

Next, the light emitting thyristor L will be described. The anode is set to the reference voltage Vsub. The gate G1 is connected to the collector C of the setting transistor Qw as described above.

The gates G1 of the odd-numbered light emitting thyristors L are connected to the voltage setting line 74*a* through the resistor Rn, and the gates G1 of the even-numbered light emitting thyristors L are connected to the voltage setting line 74*b* through the resistor Rn.

The cathodes of the odd-numbered light emitting thyristors L are connected to the lighting signal line 75*a*, and the cathodes of the even-numbered light emitting thyristors L are connected to the lighting signal line 75*b*.

Then, the light-off thyristor RT will be described. The anode is set to the reference voltage Vsub. The gate Gr of the light-off thyristor RT1 is connected to the lighting signal line 75*a*, and the gate Gr of the light-off thyristor RT2 is connected to the lighting signal line 75*b*. The cathode of the light-off thyristor RT1 is connected to the light-off signal line 76*a*, and the cathode of the light-off thyristor RT2 is connected to the light-off signal line 76*b*.

The start resistor Rs will now be described. One is connected to the first gate Gtf of the transfer thyristor T1, and the other is connected to between the terminal (φ2 and the resistor R2.

Next, the connection relationship between the voltage setting lines 74*a*, 74*b* and the lighting signal lines 75*a*, 75*b* will be described.

The resistors Rd1*a*, Rd2*a* connected in series are connected in parallel to the resistor RI1 provided between the lighting signal line 75*a* and the VI terminal to which the lighting voltage VI is supplied. Similarly, the resistors Rd1*b*, Rd2*b* connected in series are connected in parallel to the resistor RI2 provided between the lighting signal line 75*b* and the VI terminal to which the lighting voltage VI is supplied. The connection point between the resistors Rd1*a* and Rd2*a* connected in series is connected to the voltage setting line 74*a*. Similarly, the connection point between the resistors Rd1*b* and Rd2*b* connected in series is connected to the voltage setting line 74*b*.

The resistors Rd1*a*, Rd2*a*, Rd1*b*, Rd2*b* are examples of the gate voltage setting section.

The resistors R1, R2, R3, R4, Rg, Rw, Rn, RI1, RI2, Rd1*a*, Rd2*a*, Rd1*b*, Rd2*b*, Rr1, Rr2 are current limiting resistors that limit the current and maintain the voltage on the previous and subsequent wirings.

The number of light emitting thyristors L may be a predetermined number. Here, as an example, in a case where the number of light emitting thyristors L is, for example, 512, the number of setting thyristors W, setting transistors Qw, and transfer thyristors T is also 512, respectively. Similarly, the number of each of the resistors Rg, Rn is also 512. However, the number of coupling transistors Qt may be 511 which is one less than the number of transfer thyristors T. Further, the number of resistors Rm may be 256.

The number of transfer thyristors T may be larger than the number of light emitting thyristors L.

FIG. 5 shows the light emitting thyristors L1 to L6, the transfer thyristors T1 to T6, and the like.

Next, the basic operation and structure of the light emitting chip U will be described.

Figure 6A:
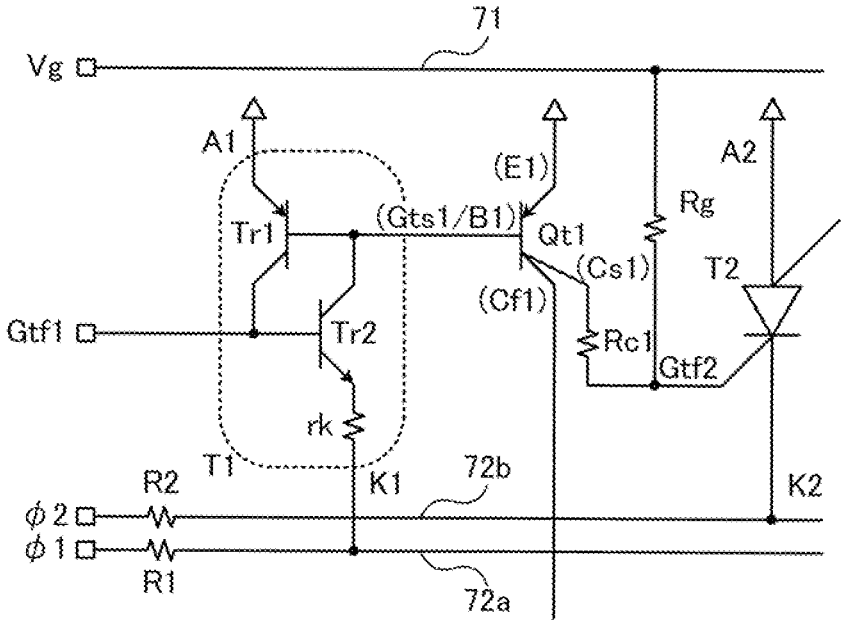
FIGS. 6A and 6B are diagrams for explaining a portion of a transfer thyristor and a coupling transistor in the light emitting chip.
Figure 6B:
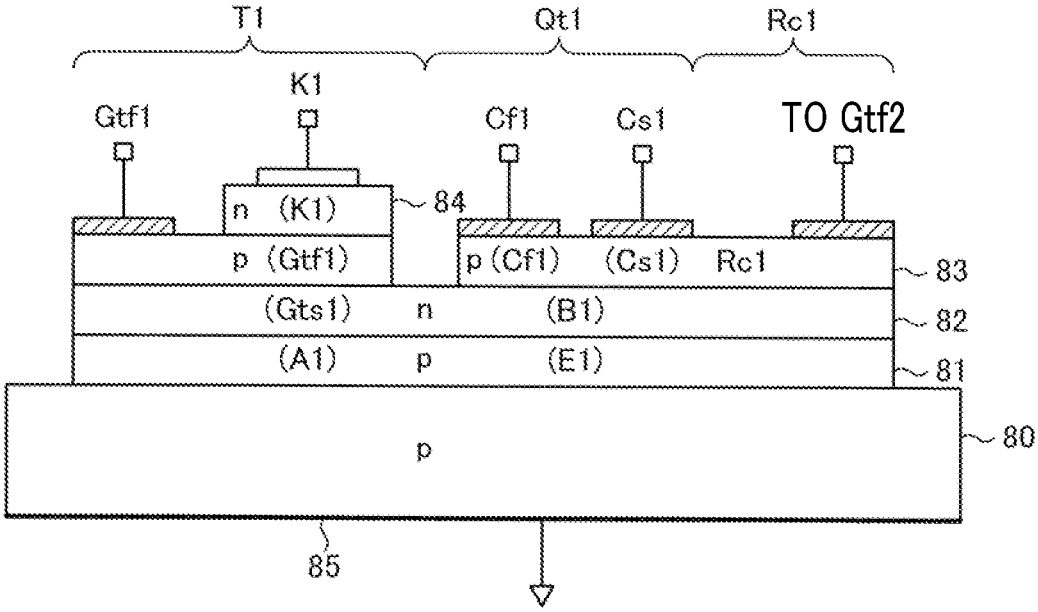

FIGS. 6A and 6B are diagrams for explaining the transfer thyristor T and the coupling transistor Qt in the light emitting chip U. FIG. 6A is an equivalent circuit, and FIG. 6B is a cross-sectional structure.

FIG. 6A shows the transfer thyristors T1, T2 and the coupling transistor Qt1 in FIG. 5. In FIGS. 6A and 6B, in order to facilitate the description, it is set that an anode is A1 and a cathode is K1 in the transfer thyristor T1, an anode is A2 and a cathode is K2 in the transfer thyristor T2, an emitter is E1, a base is B1, a first collector is Cf1, and a second collector is Cs1 in the coupling transistor Qt1, and a coupling resistor is Rc1. Here, in order to describe the operation of the transfer thyristor T1 and the coupling transistor Qt1, the transfer thyristor T1 is indicated by equivalent pnp bipolar transistors Tr1 and npn bipolar transistors Tr2. The pnp bipolar transistor Tr1 is described as a pnp transistor Tr1, and the npn bipolar transistor Tr2 is described as a npn transistor Tr2.

First, the cross-sectional structure of the transfer thyristor T1 and the coupling transistor Qt1 is described with reference to FIG. 6B.

The light emitting chip U includes plural island-like regions (islands) formed by separating a semiconductor stacked body in which on a substrate 80 of a p-type as an example of a first conductivity type, a p-type first semiconductor layer 81, and a second semiconductor layer 82 of a n-type as an example of a second conductivity type, a p-type third semiconductor layer 83, and a n-type fourth semiconductor layer 84 are sequentially stacked by so-called mesa etching. In the plural islands, at least the n-type second semiconductor layer 82, the p-type third semiconductor layer 83, and the n-type fourth semiconductor layer 84 are mutually separated from each other. The p-type first semiconductor layer 81 may or may not be separated, and a part in the thickness direction may be separated. Further, the p-type first semiconductor layer 81 may also serve as the substrate 80.

As shown in FIG. 6B, the transfer thyristor T1 and the coupling transistor Qt1 with number 1 constitute one island.

The transfer thyristor T1 uses the p-type first semiconductor layer 81 as an anode A1, the n-type second semiconductor layer 82 as a second gate Gts1, the p-type third semiconductor layer 83 as a first gate Gtf1, and the fourth semiconductor layer 84 as a cathode K1. On the p-type third semiconductor layer 83 exposed by removing the n-type fourth semiconductor layer 84, an electrode (without a reference numeral) forming an ohmic contact with the p-type semiconductor layer is a first gate Gtf1 terminal.

The coupling transistor Qt1 uses the p-type first semiconductor layer 81 as an emitter E1, the n-type second semiconductor layer 82 as a base B1, and the p-type third semiconductor layer 83 as a first collector Cf1 and a second collector Cs1. Then, on the p-type third semiconductor layer 83 exposed by removing the n-type fourth semiconductor layer 84, two electrodes (without a reference numeral) forming an ohmic contact with the p-type semiconductor layer are the first collector Cf1 terminal and the second collector Cs1 terminal.

The coupling resistor Rc1 is formed of the third semiconductor layer 83, one thereof is connected to the second collector Cs1 which is the p-type third semiconductor layer 83, and the other is connected to the electrode provided on the p-type third semiconductor layer 83. This electrode is connected to the first gate Gtf2 of the transfer thyristor T2 provided adjacent through the wiring.

As shown in FIG. 6B, the p-type third semiconductor layer 83 is removed and the n-type second semiconductor layer 82 remains between the transfer thyristor T1 and the coupling transistor Qt1. That is, the second gate Gts1 of the transfer thyristor T1 and the base B1 of the coupling transistor Qt1 are connected by the n-type second semiconductor layer 82.

The p-type first semiconductor layer 81 which is the anode A1 of the transfer thyristor T1 and the emitter E1 of the coupling transistor Qt1 is set to the reference voltage Vsub through the back electrode 85 provided on the back surface of the p-type substrate 80. That is, the p-type first semiconductor layer 81 and the n-type second semiconductor layer 82 do not need to be separated between the anode A1 of the transfer thyristor T1 and the coupling transistor Qt1.

Thus, the transfer thyristor T1 and the coupling transistor Qt1 of FIG. 6A are configured. An island including a transfer thyristor T and a coupling transistor Qt of another same number has a similar configuration. However, the even-numbered coupling transistors Qt do not have the second collector Cs. Therefore, the first collector Cf is the collector C.

Although not shown, the setting thyristor W and the setting transistor Qw having the same number constitute one island, and the light emitting thyristor L constitutes one island. The resistors R1, R2, R3, R4, Rg, Rw, Rn, RI1, RI2, Rd1*a*, Rd2*a*, Rd1*b*, Rd2*b*, Rr1, Rr2 each constitute one island. Further, the start resistor Rs constitutes one island. Some of these resistors may be combined into one island.

Next, the operation between the transfer thyristors T1, T2, the coupling transistor Qt1, and the coupling resistor Rc1 will be described with reference to FIG. 6A.

As shown in FIG. 6A, the transfer thyristor T1 has a configuration in which a pnp transistor Tr1 and a npn transistor Tr2 are combined. That is, the base of the pnp transistor Tr1 is connected to the collector of the npn transistor Tr2, and the collector of the pnp transistor Tr1 is connected to the base of the npn transistor Tr2. Then, the emitter of the pnp transistor Tr1 is the anode A1 of the transfer thyristor T1, the collector of the pnp transistor Tr1 (the base of the npn transistor Tr2) is the first gate Gtf1 of the transfer thyristor T1, the collector of the npn transistor Tr2 (the base of the pnp transistor Tr1) is the second gate Gts1 of the transfer thyristor T1, and the emitter of the npn transistor Tr2 is the cathode K1 of the transfer thyristor T1. The internal resistor rk in a case where the transfer thyristor T1 is in an on-state is shown between the emitter of the npn transistor Tr2 and the cathode K1 of the transfer thyristor T1.

The emitter of the pnp transistor Tr1, which is the anode A1 of the transfer thyristor T1, is connected to the reference voltage Vsub.

The coupling transistor Qt1 is the pnp transistor, and the emitter E1 is connected to the reference voltage Vsub. The base B1 is connected to the second gate Gts1 (the collector of the npn transistor Tr2 and the base of the pnp transistor Tr1) of the transfer thyristor T1. The second collector Cs1 is connected to the first gate Gtf2 of the transfer thyristor T2 through the coupling resistor Rc1. The first gate Gtf2 of the transfer thyristor T2 is connected to the power supply line 71 through the resistor Rg.

As shown in FIG. 6A, the pnp transistor Tr1 of the transfer thyristor T1 and the coupling transistor Qt1 constitute a current mirror circuit. That is, a current proportional to the current flowing to the pnp transistor Tr1 flows to the coupling transistor Qt1.

Hereinafter, as an example, the reference voltage Vsub supplied to the back electrode 85 (see FIG. 6B) which is a Vsub terminal is described as 0 V (hereinafter referred to as "H" (0 V) or "H") as a high level voltage, and the power voltage Vg supplied to the Vg terminal is described as −3.3 V (hereinafter referred to as "L" (−3.3 V) or "L") as a low level voltage. That is, the light emitting device 65 (see FIG. 3) is driven by a negative voltage.

As shown in FIG. 6B, the transfer thyristor T and the coupling transistor Qt have a p-type first semiconductor layer 81, an n-type second semiconductor layer 82, a p-type third semiconductor layer 83, and an n-type fourth semiconductor layer 84, which are stacked on the p-type substrate 80. As these layers are made of GaAs, GaAlAs, or the like, the forward voltage (diffusion voltage) Vd of the pn junction formed of p-type semiconductor layers (here, the first semiconductor layer 81, the third semiconductor layer 83) and the n-type semiconductor layers (here, the second semiconductor layer 82, the fourth semiconductor layer 84) is 1.5 V as an example.

Here, transfer signals φ1, φ2 are signals having the power voltage Vg ("L" (−3.3 V)) and the reference voltage Vsub ("H" (0 V)).

First, the basic operation of the transfer thyristor T1 will be described.

The anode A1 of the transfer thyristor T1 is at the reference voltage Vsub ("H" (0 V)).

In the transfer thyristor T1 in the off-state, the pnp transistor Tr1 and the npn transistor Tr2 that constitute the transfer thyristor T1 are in the off-state. Therefore, the current flowing between the anode A1 and the cathode K1 is smaller than the current in the on-state.

When the transfer signal φ1 transitions from "H" to "L", the φ1 transitions from "H" to "L" (see FIGS. 4 and 5). Then, the transfer signal line 72*a* connected to the cathode K1 of the transfer thyristor T1 goes to "L" (−3.3 V) through the resistor R1.

At this time, when the first gate Gtf1 of the transfer thyristor T1 is at a voltage higher than a value obtained by adding the diffusion voltage Vd (1.5 V) to "L" (−3.3 V), in this case, −1.8 V (the positive side is referred to as high, and the negative side is referred to as low), the npn transistor Tr2 is forward biased between the emitter and the base, and the npn transistor Tr2 transitions from the off-state to the on-state. Then, the collector of the npn transistor Tr2 is drawn to the "L" (−3.3 V) side of the transfer signal line 72*a*, and the pnp transistor Tr1 is forward biased between the emitter (the reference voltage Vsub ("H" (0 V))) and the base, and the pnp transistor Tr1 transitions from the off-state to the on-state. That is, the pnp transistor Tr1 and the npn transistor Tr2 are both turned on, and the transfer thyristor T1 transitions from the off-state to the on-state. The transition of the thyristor from the off-state to the on-state is referred to as turn on.

When the transfer thyristor T1 is turned on, the first gate Gtf1 of the transfer thyristor T1 goes to the saturation voltage Vc of the pnp transistor Tr1. Here, the saturation voltage Vc is, for example, −0.2 V. Therefore, the first gate Gtf1 goes to −0.2 V, and the second gate Gts1 goes to the voltage (−1.5 V) obtained by subtracting the diffusion voltage Vd (1.5 V) from the anode A1 ("H" (0 V)).

In the transfer thyristor T1 in the on-state, current flows from the anode A1 ("H" (0 V)) to the terminal φ1 ("L" (−3.3 V)). Therefore, the voltage Vk of the cathode K1 of the transfer thyristor T1 in the on-state is represented by Expression (2) from the internal resistor rk (the resistance value is rk) of the transfer thyristor T1 in the on-state, the resistor R1 (the resistance value is R1), and the diffusion voltage Vd.

$$Vk = (Vg + Vd) \times \frac{rk}{(R1 + rk)} - Vd \tag{1}$$

As an example, in a case where the resistance R1 is 300 S and the internal resistance rk is 60Ω, the voltage Vk of the cathode K1 is −1.8 V. The voltage Vk of the cathode K1 is the voltage on the transfer signal line 72*a*.

The same applies to odd-numbered transfer thyristors T other than the transfer thyristor T1.

In the case of the even-numbered transfer thyristors T, the resistance R1 may be replaced with the resistance R2 and the transfer signal line 72*a* may be replaced with the transfer signal line 72*b*. Here, assuming that the resistance R2 is the same as the resistance R1, the same applies to the even-numbered transfer thyristors T.

As described above, when the emitter (cathode K1)—the base (first gate Gtf1) of the npn transistor Tr2 constituting the transfer thyristor T1 is forward biased, the transfer thyristor T1 is turned on. Then, in order to make the emitter (cathode K1)—the base (first gate Gtf1) be forward biased, the voltage on the cathode K1 may be lower than the voltage obtained by subtracting the diffusion voltage Vd (1.5 V) from the voltage on the first gate Gtf1. A voltage obtained by subtracting the diffusion voltage Vd from the voltage on the first gate Gtf1 is denoted as a threshold voltage (threshold). That is, the threshold voltage of the transfer thyristor T1 is determined by the voltage on the first gate Gtf1, and when the cathode K1 (transfer signal line 72*a*) goes to a voltage (negative voltage large in absolute value) lower than the threshold voltage, the transfer thyristor T1 is turned on.

In the transfer thyristor T1 turned on, the cathode K1 has a voltage Vk (−1.8 V). When the voltage Vk (−1.8 V) (maintaining voltage) is applied to the cathode K1 and the current (maintaining current) capable of maintaining the on-state is continuously supplied from the power supply, the transfer thyristor T1 maintains the on-state.

On the other hand, the transfer thyristor T1 in the on-state transitions from the on-state to the off-state when a voltage (a negative voltage smaller in absolute value) higher than the voltage Vk (−1.8 V) (maintaining voltage) is applied to the cathode K1. The transition of the thyristor from the on-state to the off-state is referred to as turn off. For example, when the cathode K1 goes to "H" (0 V), the voltage is higher than the voltage Vk (−1.8 V) (maintaining voltage), and the cathode K1 and the anode A1 have the same voltage, and thus the transfer thyristor T1 is turned off.

Next, the operation of the coupling transistor Qt1 will be described.

In the transfer thyristor T1 in the off-state, the pnp transistor Tr1 is not forward biased between the emitter and the base, and is in the off-state. Therefore, the emitter E1—the base B1 of the coupling transistor Qt1 is not forward biased, and is in the off-state. That is, when the transfer thyristor T1 is in the off-state, the coupling transistor Qt1 is also in the off-state.

At this time, in the coupling transistor Qt1, the emitter E1 is set to the reference voltage Vsub ("H" (0 V)). Then, the emitter E1 is at the power voltage Vg ("L" (−3.3 V)) through the coupling resistor Rc1 to which the second collector Cs1 is connected in series and the resistor Rg. The same applies to the collector Cf1.

On the other hand, when the transfer thyristor T1 is turned on, the pnp transistor Tr1 is forward biased between the emitter (anode A1)—the base (second gate Gts1), and the pnp transistor Tr1 transitions from the off-state to the on-state. Then, since the base B1 of the coupling transistor Qt1 is connected to the second gate Gts1 of the transfer thyristor T1, the emitter E1—the base B1 is also forward biased. Thus, the coupling transistor Qt1 transitions from the off-state to the on-state.

Then, in the coupling transistor Qt1, the first collector Cf1 and the second collector Cs1 have the saturation voltage Vc (−0.2 V). Then, the voltage (referred to as Vgtf2) of the first gate Gtf2 of the transfer thyristor T2 is represented by Expression (1) from the saturation voltage Vc at the second collector Cs1 of the coupling transistor Qt1, the coupling resistor Rc1 (the resistance value is Rc), the resistor Rg (the resistance value is Rg).

$$Vgtf2 = (Vg - Vc) \times \frac{Rc}{(Rc + Rg)} + Vc \quad (2)$$

Here, in a case where Rc:Rg is set to 1:5, the voltage (Vgtf2) of the first gate Gtf2 of the transfer thyristor T2 goes to −0.78 V. That is, since the threshold voltage of the transfer thyristor T2 is a value (Vgtf2-Vd) obtained by subtracting the diffusion voltage Vd from the voltage Vgtf2 of the first gate Gtf2, as described above, the threshold voltage goes to −2.28 V. Since the first gate Gtf is connected to the power supply line 71 of "L" (−3.3 V) by the resistor Rg, the transfer thyristor T with the number of 3 or more has a threshold voltage of −4.8 V.

Then, when the transfer signal φ2 transitions from "H" to "L", the φ2 terminal transitions from "H" to "L" (see FIG. 5). Then, the transfer signal line 72*b* connected to the cathode K2 of the transfer thyristor T2 goes to "L" (−3.3 V) through the resistor R2. Then, the transfer thyristor T2 having a threshold voltage of −2.28 V is turned on.

In addition, Rc:Rg=1:5 is a condition under which the light emitting chip U operates even when the power voltage Vg supplied thereto decreases from "L" (−3.3 V) to −2 V in the absolute value. The operating margin of the light emitting chip U can be secured at 1.3 V which is the difference between −3.3 V and −2 V. Rc:Rg may be set by an operation margin or the like.

In the following, the coupling resistor Rc and the resistor Rg are described as Rc:Rg=1:5.

In the light emitting chip U, a period in which one transfer thyristor T of an odd-number is turned on, a period in which one transfer thyristor T of an odd-number and one transfer thyristor T of an even number larger by one are turned on, a period in which one transfer thyristor T of an even number is turned on, and a period in which one transfer thyristor T of an even number and one transfer thyristor T of an odd number larger by one are turned on are repeated, so the transfer thyristors T are sequentially turned on.

The cathodes of the odd-numbered transfer thyristors T are connected to the transfer signal line 72*a*, and the cathodes of the even-numbered transfer thyristors T are connected to the transfer signal line 72*b*.

Therefore, it is not preferable that the other transfer thyristors T whose cathodes are connected to the transfer signal line 72*a* (or the transfer signal line 72*b*) to which the transfer thyristors T in the on-state are connected are turned on in parallel.

As shown in FIG. 6A, when the transfer thyristor T1 is in the on-state, the adjacent transfer thyristor T2 has a threshold voltage of −2.28 V. Then, when the transfer thyristor T2 is turned on, the threshold voltage of the transfer thyristor T3 goes to −2.28 V, similarly to the transfer thyristor T2. At this time, the cathode of the transfer thyristor T3 is connected to the transfer signal line 72*a*. The transfer signal line 72*a* is at −1.8 V by the transfer thyristor T1 in the on-state. Thus, the transfer thyristor T3 is not turned on even when the threshold voltage is −2.28 V. The transfer thyristors T5, T7, . . . maintain a threshold voltage of −4.8 V.

In this manner, each time the transfer signals φ1, φ2 transition from "H" (0 V) to "L" (−3.3 V), the transfer thyristors T in the off-state are turned on gradually in order of number. Conversely, each time the transfer signals φ1, φ2 transition from "L" (−3.3 V) to "H" (0 V), the transfer thyristors T in the on-state are turned off gradually.

The transfer thyristor T1, the coupling transistor Qt1, and the coupling resistor Rc1 have been described above. The operations of the setting thyristor W, the setting transistor Qw, the light emitting thyristor L, and the light-off thyristor RT will be described in the timing chart described below.

Timing Chart

Next, the operation of the light emitting device 65 will be described.

The reference voltage Vsub is "H" (0 V), and the power voltage Vg is "L" (−3.3 V). The signals (the transfer signals φ1, φ2, the light-off signal φR, and the setting signals φWa1 to φWa20, φWb1 to φWb20) have voltages of "H" (0 V) and "L" (−3.3 V).

Further, as an example, the resistors R1, R2, R3, R4, RI1, RI2, Rr1, Rr2 each have 300Ω, and the resistor Rw has 10 kΩ. The start resistor Rs has 2 kΩ, the coupling resistor Rc has 2 kΩ, and the resistor Rg has 10 kΩ. The resistors Rd1*a*, Rd1*b* have 4 kΩ, and the resistors Rd2*a*, Rd2*b* have 1.6 kΩ. The resistor Rn has 60 kΩ.

The internal resistance of the setting thyristor W in the on-state is 60Ω, which is the same as the internal resistance rk of the transfer thyristor T in the on-state. That is, when the setting thyristor W is turned on, it is assumed that the cathode (setting signal lines 73*a*, 73*b*) goes to −1.8 V, similarly to the transfer thyristor T (transfer signal lines 72*a*, 72*b*). Further, it is assumed that the first gate Gwf has a saturation voltage Vc (−0.2 V). Then, it is assumed that the second gate Gws goes to −1.5 V.

The internal resistance Rp of the light emitting thyristor L is 20Ω. Then, in the light emitting thyristor L in the on-state, the cathodes (lighting signal lines 75*a*, 75*b*) go to −1.7 V. −1.7 V is an example of the on-state voltage. It is assumed that the gate G1 has the saturation voltage Vc (−0.2 V).

Further, in the light-off thyristor RT in the on-state, it is assumed that the gate Gr has a saturation voltage Vc (−0.2 V).

The above numerical values are examples, and other values can be set.

The light emitting device 65 includes light emitting chips U1 to U20 (see FIG. 3).

As shown in FIG. 4B, the reference voltage Vsub, the power voltage Vg, and the lighting voltage VI are commonly supplied to all the light emitting chips U (light emitting chips U1 to U20) on the circuit board 62.

Then, as described above, the transfer signals φ1, φ2 and the light-off signal φR are transmitted to the light emitting chips U1 to U20 in common. All light emitting chips U are driven in parallel.

Meanwhile, the setting signals φWa1, φWb1 among the setting signals φWa1 to φWa20, and φWb1 to φWb20 are transmitted to the light emitting chip U1. The same applies to other light emitting chips U. That is, the set of the setting signal φWa and the setting signal φWb is transmitted in parallel at the same timing. Thus, the light emitting chips U are driven in parallel.

In order to adjust the light amount of the light emitting thyristor L, the setting signal φWa and the setting signal φWb may be transmitted at shifted timings, or may be shifted and transmitted between the light emitting chips U.

Since the light emitting chips U2 to U20 are driven in parallel with the light emitting chip U1, it is sufficient to describe the operation of the light emitting chip U1.

Hereinafter, the operation of the light emitting chip U1 will be described.

Figure 7:
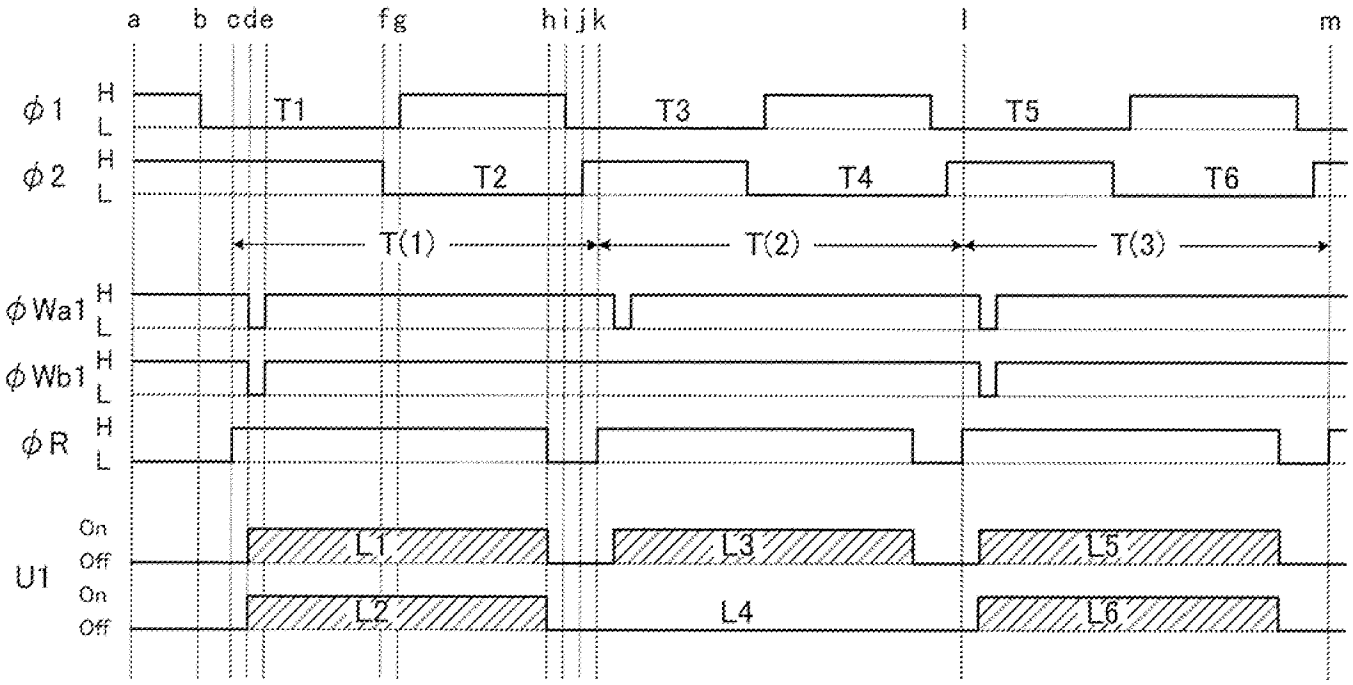
FIG. 7 is a timing chart for explaining the operation of the light emitting chip.

FIG. 7 is a timing chart for explaining the operation of the light emitting chip U1. Here, the light emitting chip U1 will be described as an example. Therefore, the setting signals are denoted by φWa1, φWb1. Then, it is assumed that time passes in alphabetical order (a, b, c, . . . ).

FIG. 7 shows a period in which the lighting of the light emitting thyristors L1 to L6 is controlled, the light emitting thyristors L1, L2, L3, L5, L6 are in a light-on state, and the light emitting thyristor L4 is in a light-off state.

Hereinafter, the operation of the light emitting chip U1 will be described in order of time with reference to FIGS. 4 and 5. The same applies to the operations of other light emitting chips U. Here, the lighting control refers to controlling the light emitting thyristor L to a light-on state or a light-off state.

In FIG. 7, it is assumed that time passes in alphabetical order from time a to time m. The lighting of the light emitting thyristors L1, L2, the light emitting thyristors L3, L4, and the light emitting thyristors L5, L6 of the light emitting chip U1 is controlled in a period T(1) from time c to time k, a period T(2) from time k to time 1, and a period T(3) from time 1 to time m, respectively. In the same manner, the lighting of the light emitting thyristors L whose numbers are 7 or more is controlled. Here, the periods T(1), T(2), and T(3) have the same length.

With respect to the signal waveforms in the periods T(1), T(2), T(3), . . . , the same waveform is repeated except for the setting signals φWa1, φWb1 which change depending on image data.

Hereinafter, the period T(1) from time c to time k will be described. The period from time a to time c is a period in which the light emitting chip U1 starts operating. The signals during this period will be described in the description of the operation.

The signal waveforms of the transfer signals φ1, φ2, and the light-off signal φR in the period T(1) will be described.

The transfer signal φ1 is "L" at time c and transitions from "L" to "H" at time g. Then, the signal transitions from "H" to "L" at time i, and maintains "L" at time k.

The transfer signal φ2 is "H" at time c and transitions from "H" to "L" at time f. Then, the signal transitions from "L" to "H" at time j, and maintains "H" at time k.

Here, in a comparison between the transfer signal φ1 and the transfer signal φ2, the waveform of the transfer signal φ2 is obtained by shifting back the waveform of transfer signal φ1 in the period T(1) by ½ of the period T(1) (time c is shifted to time g). The transfer signals φ1, φ2 repeat on a period T basis. Then, "H" and "L" are alternately repeated with a period in which both become "L" like a period from time f to time g. Then, except for the period from time a to time b, the transfer signal φ1 and the transfer signal φ2 do not have a period in which both are "H".

The transfer thyristors T shown in FIGS. 6A and 6B are turned on sequentially in order of number, by a set of the transfer signals φ1, φ2.

The light-off signal φR transitions from "L" to "H" at time c, and transitions from "H" to "L" at time h. Then, at time k, the light-off signal φR transitions from "L" to "H".

The light-off signal φR is a signal for turning off the light emitting thyristor L in the light-on state as described later.

Next, the setting signals φWa1, φWb1 in the period T(1) will be described.

The setting signal φWa1 is "H" at time c, changes from "H" to "L" at time d, and changes from "L" to "H" at time e. The same applies to the setting signal φWb1. A period in which the setting signals φWa1, φWb1 are "L" is a period in which the transfer signal φ1 is "L".

Then, the operation of the light emitting device 65 will be described, according to the timing chart of the light emitting chip U1 shown in FIG. 7, with reference to FIGS. 4 and 5.

(1) Time a

The state (initial state) at time a when supply of the reference voltage Vsub and the power voltage Vg to the light emitting device 65 is started will be described.

It is assumed that the light emitting device 65 is powered on at time a of the timing chart shown in FIG. 7. Then, power is supplied to the signal generation circuit 110, and various signals and various voltages are set. Here, the reference voltage Vsub is set to "H" (0 V) by the reference voltage supply unit 160. Thus, the back electrode 85 of each light emitting chip U goes to "H" (0 V) through the power supply line 200*a*. The power voltage supply unit 170 sets the power voltage Vg to "L" (−3.3 V). Thus, the power supply line 71 of each light emitting chip U goes to "L" (−3.3 V) through the power supply line 200*b* and the Vg terminal.

At time a, as described later, the transfer thyristor T, the coupling transistor Qt, the setting thyristor W, the setting transistor Qw, and the light emitting thyristor L are all in the off-state.

Transfer signal generation unit 120 sets the transfer signals φ1, φ2 to "H" (0 V). Then, the transfer signal lines 201, 202 and the φ1 terminal and φ2 terminal of each light emitting chip U go to "H" (0 V). Thus, the transfer signal lines 72*a*, 72*b* are set to "H" (0 V) through the resistors R1, R2.

Similarly, the setting signal generation unit 130 sets the setting signals φWa1, φWb1 to "H" (0 V). Then, the setting signal lines 203*a*-1, 203*b*-1 and the φWa terminal and the φWb terminal of the light emitting chip U1 go to "H" (0 V). Thus, the setting signal lines 73*a*, 73*b* are set to "H" (0 V) through the resistors R3, R4.

On the other hand, the light-off signal generation unit 140 sets the light-off signal φR to "L" (−3.3 V). Then, the light-off signal line 204 and the φR terminal of each light emitting chip U go to "L" (−3.3 V). Thus, the light-off signal lines 76*a*, 76*b* are set to "L" (−3.3 V) through the resistors Rr1, Rr2.

On the other hand, the light-off signal generation unit 140 sets the light-off signal φR to "L" (−3.3 V). Then, the light-off signal lines 76*a*, 76*b* of each light emitting chip U are set to "L" (−3.3 V) through the light-off signal line 204 and the φR terminal of each light emitting chip U.

Further, the lighting voltage VI is set to "L" (−3.3 V) by the lighting voltage supply unit 150. Then, the lighting voltage supply unit 150 and the VI terminal go to "L" (−3.3 V). Thus, the lighting signal lines 75*a*, 75*b* go to "L" (−3.3 V) through the resistors RI1, RI2. Further, the voltage setting lines 74*a*, 74*b* are set to "L" (−3.3 V) through the resistors Rd1*a*, Rd2*a*, Rd1*b*, Rd2*b*.

Next, the operation of the light emitting chip U1 will be described, according to the timing chart shown in FIG. 7, with reference to FIG. 6. The same applies to the other light emitting chips U2 to U20.

Since the anodes of the transfer thyristor T, the setting thyristor W, the light emitting thyristor L, and the light-off thyristor RT are connected to the back electrode 85 which is a Vsub terminal, the anodes are set to "H".

The cathode of each of the odd-numbered transfer thyristors T1, T3, T5, . . . is connected to the transfer signal line 72*a* of "H", and the cathode of each of the even-numbered transfer thyristors T2, T4, T6, . . . is connected to the transfer signal line 72*b* of "H". Therefore, the anode and the cathode of the transfer thyristor T both go to "H", and the transfer thyristor T is in the off-state.

The emitters E of the coupling transistor Qt and the setting transistor Qw are set to "H" because the emitters are connected to the back electrode 85 which is the Vsub terminal.

The base B of the coupling transistor Qt is connected to the second gate Gts of the transfer thyristor T. Since the transfer thyristor T is in the off-state, the second gate Gts is at "H". Therefore, the coupling transistor Qt is in the off-state because the emitter and the base are both at "H".

Except for the first gate Gtf of the transfer thyristor T1 described later, the first gate Gtf of the transfer thyristor T is connected to the power supply line 71 of the power voltage Vg ("L" (−3.3 V)) through the resistor Rg. Therefore, in the transfer thyristor T, the first gate Gtf is "L" (−3.3 V) and the threshold voltage is −4.8 V.

The cathodes of the odd-numbered setting thyristors W are connected to the setting signal line 73*a* of "H". The cathodes of the even-numbered setting thyristors W are connected to the setting signal line 73*b* of "H". Therefore, the anode and the cathode of the setting thyristor W go to "H", and the setting thyristor W is in the off-state.

The base B of the setting transistor Qw is connected to the second gate Gws of the setting thyristor W. Since the setting thyristor W is in the off-state, the second gate Gws is at "H". Thus, the setting transistor Qw is in the off-state because the emitter E and the base B are both at "H".

The setting thyristor W has a threshold voltage of −4.8 V because the first gate Gwf is connected to the power supply line 71 of "L" through the resistor Rw.

The cathodes of the odd-numbered light emitting thyristors L are connected to the lighting signal line 75*a* which is "L" (−3.3 V) through the resistor RI1, and the cathodes of the even-numbered light emitting thyristors L are connected to the lighting signal line 75*b* which is "L" (−3.3 V) through the resistor RI2. However, since the setting transistor Qw is in the off-state, the gate G1 of the even-numbered light emitting thyristor L is connected to the voltage setting line 74*a* of "L" (−3.3 V) through the resistor Rn. Therefore, the odd-numbered light emitting thyristors L are not turned on and are in the off-state, even when the threshold voltage is −4.8 V and the lighting signal line 75*a* is "L" (−3.3 V). Similarly, the gate G1 of the even-numbered light emitting thyristor L is connected to the voltage setting line 74*b* of "L" (−3.3 V) through the resistor Rn. Therefore, the gate G1 of the even-numbered light emitting thyristor L is connected to the voltage setting line 74*b* through the resistor Rn. Therefore, the even-numbered light emitting thyristors L are not turned on and are in the off-state, even when the threshold voltage is −4.8 V and the lighting signal line 75*b* is "L" (−3.3 V).

Further, since the gate Gr of the light-off thyristor RT1 is connected to the lighting signal line 75*a* of "L" (−3.3 V), the threshold voltage is −4.8 V. The light-off thyristor RT1 has a cathode connected to the light-off signal line 76*a* of "L" (−3.3 V), but is not turned on and is in the off-state. Similarly, since the gate Gr of the light-off thyristor RT2 is connected to the lighting signal line 75*b* of "L" (−3.3 V), the threshold voltage is −4.8 V. The light-off thyristor RT2 has a cathode connected to the light-off signal line 76*b* of "L" (−3.3 V), but is not turned on and is in the off-state.

At time a, when the signal generation circuit 110 is activated, the light-off thyristors RT1, RT2 may be turned on. In this case, in the light-off thyristors RT1, RT2, the gates Gr go to −0.2 V. Therefore, the lighting signal line 75*a* connected to the gate Gr of the light-off thyristor RT1 and the lighting signal line 75*b* connected to the gate Gr of the light-off thyristor RT2 also go to −0.2 V.

At time a, since none of the light emitting thyristors L are lit, the lighting signal lines 75*a*, 75*b* may be −0.2 V.

The first gate Gtf of the transfer thyristor T1 in FIGS. 6A and 6B is connected to the φ2 terminal of "H" (0 V) through the start resistor Rs, and is connected to the power supply line 71 of "L" (−3.3 V) through the resistor Rg. Here, since the start resistor Rs has 2 kQ and the resistor Rg has 10 kQ, in the transfer thyristor T1, the first gate Gtf goes to −0.55 V and the threshold voltage is −2.05 V. The other transfer thyristors T have a threshold voltage of −4.8 V.

(2) Time b

At time b, the transfer signal φ1 transitions from "H" (0 V) to "L" (−3.3 V). Thus, the light emitting chip U1 enters an operating state.

Then, the transfer signal line 72*a* transitions from "H" to "L" through the resistor R1. The transfer thyristor T1 having a threshold voltage of −2.05 V is turned on. The odd-numbered transfer thyristor T with the number of 3 or more are not turned on because the threshold voltage is −4.8 V. On the other hand, the even-numbered transfer thyristors T are not turned on because the transfer signal line 72*b* is at "H" (0 V).

When the transfer thyristor T1 is turned on, the first gate Gtf goes to −0.2 V, and the second gate Gts goes to −1.5 V. Further, the cathode (the transfer signal line 72*a* in FIG. 5) goes to −1.8 V. Then, since the base B of the coupling transistor Qt1 is connected to the second gate Gts (−1.5 V), the coupling transistor Qt1 is forward biased between the emitter E and the base B, and transitions from the off-state to the on-state. Then, the first collector Cf and the second collector Cs of the coupling transistor Qt1 go to −0.2 V.

In the transfer thyristor T2, the first gate Gtf is connected to the second collector Cs of the coupling transistor Qt1 through the coupling resistor Rc, and is connected to the power supply line 71 by the resistor Rg. Since the coupling resistor Rc has 2 kΩ, and the resistor Rg has 10 kΩ, the first gate Gtf goes to −0.72 V, and the threshold voltage goes to −2.22 V.

On the other hand, when the first collector Cf of the coupling transistor Qt1 goes to −0.2 V, the setting thyristor W1 goes to −0.2 V because the first gate Gwf is connected to the first collector Cf of the coupling transistor Qt1, and the threshold voltage goes to −1.7 V. However, since the setting signal line 73*a* is at "H" (0 V), the setting thyristor W1 is not turned on.

Further, the setting thyristor W2 is also at −0.2 V because the first gate Gwf is connected to the first collector Cf of the coupling transistor Qt1, and the threshold voltage is −1.7 V. However, since the setting signal line 73*b* is at "H", the setting thyristor W2 is not turned on.

The other setting thyristors W maintain the threshold voltage of −4.8 V.

That is, at time b, the transfer thyristor T1 is turned on. Then, immediately after time b, the transfer thyristor T1 and the coupling transistor Qt1 are in the on-state, and the other transfer thyristors T, the setting thyristor W, the light emitting thyristor L, the coupling transistor Qt, the setting transistor Qw, and the light-off thyristors RT1, RT2 are in the off-state.

In the following, the thyristors (the transfer thyristor T, the setting thyristor W, the light emitting thyristor L, and the light-off thyristors RT1, RT2) and transistors (the coupling transistor Qt and the setting transistor Qw) which are in the on-state are shown, and the thyristors (the transfer thyristor T, the setting thyristor W, the light emitting thyristor L, and the light-off thyristors RT1, RT2) and transistors (the coupling transistor Qt and the setting transistor Qw) which are in the off-state are not shown.

(3) Time c

At time c, the light-off signal φR transitions from "L" (−3.3 V) to "H" (0 V).

Then, the light-off signal line 76*a* transitions from "L" to "H" through the resistor Rr1, and the light-off signal line 76*b* transitions from "L" to "H" through the resistor Rr2. Then, the cathodes and the anodes of the light-off thyristors RT1, RT2 both go to "H", and the light-off thyristors RT1, RT2 are turned off even in a case of being in the on-state. Thus, even when the light-off thyristors RT1, RT2 are in the on-state and the lighting signal lines 75*a*, 75*b* are at −0.2 V, the lighting signal lines 75*a*, 75*b* transition to the power voltage Vg ("L" (−3.3 V)) of the power supply line 71 through the resistors RI1, RI2.

Even when the lighting signal lines 75*a*, 75*b* transition to "L" (−3.3 V), the light emitting thyristor L is not turned on because the threshold voltage is −4.8 V.

Immediately after time c, the transfer thyristor T1 and the coupling transistor Qt1 are in the on-state.

(4) Time d

At time d, the setting signals φWa1, φWb1 transmitted to the light emitting chip U1 transition from "H" (0 V) to "L" (−3.3 V).

Then, the setting signal lines 73*a*, 73*b* transition from "H" to "L" through the resistors R3, R4. Thus, the setting thyristors W1, W2 having threshold voltage of −1.7 V are turned on. The setting thyristor W with the number of 3 or more is not turned on because the threshold voltage is −4.8 V.

When the setting thyristors W1, W2 are turned on, the second gate Gws goes to −1.5 V. Then, the setting transistors Qw1, Qw2 transition from the off-state to the on-state. Thus, the collector C of each of the setting transistors Qw1, Qw2 goes to −0.2 V. Further, the cathode (setting signal line 73*a*) of the setting transistor Qw1 and the cathode (setting signal line 73*b*) of the setting transistor Qw2 go to −1.8 V.

In the light emitting thyristor L1, the gate G1 is connected to the collector C of the setting transistor Qw1. Accordingly, in the light emitting thyristor L1, the gate G1 goes to −0.2 V, and the threshold voltage goes to −1.7 V. The lighting signal line 75*a* to which the cathode of the light emitting thyristor L1 is connected is at "L" (−3.3 V) at time c. Thus, the light emitting thyristor L1 is turned on and lit.

Similarly, in the light emitting thyristor L2, the gate G1 is connected to the collector C of the setting transistor Qw2. Accordingly, in the light emitting thyristor L2, the gate G1 goes to −0.2 V, and the threshold voltage goes to −1.7 V. The lighting signal line 75*b* to which the cathode of the light emitting thyristor L2 is connected is at "L" (−3.3 V) at time c. Thus, the light emitting thyristor L2 is turned on and lit.

The light emitting thyristor L1 has a gate G1 of −0.2 V and the cathode (lighting signal line 75*a*) of −1.7 V as described above, and the light emitting thyristor L2 has a gate G1 of −0.2 V and the cathode (lighting signal line 75*b*) of −1.7 V as described above.

Since the light-off thyristor RT1 is connected to the lighting signal line 75*a* with the gate Gr of −1.7 V, the threshold voltage goes to −3.2 V. Further, since the light-off thyristor RT2 is connected to the lighting signal line 75*b* with the gate Gr of −1.7 V, the threshold voltage goes to −3.2 V.

At this time, the voltage setting line 74*a* is connected to the gate G1 (−0.2 V) of the light emitting thyristor L1 through the resistor Rn. Therefore, a voltage difference between "L" (−3.3 V) of the VI terminal and −1.7 V of the lighting signal line 75*a* is distributed by the resistors RI1, Rd1*a*, Rd2*a*, and the voltage setting line 74*a* goes to −2.16 V. Similarly, the voltage setting line 74*b* is connected to the gate G1 of the light emitting thyristor L2 of −0.2 V through the resistor Rn. Therefore, a voltage difference between "L" (−3.3 V) of the VI terminal and −1.7 V of the lighting signal line 75*b* is distributed by the resistors RI2, Rd1*b*, Rd2*b*, and the voltage setting line 74*b* goes to −2.16 V.

Immediately after time d, the transfer thyristor T1, the coupling transistor Qt1, the setting thyristors W1, W2, and the setting transistors Qw1, Qw2 are in the on-state, and the light emitting thyristors L1, L2 are lit in an on-state.

(5) Time e

At time e, the setting signals φWa1, φWb1 transmitted to the light emitting chip U1 transition from "L" (−3.3 V) to "H" (0 V).

Then, the setting signal lines 73*a*, 73*b* transition from −1.8 V to "H" (0 V). The setting thyristors W1, W2 in the on-state are turned off because the cathode and the anode both are at "H". Then, the setting transistors Qw1, Qw2 transition from the on-state to the off-state.

The light emitting thyristors L1 and L2 in the on-state are maintained in the on-state because the lighting signal lines 75*a*, 75*b* are maintained at −1.7 V (maintenance voltage).

Even when the setting transistor Qw1 is turned off, the gate G1 of the light emitting thyristor L1 maintains at −0.2 V because the light emitting thyristor L1 is the on-state.

Immediately after time e, the transfer thyristor T1 and the coupling transistor Qt1 are in the on-state, and the light emitting thyristors L1, L2 are lit in an on-state.

(6) Time f

At time f, the transfer signal φ2 transitions from "H" (0 V) to "L" (−3.3 V).

Then, the transfer signal line 72*b* transitions from "H" to "L", and the transfer thyristor T2 whose threshold voltage is −2.22 V is turned on. However, even-numbered transfer thyristors T whose numbers are 4 or more are not turned on because the threshold voltage is −4.8 V.

When the transfer thyristor T2 is turned on, the cathode (transfer signal line 72*b*) of the transfer thyristor T2 goes to −1.8 V, as in the case where the transfer thyristor T1 is turned on at time b.

Then, when the transfer thyristor T2 is turned on, the coupling transistor Qt2 transitions from the off-state to the on-state, and the collector C of the coupling transistor Qt2 goes to −0.2 V.

Then, in the transfer thyristor T3 connected to the collector C, the first gate Gtf goes to −0.72 V and the threshold voltage goes to −2.22 V.

The light emitting thyristors L1, L2 in the on-state are maintained in the on-state because the lighting signal lines 75*a*, 75*b* are maintained at −1.7 V (maintenance voltage).

Immediately after time f, the transfer thyristors T1, T2 and the coupling transistors Qt1, Qt2 are in the on-state, and the light emitting thyristors L1, L2 are lit in an on-state.

(7) Time g

At time g, transfer signal φ1 transitions from "L" (−3.3 V) to "H" (0 V).

Then, the transfer signal line 72*a* transitions from −1.8 V to "H" (0 V). The transfer thyristor T1 in the on-state is turned off because the cathode and the anode both is at "H". Thus, the coupling transistor Qt1 transitions from the on-state to the off-state. The setting thyristors W1, W2 go to "L" (−3.3 V) of the power supply line 71 to which the respective first gates Gwf are connected through the resistor Rw, and the threshold voltage goes to −4.8 V. That is, the threshold voltages of all the setting thyristors W go to −4.8 V.

The light emitting thyristors L1 and L2 in the on-state are maintained in the on-state because the lighting signal lines 75*a*, 75*b* are maintained at −1.7 V (maintenance voltage). The gate G1 of the light emitting thyristors L1, L2 in the on-state is at −0.2 V.

Immediately after time g, the transfer thyristor T2 and the coupling transistor Qt2 are in the on-state, and the light emitting thyristors L1, L2 are lit in an on-state.

(8) Time h

At time h, the light-off signal φR transmitted to the light emitting chip U1 transitions from "H" (0 V) to "L" (−3.3 V).

Then, the light-off signal line 76*a* transitions from "H" (0 V) to "L" (−3.3 V) through the resistor Rr1, and the light-off signal line 76*b* transitions from "H" (0 V) to "L" (−3.3 V) through the resistor Rr2. Since the threshold voltage is −3.2 V, the light-off thyristors RT1, RT2 are turned on. Then, the gate Gr of the light-off thyristor RT1 goes to −0.2 V, and the lighting signal line 75*a* goes to −0.2 V. Similarly, the gate Gr of the light-off thyristor RT2 goes to −0.2 V, and the lighting signal line 75*b* goes to −0.2 V.

Then, since the voltage between the anode and the cathode goes to −0.2 V which is smaller in absolute value than the holding voltage (−1.7 V), the light emitting thyristors L1, L2 in the on-state are turned off and lit off (non-lit).

That is, the light emitting thyristors L1, L2 of the light emitting chip U1 are turned on and lit on at the timing when the setting signals φWa1, φWb1 transition from "H" to "L" at time d, and are turned off and lit off at the timing when the light-off signal φR transitions from "H" to "L" at time h. A period from time d to time h corresponds to the lighting (light emitting) period of the light emitting thyristors L1, L2 of the light emitting chip U1.

Immediately after time h, the transfer thyristor T2, the coupling transistor Qt2, and the light-off thyristors RT1, RT2 are in the on-state.

(9) Time i

At time i, the transfer signal φ1 transmitted to the light emitting chip U transitions from "H" (0 V) to "L" (−3.3 V).

Then, the transfer signal line 72*a* in the light emitting chip U1 transitions from "H" to "L". Then, the transfer thyristor T3 having a threshold voltage of −2.22 V is turned on. However, even-numbered transfer thyristors T whose numbers are 5 or more do not transition to the on-state because the threshold voltage is −4.8 V. Further, the transfer thyristor T1 is in the off-state, and the first gate Gtf is connected to the φ2 terminal of "L" (−3.3 V) through the start resistor Rs, and is connected to the power supply line 71 of "L" (−3.3 V) through the resistor Rg. Thus, the transfer thyristor T1 is not turned on because the threshold voltage is −4.8 V.

Then, the coupling transistor Qt3 transitions from the off-state to the on-state. Thus, the first collector Cf and the second collector Cs of the coupling transistor Qt3 go to −0.2 V.

Then, similar to the transfer thyristor T2 at time b, in the transfer thyristor T4, the first gate Gtf goes to −0.72 V and the threshold voltage goes to −2.22 V.

On the other hand, in the setting thyristor W3 connected to the first collector Cf, the first gate Gwf goes to −0.2 V and the threshold voltage goes to −1.7 V.

Immediately after time i, the transfer thyristors T2, T3, the coupling transistors Qt2, Qt3, and the light-off thyristors RT1, RT2 are in the on-state.

(10) Time j

At time j, the transfer signal φ2 transmitted to the light emitting chip U transitions from "L" (−3.3 V) to "H" (0 V).

Then, in the light emitting chip U1, the transfer signal line 72*b* transitions from "L" to "H". The transfer thyristor T2 in the on-state is turned off because the cathode and the anode both are at "H". Thus, the coupling transistor Qt2 transitions from the on-state to the off-state.

Immediately after time j, the transfer thyristor T3, the coupling transistor Qt3, and the light-off thyristors RT1, RT2 are in the on-state.

(11) Time k

At time k, the light-off signal φR transmitted to the light emitting chip U transitions from "L" (−3.3 V) to "H" (0 V).

Then, in the light emitting chip U1, the light-off signal lines 76*a*, 76*b* transition from the voltage (−1.7 V) of the cathode of the light-off thyristors RT1, RT2 in the on-state to "H" (0 V). The light-off thyristors RT1, RT2 turn off since the cathode and the anode both become "H". Then, the lighting signal lines 75*a*, 75*b* transition from −0.2 V of each gate Gr of the light-off thyristors RT1, RT2 to "L" (−3.3 V) of the lighting voltage VI.

Since the gates Gr of the light-off thyristors RT1, RT2 are respectively connected to the lighting signal lines 75*a*, 75*b* of the lighting voltage VI ("L" (−3.3 V)), the threshold voltage goes to −4.8 V.

Immediately after time k, the transfer thyristor T3 and the coupling transistor Qt3 are in the on-state.

In the above, the period T(1) in which the light emitting thyristors L1, L2 in the light emitting chip U1 are controlled ends.

After this, the period T(1) from time c to time k is repeated.

In a case where the light emitting thyristor L is not lit, the setting signal φWb1 is not set to "L" (−3.3 V) and may be maintained at "H" (0 V), in a period T(2) (between time k and time 1) during the control of the lighting of the light emitting thyristor L4. The setting thyristor W4 is not turned on, when the setting signal φWb1 does not go to "L" (−3.3 V) (see FIG. 5). Thus, the setting transistor Qw4 is also maintained in the off-state. Thus, the light emitting thyristor L4 is not turned on, and the threshold voltage is maintained at −4.8 V. Since the light emitting thyristor L4 is not turned on, the voltage setting line 74*b* is maintained at "L" (−3.3 V).

As described above, two setting thyristors W are connected to the coupling transistor Qt connected to the odd-numbered transfer thyristors T. A setting transistor Qw is connected to each setting thyristor W, and a light emitting thyristor L is connected to the setting transistor Qw. The odd-numbered transfer thyristors T are turned on to designate the light emitting thyristors L to be lit by control. The setting thyristor W is turned on to set the light emitting thyristor L designated by the transfer thyristor T to a lighting enabled state. When the lighting signal line 75 is "L" (−3.3 V), the setting thyristor W is turned on, and the light emitting thyristor L is turned on and lit.

A coupling resistor Rc is provided between the second collector Cs of the odd-numbered coupling transistor Qt and the first gate Gtf of the even-numbered transfer thyristor T in the subsequent stage. Similarly, a coupling resistor Rc is provided between the collector C of the even-numbered coupling transistor Qt and the first gate Gtf of the odd-numbered transfer thyristor T in the subsequent stage. Thus, the voltage (in the above example, −2.22 V) of the first gate Gtf (the first gate Gtf2 shown in FIG. 6A) of the off-state transfer thyristor T connected through the coupling resistor Rc to the collector C (including the second collector Cs) of the coupling transistor Qt which is turned on by the on-state transfer thyristor T is lower than the voltage (in the above example, −1.8 V) of the transfer signal line 72*a* or the transfer signal line 72*b* to which the cathode of the on-state transfer thyristor T is connected.

Thus, the transfer thyristors T are prevented from being turned on in a chain like a domino effect.

In the above, the operation of the light emitting chip U has been described, focusing on the light emitting thyristor L for lighting control. However, the light emitting chip U is provided with plural light emitting thyristors L, the cathodes of the odd-numbered light emitting thyristors L are connected to the lighting signal line 75*a*, and the cathodes of the even-numbered light emitting thyristors L are connected to the lighting signal line 75*b* in parallel. The gates G1 of the odd-numbered light emitting thyristors L are connected to the voltage setting line 74*a*, and the gates G1 of the even-numbered light emitting thyristors L are connected to the voltage setting line 74*b*.

As described above, the voltages of the lighting signal lines 75*a*, 75*b* change to "L" (−3.3 V) when none of the light emitting thyristors L are lit, and −1.7 V when one light emitting thyristor L is lit. For example, in a case where the light emitting chip U includes 512 light emitting thyristors L, 256 light emitting thyristors L are connected in parallel to the lighting signal lines 75*a*, 75*b*, respectively. Then, the light emitting thyristor L in the off-state works as a load capacitor against the fluctuation of the voltage on the lighting signal lines 75*a*, 75*b*.

Here, the light emitting chip U' of the comparative example will be described.

Figure 8:
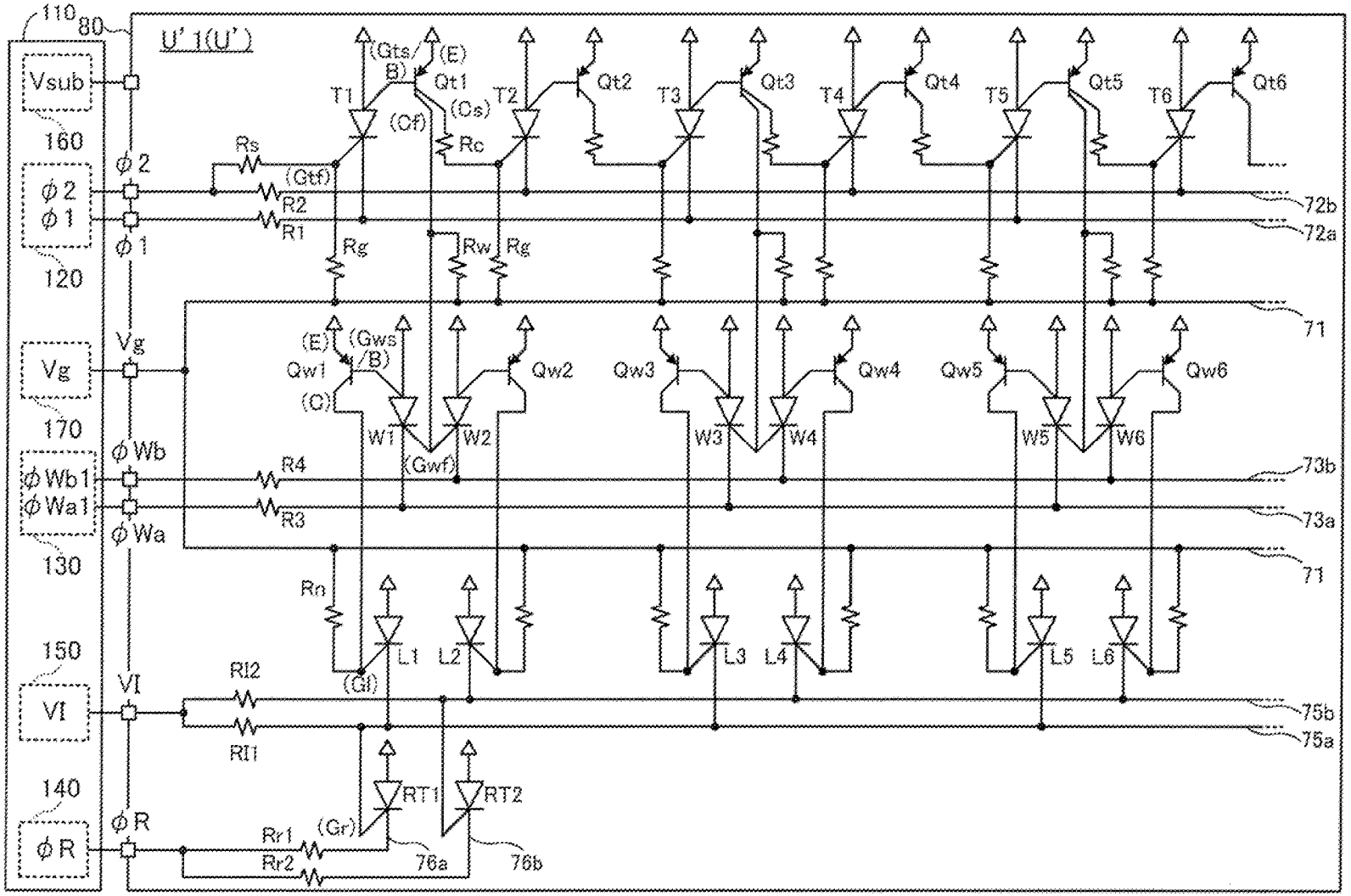
FIG. 8 is an example of an equivalent circuit diagram for explaining a configuration of a light emitting chip shown as a comparative example.

FIG. 8 is an example of an equivalent circuit diagram for explaining a configuration of the light emitting chip U' shown as a comparative example; The light emitting chip U' in the comparative example is configured to be able to replace the light emitting chip U to which the first exemplary embodiment is applied.

Here, the light emitting chip U' will be described by using the light emitting chip U'1 as an example in relation to the signal generation circuit 110. Therefore, in FIG. 8, the light emitting chip is denoted by U'1 (U'), and hereinafter, the light emitting chip is denoted by U'. The same portions as those of the light emitting chip U are denoted by the same reference numerals and the description thereof is omitted.

The light emitting chip U' does not include the voltage setting lines 74*a*, 74*b* in the light emitting chip U according to the first exemplary embodiment shown in FIG. 5. Therefore, the gate G1 of each light emitting thyristor L is connected to the power supply line 71 through the resistor Rn. Therefore, the configuration of the light emitting chip U' is simplified as compared to the light emitting chip U.

The light emitting chip U' operates according to the timing chart shown in FIG. 7 in the same manner as the light emitting chip U. The voltage on the gate G1 of the light emitting thyristor L is different from the voltage on the light emitting chip U as described below.

The portion (light emitting unit 102) of the light emitting thyristor L of the light emitting chip U' will be described.

Figure 9A:
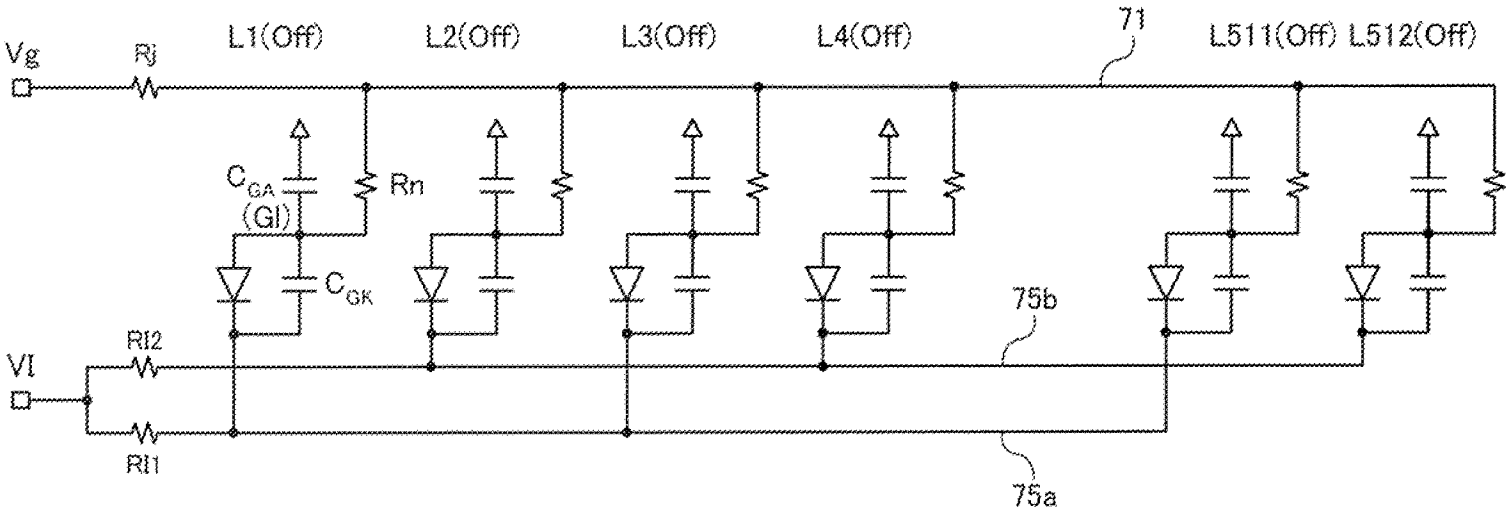
FIGS. 9A and 9B are equivalent circuits of light emitting thyristors (light emitting units) in the light emitting chip shown as the comparative example.
Figure 9B:
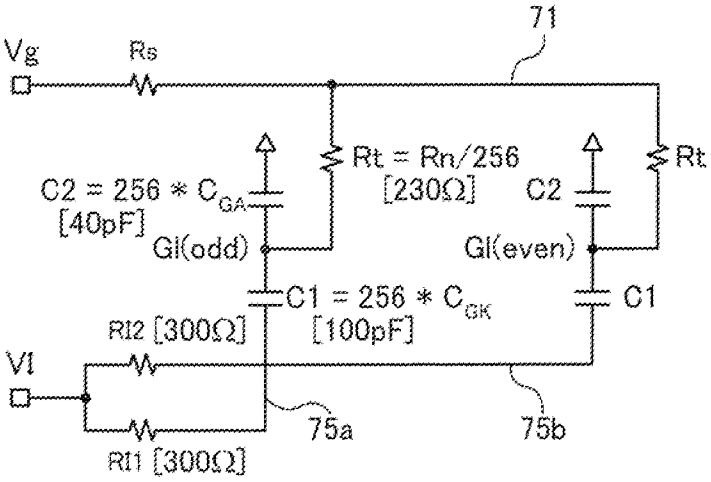

FIGS. 9A and 9B are equivalent circuits of the portion (light emitting unit 102) of the light emitting thyristor L of the light emitting chip U' shown as comparative examples. FIG. 9A is an equivalent circuit individually showing light emitting thyristors L, and FIG. 9B is an equivalent circuit in which light emitting thyristors are integrated. Here, it is assumed that there are 512 light emitting thyristors L. Then, all the light emitting thyristors L are in the off-state.

In FIG. 9A, the light emitting thyristor L in the off-state will be described. The light emitting thyristor L in the off-state can be regarded as a capacitor. Here, there are a capacity $C_{GK}$ between the gate G1 and the cathode of each light emitting thyristor L, and a capacity $C_{GA}$ between the gate G1 and the anode. Further, the part between the gate G1 and the cathode of the light emitting thyristor L is approximated by a diode. Therefore, as shown in FIG. 9A, the light emitting thyristor L1 is approximated by the capacitor $C_{GK}$ and the capacitor $C_{GA}$ connected in series, and a diode connected in parallel to the capacitor $C_{GK}$. The connection point between the capacitor $C_{GK}$ and the capacitor $C_{GA}$ is a gate G1. Then, in the odd-numbered light emitting thyristors L, the non-connection point side terminal of the capacitor $C_{GA}$ is connected to the reference voltage Vsub, and the non-connection point side terminal of the capacitor $C_{GK}$ is connected to the lighting signal line 75*a*. In the even-numbered light emitting thyristors L, the non-connection point side terminal of the capacitor $C_{GA}$ is connected to the reference voltage Vsub, and the non-connection point side terminal of the capacitor $C_{GK}$ is connected to the lighting signal line 75*b*. The resistor Rj provided on the power supply line 71 is a parasitic resistor of the power supply line 71.

The gate G1 of the light emitting thyristor L is connected to the power supply line 71 of the power voltage Vg and has the same voltage. Therefore, as shown in FIG. 9B, the odd-numbered light emitting thyristors L and the even-numbered light emitting thyristors L may be grouped together. That is, the capacitance may be 256 times and the resistance may be 1/256. The odd-numbered light emitting thyristor L is represented by a series connection of a capacitor C1 256 times the capacitor $C_{GK}$ and a capacitor C2 256 times the capacitor $C_{GA}$. Further, a resistor Rt which is 1/256 of the resistor Rn is denoted. The gate G1 of the odd-numbered light emitting thyristor L is described as a gate G1 (odd), and the gate G1 of the even-numbered light emitting thyristor L is described as a gate G1 (even). Since the light emitting thyristor L is in the off-state, the description of the diode that approximates the light emitting thyristor L is omitted. Here, for example, the capacitor C1 has 100 pF, and the capacitor C2 has 40 pF. Then, since the resistor Rn has 60 kΩ, the resistor Rt has 230Ω.

Here, the capacitor C1 is an example of a first parasitic capacitor, and the capacitor C2 is an example of a second parasitic capacitor.

The odd-numbered light emitting thyristors L and the even-numbered light emitting thyristors L have the same configuration. Therefore, either the odd-numbered light emitting thyristors L or the even-numbered light emitting thyristors L perform the same operation. Therefore, the operation before and after one light emitting thyristor L is lit will be described for one of the odd numbered light emitting thyristors L and the even numbered light emitting thyristors L.

Figure 10A:
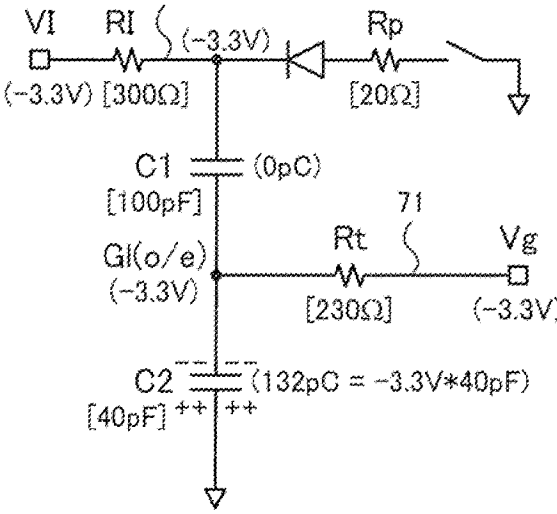
FIGS. 10A to 10D are diagrams for explaining operations before and after lighting the light emitting thyristors in the light emitting chip shown as the comparative example.
Figure 10B:
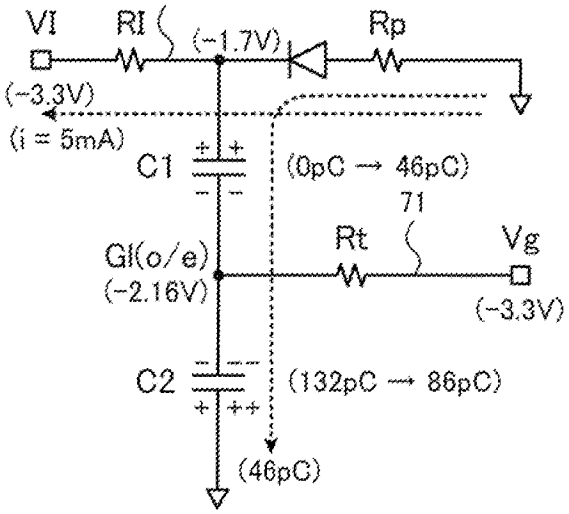
Figure 10C:
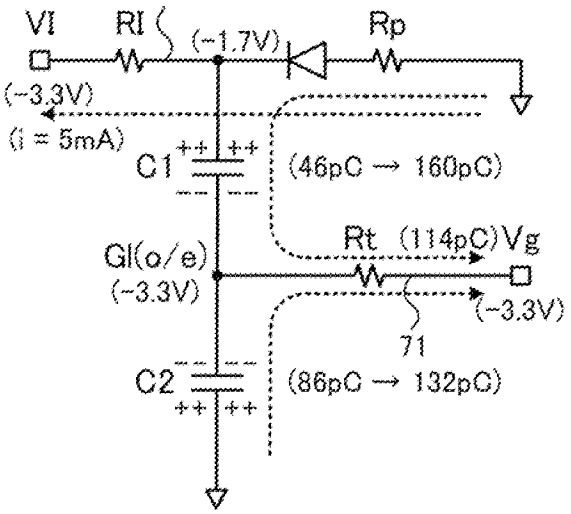
Figure 10D:
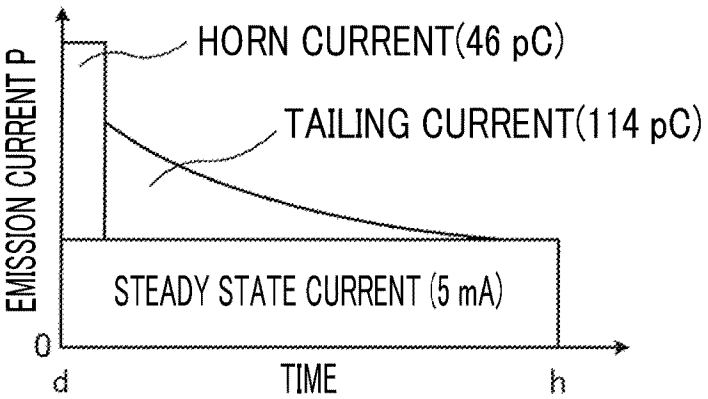

FIGS. 10A to 10D are diagrams for explaining operations before and after lighting the light emitting thyristor L in the light emitting chip U' shown as the comparative example. FIG. 10A shows a state before lighting, FIG. 10B shows a state immediately after lighting, FIG. 10C shows a steady state, and FIG. 10D shows a change of an emission current P over time. Note that the gate G1 (odd) and the gate G1 (even) are not distinguished, and are denoted as a gate G1 (o/e). Similarly, the lighting signal line 75*a* or the lighting signal line 75*b* is not distinguished from one another and is described as the lighting signal line 75, and the resistors RI1, RI2 are not distinguished from one another, and is described as the resistor RI. In addition, the light emitting thyristor L in the on-state is approximated by one diode. As described above, the internal resistor Rp has 20Ω. Moreover, the resistor RI has 300Ω. Since one light emitting thyristor L is turned on, the capacitors C1, C2 are set to 40 pF and 100 pF.

The state before lighting shown in FIG. 10A corresponds to the state between time c and time d in the timing chart shown in FIG. 7. At this time, since the light emitting thyristor L is in the off-state, no current flows. The lighting signal line 75 is at "L" (−3.3 V). Further, the gate G1 is connected to the Vg terminal of the power voltage Vg ("L" (−3.3 V)) through the resistor Rt. Therefore, the gate G1 (o/e) is at "L" (−3.3 V). Therefore, since both terminals (the lighting signal line 75 and the gate G1 (o/e)) of the capacitor C1 are at "L" (−3.3 V), no charge is accumulated in the capacitor C1. On the other hand, since one terminal (gate G1 (o/e)) of the capacitor C2 is at "L" (−3.3 V) and the other terminal (reference voltage Vsub) is at "H" (0 V), the charge of 132 pC is accumulated in the capacitor C2 of 40 pF due to the voltage difference of −3.3 V. The polarity is indicated by + and − in FIGS. 10A to 10D, and the amount of charge is indicated by the number of + and −. The same is applied to the other cases.

The state immediately after lighting shown in FIG. 10B is a state immediately after time d in FIG. 7. When one light emitting thyristor L transitions to the on-state, as described above, the lighting signal line 75 goes to −1.7 V. Then, a voltage difference (−1.6 V) between "L" (−3.3 V) of the VI terminal and −1.7 V of the lighting signal line 75 is applied to the resistor RI of 300Ω. Therefore, 5 mA (=−1.6 V/300Ω) flows as the current i in the light emitting thyristor L in the on-state. The current i steadily flows as long as the light emitting thyristor L is in the on-state. This is the steady state current (5 mA) shown in FIG. 10D.

At the initial stage where the light emitting thyristor L transitions to the on-state, a displacement current flows through the capacitors C1, C2. The displacement current changes the voltage between both terminals of series capacitor Cp (=C1×C2/(C1+C2)) of the capacitor C1 and the capacitor C2 from −3.3 V to −1.7 V by −1.6 V. In this example, the series capacitance Cp is 28.6 pF. Therefore, a total charge of 46 pC flows through the light emitting thyristor L in the on-state. This current changes the charge of the capacitor C1 from 0 pC to 46 pC and the charge of the capacitor C2 from 132 pC to 86 pC. Therefore, the gate G1 goes to −2.16 V.

The charge flows with a time constant (Rp×Cp) determined by the series capacitance Cp and the internal resistance Rp. In this example, the time constant is about 0.6 ns. This is a current shown as a horn current in FIG. 10D. The horn current is a large current which flows in a short time immediately after the light emitting thyristor L is turned on.

Next, the steady state shown in FIG. 10C is the state after the end of the horn current in FIG. 10D.

Since the voltage difference between the gate G1 (o/e) (−2.16 V) and the Vg terminal ("L" (−3.3 V)) occurs even when the horn current ends, a current flows through the light emitting thyristor L in the on-state until the voltage on the gate G1 (o/e) goes to −3.3 V. Thus, the charge stored in the capacitor C1 changes from 46 pC to 160 pC by 114 pC. Similarly, the charge stored in the capacitor C2 changes from 86 pC to 132 pC by 46 pC. This current flows with a time constant (C1×(Rt+Rp)) determined by the capacitor C1, the resistor Rt, and the internal resistor Rp. In this example, the time constant is 25 ns. This is the tailing current shown in FIG. 10D.

As shown in FIG. 10D, in the light emitting chip U', when one light emitting thyristor L transitions from the off-state to the on-state at time d in the timing chart of FIG. 7, as the emission current P, a steady state current which continues to flow over the on-state period, a large horn current which flows immediately after transition to the on-state, and a tailing current flowing to pull tailing following the horn current flow.

Therefore, it takes time until the emission current P of the light emitting thyristor L goes to a steady state current, that is, until the fluctuation of the light emission amount of the light emitting thyristor L decreases.

Next, the portion (light emitting unit 102) of the light emitting thyristor L in the light emitting chip U in the first exemplary embodiment will be described.

Figure 11A:
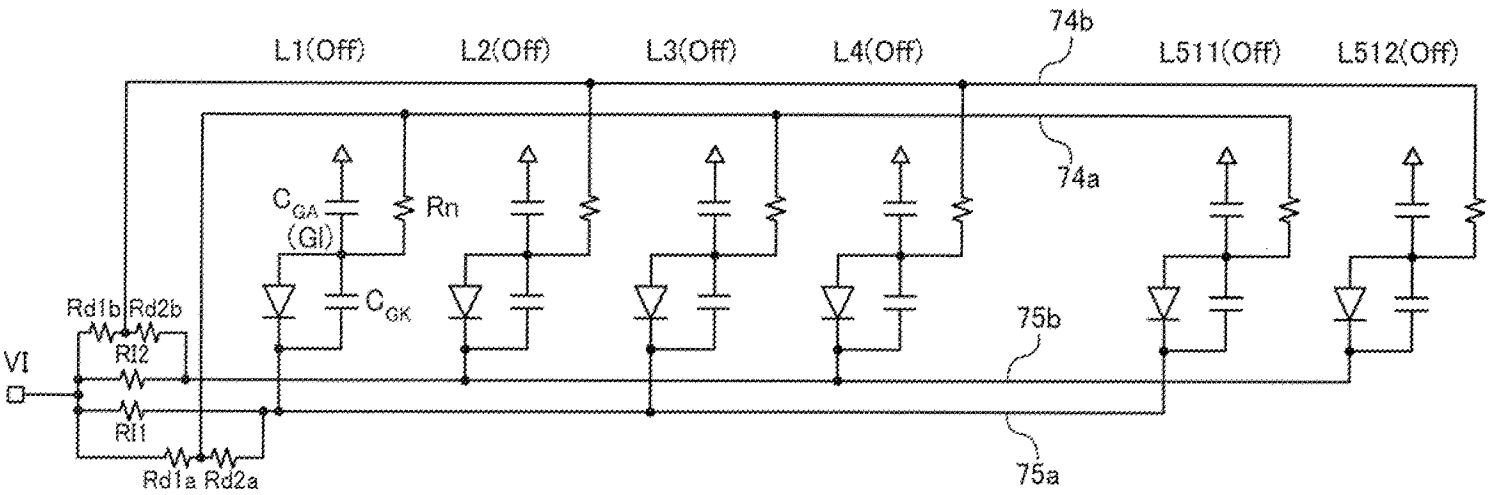
FIGS. 11A and 11B are equivalent circuits of portions (light emitting units) of light emitting thyristors of the light emitting chip to which the first exemplary embodiment is applied.
Figure 11B:
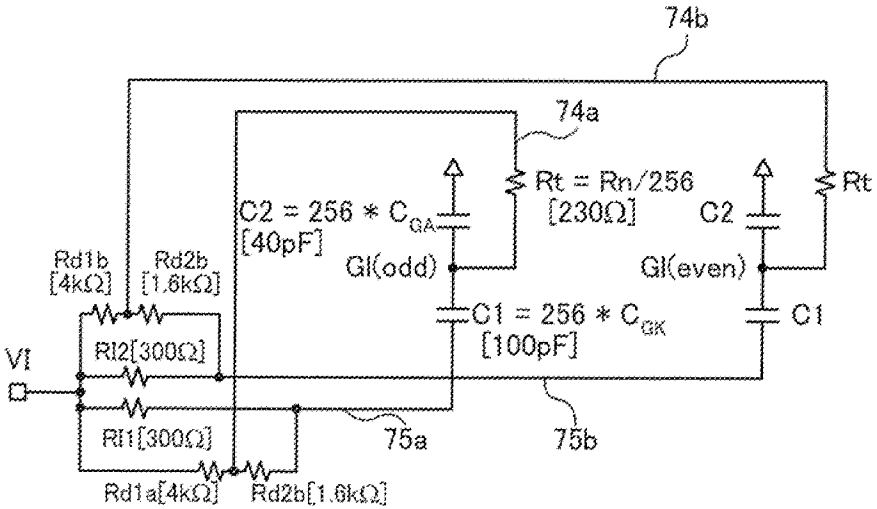

FIGS. 11A and 11B are equivalent circuits of the portion (light emitting unit 102) of the light emitting thyristor L of the light emitting chip U to which the first exemplary embodiment is applied. FIG. 11A is an equivalent circuit individually showing light emitting thyristors L, and FIG. 11B is an equivalent circuit in which light emitting thyristors L are integrated. Here, it is assumed that there are 512 light emitting thyristors L. Then, all the light emitting thyristors L are in the off-state.

In FIG. 11A, the light emitting thyristor L in the off-state will be described. In addition, the part different from FIG. 9A will be described, and the description of the same portion will be omitted. The gate G1 of the even-numbered light emitting thyristor L is connected to the voltage setting line 74*a* through the resistor Rn. The gate G1 of the even-numbered light emitting thyristor L is connected to the voltage setting line 74*b* through the resistor Rn. The voltage setting line 74*a* is connected to the connection point between resistors Rd1*a* and Rd2*a* connected in series, which is provided between the VI terminal and the lighting signal line 75*a*. The resistors Rd1*a*, Rd2*a* connected in series are connected in parallel to the resistor RI1. Similarly, the voltage setting line 74*b* is connected to the connection point between resistors Rd1*b* and Rd2*b* connected in series, which is provided between the VI terminal and the lighting signal line 75*b*. The resistors Rd1*b*, Rd2*b* connected in series are connected in parallel to the resistor RI2.

Similarly in FIG. 11B, the gate G1 (odd) is connected to the connection point between the resistors Rd1*a* and Rd2*a* connected in series, which is provided between the VI terminal and the lighting signal line 75*a*, and the gate G1 (even) is connected to the connection point between the resistors Rd1*b* and Rd2*b* connected in series, which is provided between the VI terminal and the lighting signal line 75*b*.

The resistors Rd1*a*, Rd1*b* are set to 4 kΩ as an example, and the resistors Rd2*a*, Rd2*b* are set to 1.6 kΩ as an example.

The odd-numbered light emitting thyristors L and the even-numbered light emitting thyristors L have the same configuration. Therefore, either the odd-numbered light emitting thyristors L or the even-numbered light emitting thyristors L perform the same operation. Therefore, the operation before and after one light emitting thyristor L is lit will be described for one of the odd numbered light emitting thyristors L or the even numbered light emitting thyristors L.

FIGS. 12A to 12D are diagrams for explaining operations before and after lighting the light emitting thyristor L in the light emitting chip U to which the second exemplary embodiment is applied. FIG. 12A shows a state before lighting, FIG. 12B shows a state immediately after lighting, FIG. 12C shows a steady state, and FIG. 12D shows a change of an emission current P over time. Note that the gate G1 (odd) and the gate G1 (even) are not distinguished, and are denoted as a gate G1 (o/e) of the light emitting thyristor L. Similarly, the lighting signal line 75*a* and the lighting signal line 75*b* are not distinguished from one another and are described as the lighting signal line 75, the voltage setting line 74*a* and the voltage setting line 74*b* are not distinguished from each other and are described as the voltage setting line 74, and the resistors RI1, RI2 are not distinguished from one another and are described as the resistor RI. In addition, the light emitting thyristor L in the on-state is approximated by one diode. Others are the same as the case of the light emitting chip U' described above.

The state before lighting shown in FIG. 12A is the same as the state of FIG. 10A, and none of the light emitting thyristors L is turned on, so the lighting signal line 75 and the voltage setting line 74 is at "L" (−3.3 V). The capacitor C1 stores charges of 0 pC, and the capacitor C2 stores charges of 132 pC.

In the state immediately after lighting shown in FIG. 12B, as in FIG. 10B, when one light emitting thyristor L is turned on, as described above, the lighting signal line 75 goes to −1.7 V. Then, a voltage difference (−1.6 V) between "L" (−3.3 V) of the VI terminal and −1.7 V of the lighting signal line 75 is applied to the resistor RI of 300Ω, so 5 mA (=−1.6 V/300Ω) flows to the light emitting thyristor L in the on-state as the current i. The current i steadily flows as long as the light emitting thyristor L is in the on-state. This current i is a steady state current (5 mA) shown in FIG. 12D.

Further, as in FIG. 10B, at the initial stage when the light emitting thyristor L is turned on, a displacement current flows through the capacitors C1, C2. The displacement current changes the voltage between both terminals of series capacitor Cp (=C1×C2/(C1+C2)) of the capacitor C1 and the capacitor C2 from −3.3 V to −1.7 V by −1.6 V. That is, a total charge of 46 pC flows through the light emitting thyristor L in the on-state. This current changes the charge of the capacitor C1 from 0 pC to 46 pC and the charge of the capacitor C2 from 132 pC to 86 pC. Therefore, the gate G1 goes to −2.16 V.

The charge flows with a time constant (Rp×Cp) determined by the series capacitance Cp and the internal resistance Rp. In this example, the time constant is about 0.6 ns. This is the horn current shown in FIG. 12D.

At this time, the voltage setting line 74 is connected to the connection point between the resistors Rd1 and Rd2 connected in series. The terminal on the serially connected resistor Rd1 side is connected to the lighting signal line 75 of −1.7 V, and the terminal on the resistor Rd2 side is connected to the VI terminal of "L" (−3.3 V). Therefore, the voltage setting line 74 is at −2.16 V. That is, the voltage on the gate G1 (o/e) and the voltage on the voltage setting line 74 are the same. This state is the same as the pseudo floating state, which allows following the voltage on the gate G1 (o/e).

In order to obtain such a voltage, the resistance values of the resistors Rd1, Rd2 may be set based on the capacitances of the capacitors C1, C2. That is, when resistance values of the resistors Rd1, Rd2 are Rd1, Rd2 and capacitances of the capacitors C1, C2 are C1, C2, Rd1 Rd2=C1: C2 may be set. In the above example, since C1 is 100 pF and C2 is 40 pF, Rd1 is 4 kΩ and Rd2 is 1.6 kΩ.

In the steady state shown in FIG. 12C, the voltage (−2.16 V) of the gate G1 (o/e) and the voltage (−2.16 V) of the voltage setting line 74 are the same, so no current flows between the gate G1 (o/e) and the voltage setting line 74. That is, only the steady state current (5 mA) flows.

As shown in FIG. 12D, in the light emitting chip U, when the light emitting thyristor L transitions from the off-state to the on-state, as the emission current P, a steady state current which continues to flow over the on-state period and a large horn current which flows immediately after transition to the on-state flow, but a tailing current seen in the light emitting chip U' is suppressed.

Therefore, the time until the emission current P of the light emitting thyristor L goes to a steady state current, that is, the time until the fluctuation of the light emission amount of the light emitting thyristor L decreases becomes shorter as compared to the light emitting chip U'.

Here, although the voltage on the gate G1 (o/e) and the voltage on the voltage setting line 74 are described to be the same, the voltage difference may be smaller than the light emitting chip U'. As the voltage difference decreases, the tailing current decreases, and the time until the emission current P of the light emitting thyristor L goes to a steady state, that is, the time until the fluctuation of the light emission amount of the light emitting thyristor L decreases becomes shorter. The voltage on the voltage setting line 74 can be set arbitrarily by the resistors Rd1, Rd2.

Figure 13A:
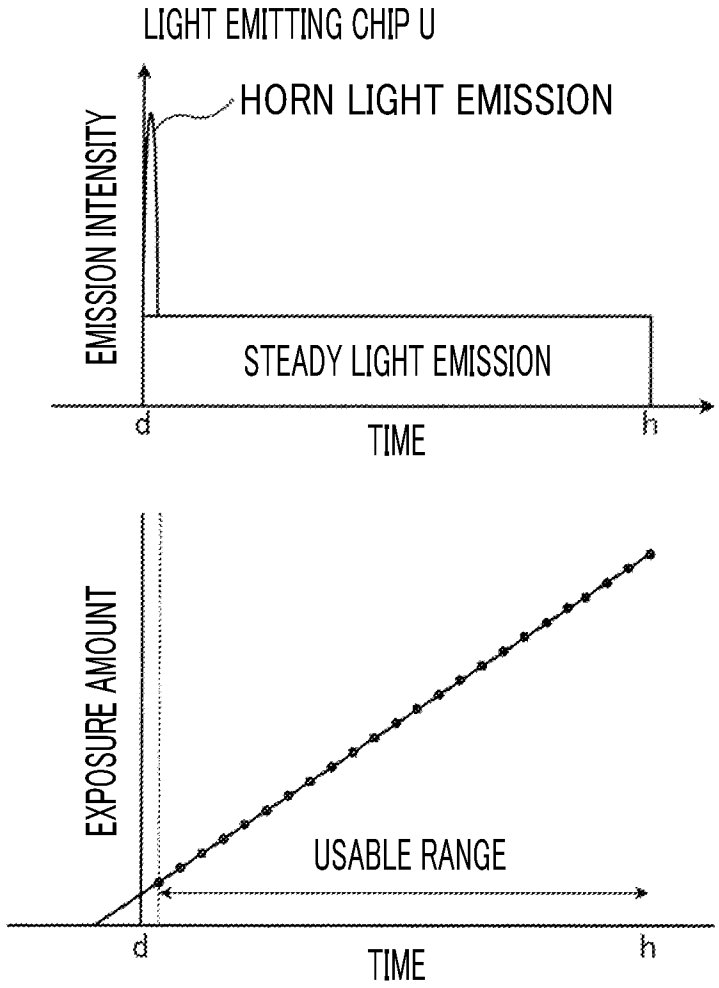
FIGS. 13A and 13B are diagrams for explaining a usable range for exposure.
Figure 13B:
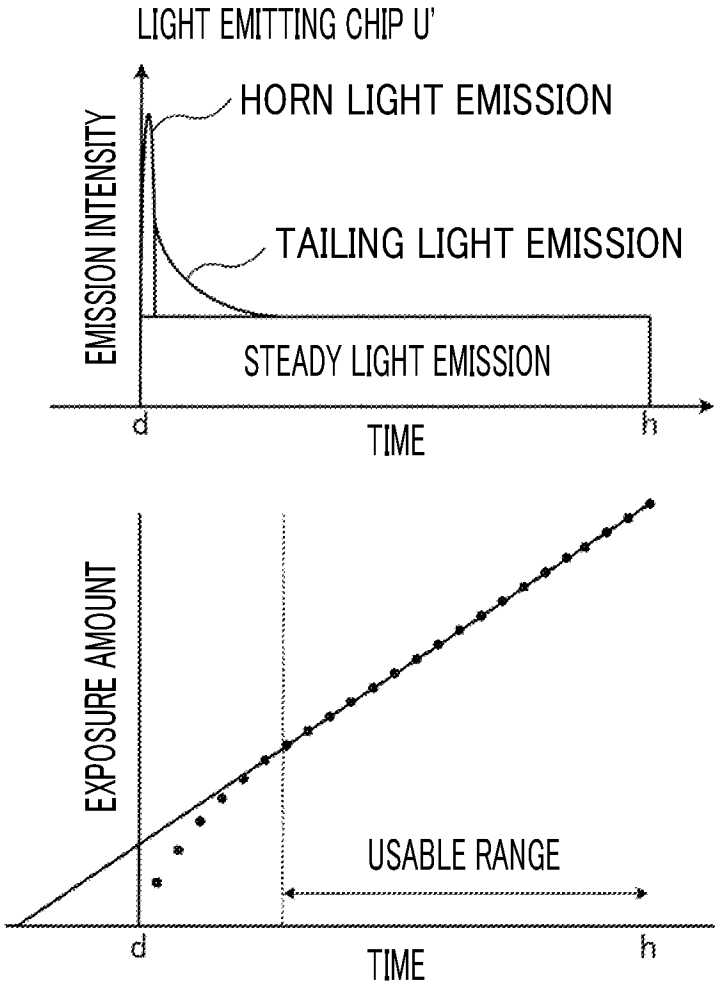

FIGS. 13A and 13B are diagrams for explaining a usable range for exposure. FIG. 13A is a case of a light emitting chip U to which the first exemplary embodiment is applied, and FIG. 13B is a case of a light emitting chip U' shown as a comparative example. The upper side is a diagram showing an emission intensity on the vertical axis and a time on the horizontal axis, and the lower side is a diagram showing an exposure amount on the vertical axis and a time on the horizontal axis. In the upper side of FIG. 13A, light emission due to the horn current is referred to as horn light emission, light emission due to the tailing current is referred to as tailing light emission, and light emission due to the steady state current is referred to as steady light emission. As shown in the lower side of FIG. 13A, here, the exposure amount is set according to the lighting time of the light emitting thyristor L. That is, in a case where it is desired to increase the exposure amount, the lighting time is set long, and in a case where it is desired to decrease the exposure amount, the lighting time is set short.

As shown in FIG. 13A, in the light emitting chip U, a case is shown where horn light emission occurs but tailing light emission does not occur. In this case, since the period of horn light emission is short, in the light emitting chip U, the usable range in which the exposure amount is set is wider than the usable range of the light emitting chip U' shown in FIG. 13B. That is, in the light emitting chip U' having tailing light emission shown in FIG. 13B, the period in which the tailing light emission occurs may not be set as the usable range for setting the exposure amount. That is, in the light emitting chip U, the linearity with respect to the exposure amount is secured due to the short light emitting period.

Further, as shown in FIG. 13A, in the light emitting chip U, since the tailing light emission does not occur, the minimum exposure amount is smaller than the exposure amount in the case of the light emitting chip U' shown in FIG. 13B. That is, in the light emitting chip U having no tailing light emission as shown in FIG. 13A, only the exposure amount due to horn light emission is the minimum exposure amount. On the other hand, in the light emitting chip U' having the tailing light emission shown in FIG. 13B, the exposure amount obtained by adding the horn light emission and the tailing light emission is the minimum exposure amount.

In the light emitting chip U, there is no tailing current (tailing light emission), but the tailing current may be suppressed as compared to the light emitting chip U'.

As described above, in the light emitting chip U to which the first exemplary embodiment is applied is provided with the voltage setting line 74, when one light emitting thyristor L is lit and the voltage on the lighting signal line 75 fluctuates, by setting the voltage on the gate G1 of the light emitting thyristor L in the off-state to a voltage different from the lighting voltage VI (here, "L" (−3.3 V)), the voltage on the gate G1 is prevented from fluctuating, and the tailing current is suppressed. At this time, the voltage on the voltage setting line 74 to which the gate G1 is connected is set by dividing the voltage difference between the lighting voltage VI and the lighting signal line 75 by the resistors Rd1, Rd2.

Next, a modification example of the light emitting chip U in the first exemplary embodiment will be described.

Figure 14:
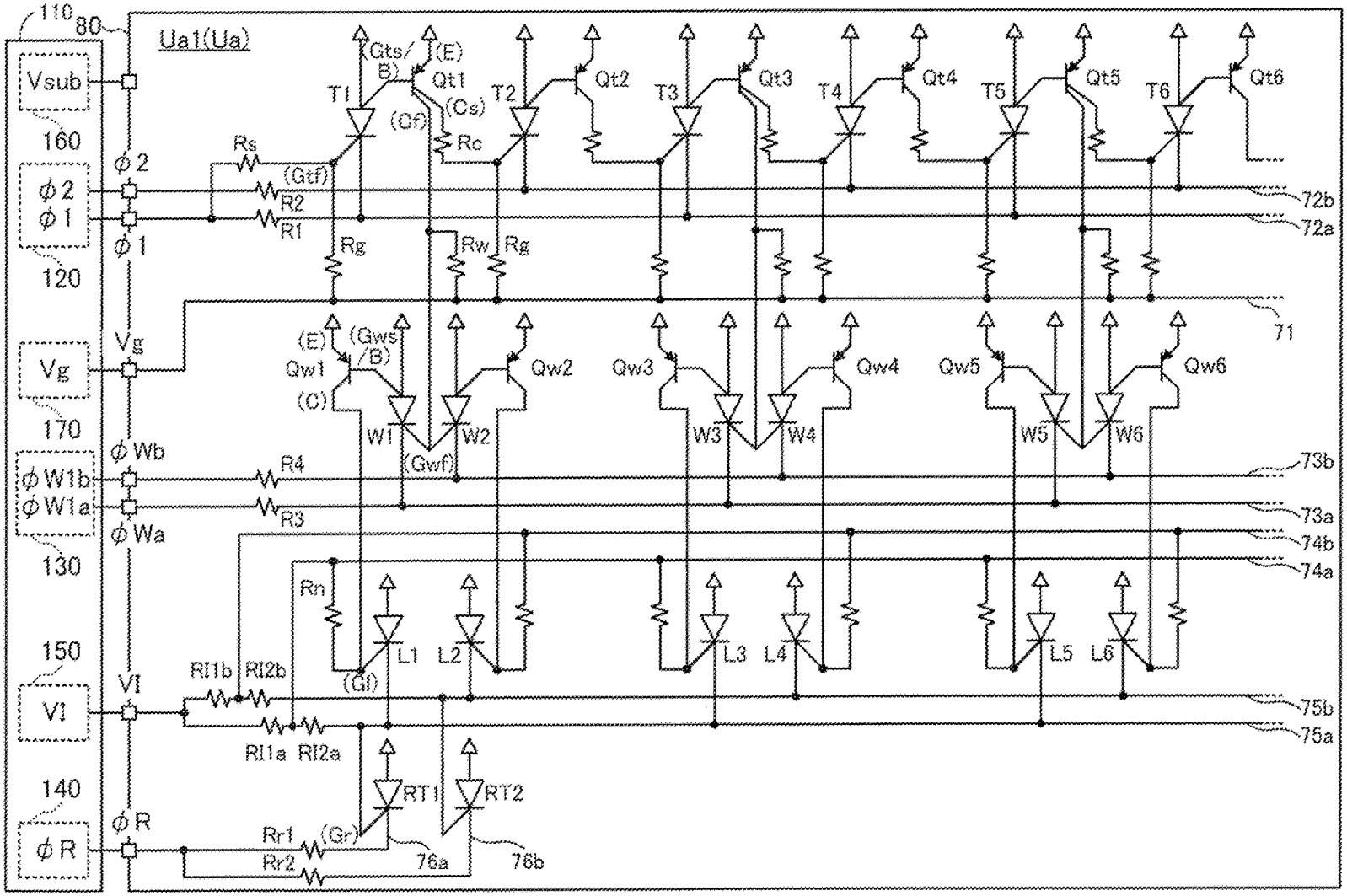
FIG. 14 is an example of an equivalent circuit diagram for explaining a configuration of a light emitting chip which is a modification example of the light emitting chip.

FIG. 14 is an example of an equivalent circuit diagram for explaining a configuration of a light emitting chip Ua which is a modification example of the light emitting chip U. The configuration is the same as the configuration of the first exemplary embodiment using the light emitting chip U, except that the light emitting chip U is a light emitting chip Ua, in the light emitting device 65 (see FIG. 4B) according to the first exemplary embodiment, so a description thereof will be omitted. Then, in FIG. 14, similarly to FIG. 5, the light emitting chip Ua will be described by using the light emitting chip Ua1 as an example in relation to the signal generation circuit 110. Therefore, in FIG. 14, the light emitting chip is denoted by Ua1 (Ua).

The light emitting chip Ua is different from the light emitting chip U in the method of connecting the VI terminal to which the lighting voltage VI is supplied, the lighting signal lines 75*a*, 75*b*, and the voltage setting lines 74*a*, 74*b*. The other configuration of the light emitting chip Ua is the same as the configuration of the light emitting chip U, so the description will be omitted.

In the light emitting chip Ua, the resistors RI1 of the light emitting chip U is replaced with resistors RI1*a*, RI1*b* connected in series. The connection point between the resistors RI1*a* and RI1*b* connected in series is connected to the voltage setting line 74*a*. Similarly, the resistor RI2 of the light emitting chip U is replaced with resistors RI2*a*, RI2*b* connected in series. The connection point between the resistors RI2*a* and RI2*b* is connected to the voltage setting line 74*b*. The resistors Rd1*a*, Rd2*a*, Rd1*b*, and Rd2*b* are not provided.

Even in this case, the voltage setting line 74*a* is set to a voltage obtained by dividing the lighting voltage VI and the voltage on the lighting signal line 75*a* by the resistors RI1*a*, RI1*b*. Similarly, the voltage setting line 74*b* is set to a voltage obtained by dividing the lighting voltage VI and the voltage on the lighting signal line 75*b* by the resistors RI2*a*, RI2*b*.

When resistance values of the resistors RI1*a*, RI1*b* are RI1*a* and RI1*b*, RI1*a*:RI1*b* may be set to C1:C2. Similarly, when resistance values of the resistors RI2*a*, RI2*b* are RI2*a* and RI2*b*, RI2*a*:RI2*b* may be set to C1:C2.

Figure 15:
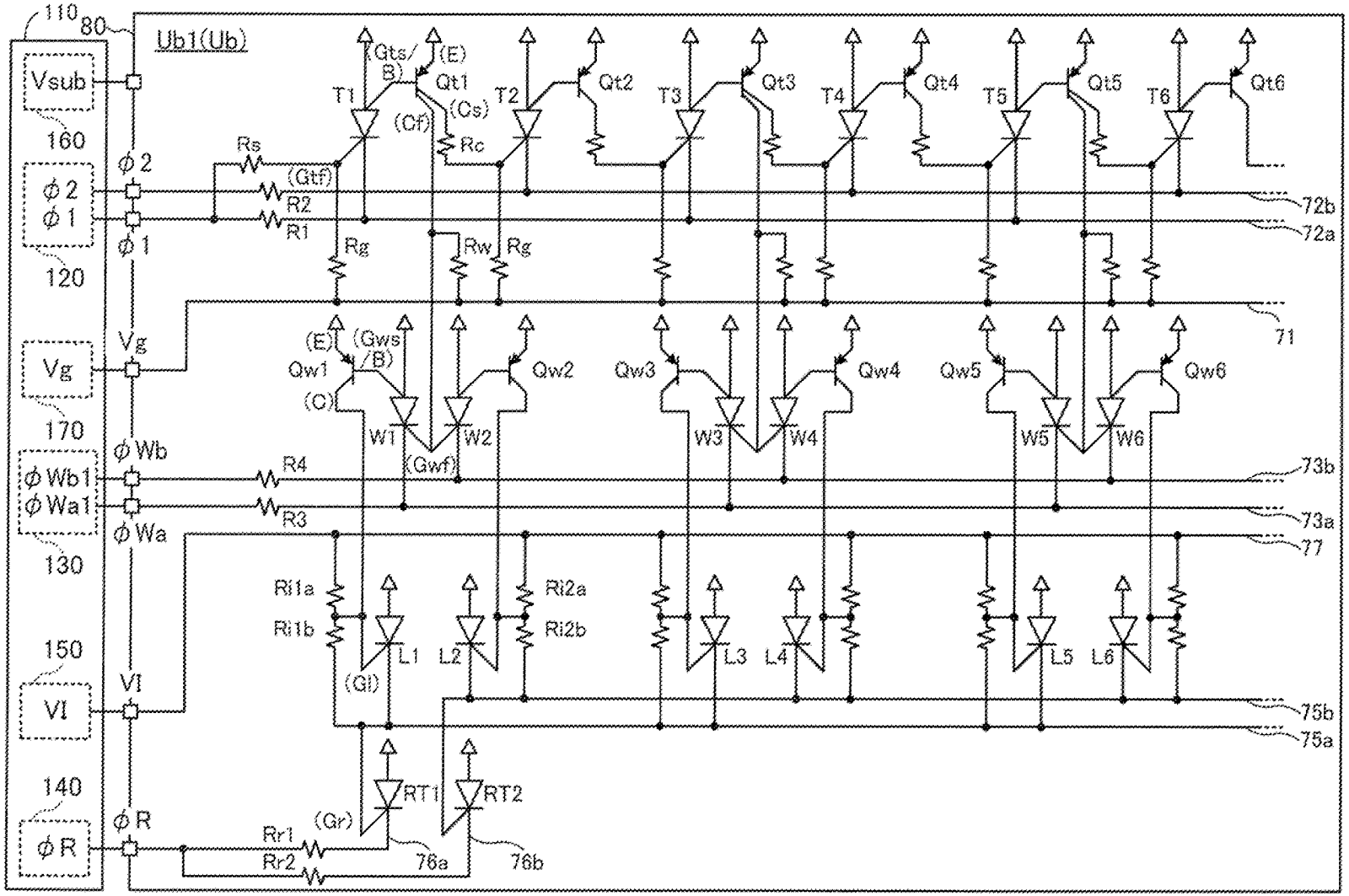
FIG. 15 is an example of an equivalent circuit diagram for explaining a configuration of a light emitting chip which is another modification example of the light emitting chip.

FIG. 15 is an example of an equivalent circuit diagram for explaining a configuration of a light emitting chip Ub which is another modification example of the light emitting chip U. The configuration is the same as the configuration of the first exemplary embodiment using the light emitting chip U, except that the light emitting chip U is a light emitting chip Ub, in the light emitting device 65 (see FIG. 4B) according to the first exemplary embodiment, so a description thereof will be omitted. Then, in FIG. 15, similarly to FIG. 5, the light emitting chip Ub will be described by using the light emitting chip Ub1 as an example in relation to the signal generation circuit 110. Therefore, in FIG. 15, the light emitting chip is denoted by Ub1 (Ub).

Unlike the light emitting chip U, the light emitting chip Ub includes the lighting voltage line 77 connected to the VI terminal to which the lighting voltage VI is supplied. The lighting voltage line 77 is connected to the lighting signal line 75*a* through the resistors Ri1*a*, Ri1*b* connected in series. The resistors Ri1*a*, Ri1*b* connected in series are provided for each of the odd-numbered light emitting thyristors L. The resistors Ri1*a*, Ri1*b* connected in series and the odd-numbered light emitting thyristor L form a set. Further, serially connected resistors Ri1*a*, Ri1*b* provided for each of the odd-numbered light emitting thyristors L are provided in parallel between the lighting signal line 75*a* and the lighting voltage line 77. The connection point between the resistors Ri1*a* and Ri1*b* connected in series is connected to the gate G1 of the odd-numbered light emitting thyristor L forming a set.

Similarly, the lighting voltage line 77 is connected to the lighting signal line 75*b* through the resistors Ri2*a*, Ri2*b* connected in series. The resistors Ri2*a*, Ri2*b* connected in series are provided for each of the even-numbered light emitting thyristors L. The resistors Ri2*a*, Ri2*b* connected in series and the even-numbered light emitting thyristor L form a set. Further, serially connected resistors Ri2*a*, Ri2*b* provided for each of the even-numbered light emitting thyristors L are provided in parallel between the lighting signal line 75*b* and the lighting voltage line 77. The connection point between the serially connected resistors Ri2*a* and Ri2*b* is connected to the gate G1 of the odd-numbered light emitting thyristor L forming a set.

Even in this case, the gate G1 of the odd-numbered light emitting thyristor L in the off-state is set to a voltage obtained by dividing the lighting voltage VI of the VI terminal and the voltage on the lighting signal line 75*a* by the resistors Ri1*a*, Ri1*b*. Similarly, the gate G1 of the even-numbered light emitting thyristor L in the off-state is set to a voltage obtained by dividing the lighting voltage VI of the VI terminal and the voltage on the lighting signal line 75*b* by the resistors Ri2*a*, Ri2*b*.

When resistance values of the resistors Ri1*a*, Ri1*b* are Ri1*a* and Ri1*b*, Ri1*a*:Ri1*b* may be set to C1:C2. Similarly, when resistance values of the resistors Ri2*a*, Ri2*b* are Ri2*a* and Ri2*b*, Ri2*a*:Ri2*b* may be set to C1:C2.

The current flowing to the light emitting thyristors L in a case where the odd-numbered light emitting thyristors L are in the light-on state is determined by (Ri1*a*+Ri1*b*)/No instead of the resistor RI1 in the light emitting chip U. Similarly, the current flowing to the light emitting thyristors L in a case where the even-numbered light emitting thyristors L are in the light-on state is determined by (Ri2*a*+Ri2*b*)/Ne instead of the resistor RI2 in the light emitting chip U. In addition, No is the number of odd-numbered light emitting thyristors L, and Ne is the number of even numbered light emitting thyristors L.

Alternatively, a resistor may be provided between the lighting voltage line 77 and the lighting signal lines 75*a*, 75*b* to adjust the current flowing to the light emitting thyristor L in the light-on state.

In the first exemplary embodiment, two setting thyristors W are connected to the odd-numbered transfer thyristors T. A light emitting thyristor L is connected to each setting thyristor W. To the odd-numbered transfer thyristors T, one setting thyristor W may be connected or three or more setting thyristors W may be connected. The number of lighting signal lines 75 and the number of voltage setting lines 74 may be set according to the number of setting thyristors W.

Second Exemplary Embodiment

In the second embodiment, unlike the light emitting chip U according to the first exemplary embodiment, the light emitting chip V does not include the setting thyristor W, the setting transistor Qw, and the like. A light emitting thyristor L is provided for each coupling transistor Qt provided between adjacent transfer thyristors T. The second exemplary embodiment is obtained by replacing the light emitting chip U with the light emitting chip V, and replacing the signal generation circuit 110 with the signal generation circuit 110' corresponding to the light emitting chip V, in the light emitting device 65 of the first exemplary embodiment. The other configuration is the same as that of the first exemplary embodiment, so the description of the same part will be omitted, and the different part will be described.

Figure 16:
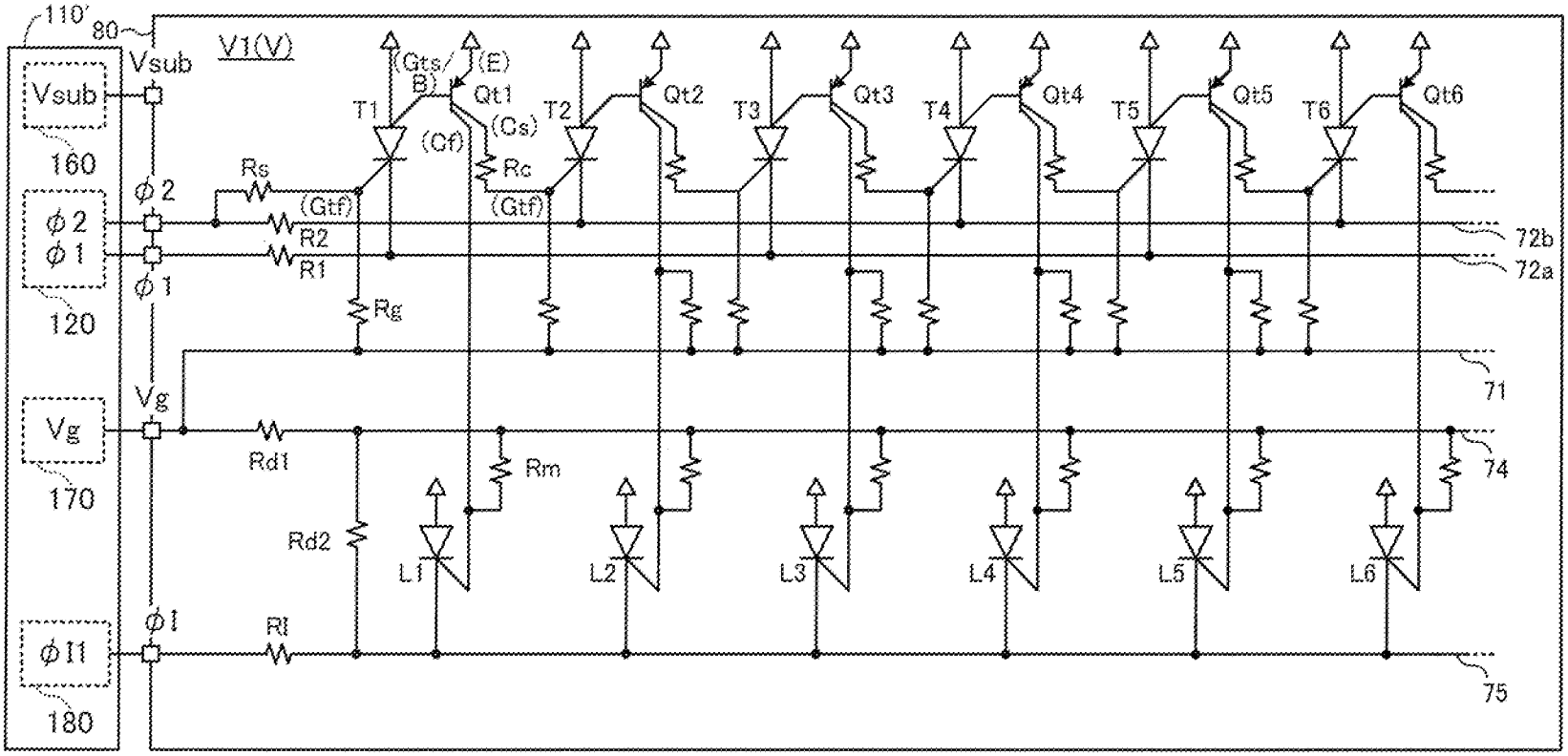
FIG. 16 is an example of an equivalent circuit diagram for explaining the configuration of the light emitting chip to which a second exemplary embodiment is applied.

FIG. 16 is an example of an equivalent circuit diagram for explaining the configuration of the light emitting chip V to which the second exemplary embodiment is applied. Here, the light emitting chip V will be described by using the light emitting chip V1 as an example in relation to the signal generation circuit 110'. Therefore, although the light emitting chip V1(V) is denoted in FIG. 16, the light emitting chip V is denoted below. The same parts as those of the first exemplary embodiment are denoted by the same reference numerals and the description thereof is omitted.

Unlike the signal generation circuit 110 according to the first exemplary embodiment, the signal generation circuit 110' does not include the setting signal generation unit 130 and the light-off signal generation unit 140. Instead, the lighting signal generation unit 180 is provided. That is, in a case where the light emitting chip U in FIGS. 4A and 4B is replaced with the light emitting chip V, the lighting signal generation unit 180 transmits different lighting signals φI1 to φI20 to the light emitting chips V1 to V20. FIG. 16 shows the lighting signal φI1 in order to explain the light emitting chip V1 as an example.

The light emitting chip V includes light emitting thyristors L1, L2, L3, . . . arranged in a row on the substrate 80, similar to the light emitting chip U. The light emitting chip V includes transfer thyristors T1, T2, T3, . . . arranged in a row, similar to the light emitting thyristors L. In addition, as in the first exemplary embodiment, the light emitting thyristors L1, L2, L3, . . . are denoted as the light emitting thyristor L when not distinguished from one another, and the transfer thyristors T1, T2, T3, . . . are denoted as the transfer thyristor T when not distinguished from one another.

In the light emitting chip V, two transfer thyristors T are paired in numerical order, and coupling transistors Qt1, Qt2, Qt3, . . . are provided between the respective pairs. The coupling transistors Qt1, Qt2, Qt3, . . . are denoted as the coupling transistor Qt when not distinguished from one another.

Then, the light emitting chip V includes the start resistor Rs. Further, the light emitting chip V includes plural resistors. Numbers to distinguish elements such as the light emitting thyristors L1, L2, L3, . . . are not assigned to the resistors.

The light emitting thyristor L is a three-terminal element having an anode, a gate G1, and a cathode, as in the light emitting thyristor L of the first exemplary embodiment. The transfer thyristor T is a four-terminal element having an anode, a first gate Gtf, a second gate Gts, and a cathode, as in the transfer thyristor T of the first exemplary embodiment. The coupling transistor Qt is a multi-collector having an emitter E, a base B, a first collector Cf, and a second collector Cs, as in the odd-numbered coupling transistor Qt in the first exemplary embodiment.

The number of light emitting thyristors L may be a predetermined number. In the second exemplary embodiment, in a case where the number of light emitting thyristors L is, for example, 512, the number of transfer thyristors T is also 512. However, the number of coupling transistors Qt may be 511 which is one less than the number of transfer thyristors T.

The number of transfer thyristors T may be larger than the number of light emitting thyristors L.

FIG. 16 shows a part centered on the light emitting thyristors L1 to L6 and the transfer thyristors T1 to T6.

The light emitting chip V includes plural wirings connecting the above elements.

The light emitting chip V includes the power supply line 71 connected to the Vg terminal. The power supply line 71 is supplied with the power voltage Vg from the power voltage supply unit 170 through the Vg terminal.

The light emitting chip V includes transfer signal lines 72*a*, 72*b* connected to the φ1 terminal and the φ2 terminal respectively through the resistors R1, R2. Transfer signals φ1, φ2 are respectively transmitted from the transfer signal generation unit 120 to the φ1 terminal and the φ2 terminal. The light emitting chip V further includes a lighting signal line 75 connected to the φI terminal through the resistor RI. The lighting signal φI1 is transmitted from the lighting signal generation unit 180 to the φI terminal.

The light emitting chip V further includes a voltage setting line 74 connected to the gate of each light emitting thyristor L through the resistor Rm. The voltage on the gate of the light emitting thyristor L in the off-state is set by the voltage setting line 74.

Further, the light emitting chip V includes the Vsub terminal on the back electrode 85 of the substrate 80. The reference voltage Vsub is supplied from the reference voltage supply unit 160 to the Vsub terminal.

Next, the connection relationship will be described.

The anode of the transfer thyristor T is set to the reference voltage Vsub. The gate Gt is connected to the power supply line 71 through a resistor Rg. The cathodes of the odd-numbered transfer thyristors T are connected to the transfer signal line 72*a*. The cathodes of the even-numbered transfer thyristors T are connected to the transfer signal line 72*b*.

The coupling transistor Qt is provided between the second gate Gts and the first gate Gtf of the transfer thyristor T whose number is larger by one, with two transfer thyristors arranged in numerical order as a pair.

The light emitting thyristor L has an anode set to the reference voltage Vsub. The gate G1 is connected to the voltage setting line 74 through a resistor Rm. The cathode of the light emitting thyristor L is connected to the lighting signal line 75.

Further, the resistors Rd1, Rd2 connected in series are connected between the power supply line 71 and the lighting signal line 75. The resistor Rd1 is connected to the power supply line 71 side, and the resistor Rd2 is connected to the lighting signal line 75 side. The voltage setting line 74 is connected to the connection point between the resistors Rd1 and Rd2 connected in series.

The resistors R1, R2, Rg, Rm, RI, Rd1, and Rd2 described above are current limiting resistors that limit the current and maintain the voltage on the previous and subsequent wirings.

Timing Chart

Next, the operation of the light emitting chip V will be described.

The reference voltage Vsub is "H" (0 V), and the power voltage Vg is "L" (−3.3 V). The signals (transfer signals φ1 and φ2 and lighting signal φI1) have voltages of "H" (0 V) and "L" (−3.3 V).

Then, as an example, the resistors R1, R2, and RI each have 200Ω, and the resistor Rg has 10 kΩ. The resistor Rd1 has 4 kΩ, and the resistor Rd2 has 1.6 kΩ. The resistor Rm has 36 kΩ. Other values are the same as in the first exemplary embodiment. That is, the internal resistance rk of the transfer thyristor T is 60 kΩ, and the cathode (transfer signal lines 72*a*, 72*b*) of the transfer thyristor T in the on-state goes to −1.8 V. Further, the internal resistor of the light emitting thyristor L has 20Ω, and the cathode (lighting signal line 75) of the light emitting thyristor L in the on-state goes to −1.7 V.

The above numerical values are examples, and other values can be set.

The light emitting device 65 (a configuration in which the light emitting chip U in FIG. 3 is replaced with the light emitting chip V and the signal generation circuit 110 is replaced with the signal generation circuit 110') includes light emitting chips V1 to V20. As in the first exemplary embodiment, the reference voltage Vsub and the power voltage Vg are commonly supplied to all the light emitting chips V (light emitting chips V1 to V20) on the circuit board 62.

Then, as described above, the transfer signals φ1, φ2 are commonly transmitted to the light emitting chips V1 to V20. All light emitting chips V are driven in parallel.

Meanwhile, the lighting signal φI1 is transmitted to the light emitting chip V1, and the lighting signals φI2 to φI20 are transmitted to the light emitting chips V2 to V20. Here, the lighting signals φI1 to φI20 are transmitted in parallel at the same timing. Thus, the light emitting chips V are driven in parallel. The lighting signals φI1 to φI20 are denoted as the lighting signal φI when not distinguished from one another.

In order to adjust the light amount of the light emitting thyristor L, the lighting signal φI may be transmitted at shifted timings, or may be shifted and transmitted between the light emitting chips V.

Since the light emitting chips V2 to V20 are driven in parallel with the light emitting chip VI, it is sufficient to describe the operation of the light emitting chip V1.

Hereinafter, the operation of the light emitting chip V1 will be described.

Figure 17:
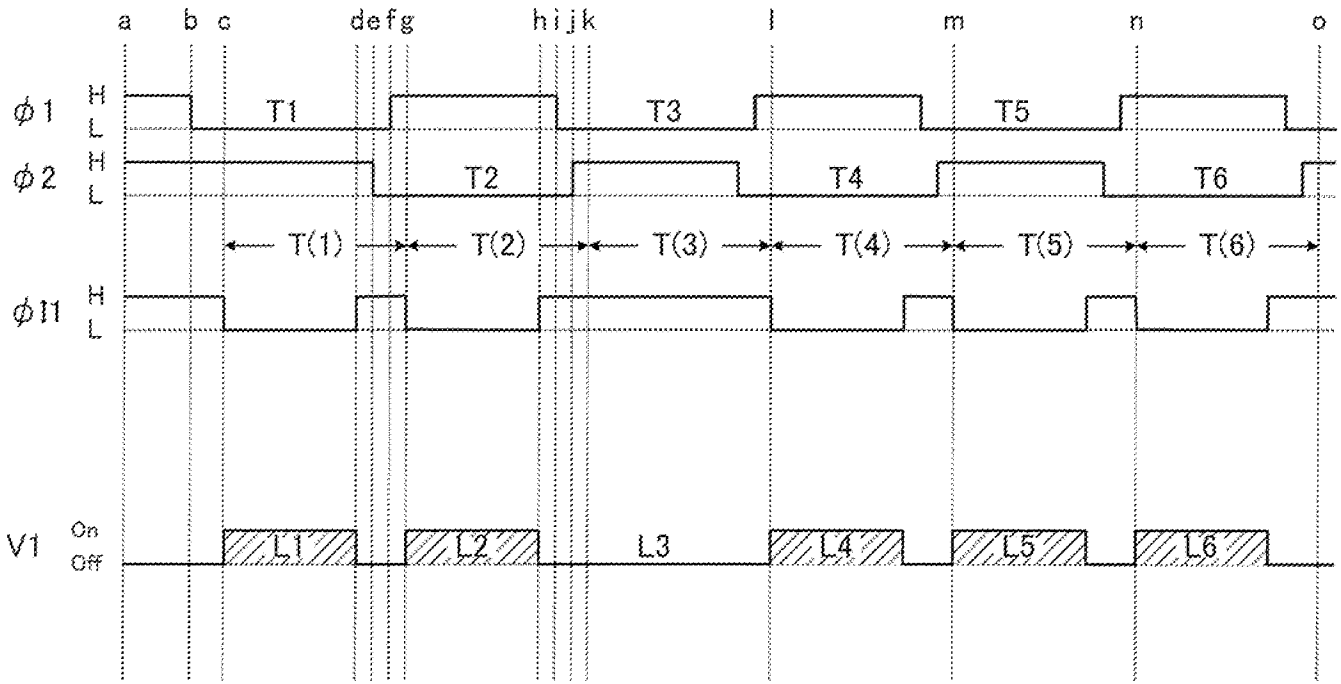
FIG. 17 is a timing chart for explaining the operation of the light emitting chip.

FIG. 17 is a timing chart for explaining the operation of the light emitting chip V1. Here, the light emitting chip V1 will be described as an example. Therefore, the lighting signal φI1 is denoted. Then, it is assumed that time passes in alphabetical order (a, b, c, . . . ). The times and periods T indicated by the alphabets in FIG. 17 are different from the times and periods T indicated by the alphabets in FIG. 7.

FIG. 17 shows a period in which the lighting control of the light emitting thyristors L1 to L6 is performed, the light emitting thyristors L1, L2, L3, L5, L6 are in a light-on state, and the light emitting thyristor L4 is in a light-off state.

Hereinafter, the operation of the light emitting chip V1 will be described in order of time with reference to FIG. 16. The same applies to the operations of other light emitting chips V.

The lighting of the light emitting thyristor L1 of the light emitting chip V1 is controlled in a period T(1) from time c to time g, and the lighting of the light emitting thyristor L2 is controlled in a period T(2) from time g to time k. The other light emitting thyristors L3 to L6 are also controlled to light in the periods T(3) to T(6). Here, except for the lighting signal φI1 which changes according to image data, the signal waveforms of the continuous odd-numbered period T and even-numbered period T repeat. That is, signal waveforms of the period T(1) and the period T(2) repeat in the period T(3) and the period T(4). Here, the periods T(1), T(2), T(3), . . . have the same length. The period from time a to time c is a period in which the light emitting chip V1 starts operating. The signals during this period will be described in the description of the operation.

Transfer signals φ1 and φ2 will be described from time c to time k of periods T(1) and T(2).

The transfer signal φ1 is "L" at time c, and transitions from "L" to "H" at time f. Then, the signal transitions from "H" to "L" at time i, and maintains "L" at time k.

The transfer signal φ2 is "H" at time c, and transitions from "H" to "L" at time e. Then, the signal transitions from "L" to "H" at time j, and maintains "H" at time k. The transfer signals φ1, φ2 are repeated on a unit twice the period T of the period T(1) and the period T(2) basis. Then, "H" and "L" are alternately repeated with a period in which both become "L" like a period from time e to time f. Then, except for the period from time a to time b, the transfer signal φ1 and the transfer signal φ2 do not have a period in which both are "H".

The transfer thyristors T shown in FIG. 16 are turned on sequentially in order of number, by a set of the transfer signals φ1, φ2.

Next, the lighting signal φI1 will be described in the period T(1).

The lighting signal φI1 transitions from "H" to "L" at time c, and transitions from "L" to "H" at time d. Then, the lighting signal φI1 transitions from "H" to "L" at time g. The period in which the lighting signal φI1 is "L" is a period in which the transfer signal φ1 is "L" and the transfer signal φ2 is "H".

In the lighting signal φI1, a waveform similar to the waveform in the period T(1) repeats in the period T(2). That is, the lighting signal φI1 is a signal with the period T as a unit.

The operation of the light emitting chip V1 in the second exemplary embodiment will be described, according to the timing chart of the light emitting chip V1 shown in FIG. 17, with reference to FIG. 16.

(1) Time a

The state (initial state) at time a when supply of the reference voltage Vsub and the power voltage Vg is started will be described.

At time a of the timing chart shown in FIG. 17, power is applied to the light emitting device 65 (a configuration in which the light emitting chip U in FIG. 3 is replaced with the light emitting chip V and the signal generation circuit 110 is replaced with the signal generation circuit 110'). Then, power is supplied to the signal generation circuit 110', and various signals and various voltages are set. Here, the reference voltage Vsub is set to "H" (0 V) by the reference voltage supply unit 160. Thus, the back electrode 85 of each light emitting chip V goes to "H" (0 V). The power voltage supply unit 170 sets the power voltage Vg to "L" (−3.3 V). Thus, the power supply line 71 of each light emitting chip V goes to "L" (−3.3 V) through the Vg terminal.

At time a, the transfer thyristor T, coupling transistor Qt, and light emitting thyristor L are all in the off-state.

Transfer signal generation unit 120 sets the transfer signals φ1, φ2 to "H" (0 V). Then, the φ1 terminal and the φ2 terminal of each light emitting chip U go to "H" (0 V). Thus, the transfer signal lines 72*a*, 72*b* are set to "H" (0 V) through the resistors R1, R2.

Similarly, the lighting signal generation unit 180 sets the lighting signal φI1 to "H" (0 V). Then, the φI terminal of the light emitting chip V1 goes to "H" (0 V). Thus, the lighting signal line 75 is set to "H" (0 V) through the resistor RI.

Then, the voltage setting line 74 is at the voltage obtained by dividing by the resistors Rd1, Rd2 connected to between the power supply line 71 of "L" (−3.3 V) and the lighting signal line 75 of "H" (0 V). Here, since the resistor Rd1 has 4 kΩ and the resistor Rd2 has 1.6 kΩ, the voltage setting line 74 is at −0.94 V.

Next, the operation of the light emitting chip V1 will be described, according to the timing chart shown in FIG. 17, with reference to FIG. 16. The same applies to the other light emitting chips V2 to V20.

Since the anodes of the transfer thyristor T and the light emitting thyristor L are connected to the back electrode 85 which is a Vsub terminal, the anodes are set to "H". Since the emitter E of the coupling transistor Qt is connected to the back electrode 85 which is the Vsub terminal, the emitter is also set to "H".

The cathode of each of the odd-numbered transfer thyristors T1, T3, T5, . . . is connected to the transfer signal line 72*a* of "H", and the cathode of each of the even-numbered transfer thyristors T2, T4, T6, . . . is connected to the transfer signal line 72*b* of "H". Therefore, the anode and the cathode of the transfer thyristor T both go to "H", and the transfer thyristor T is in the off-state.

Similarly, the coupling transistor Qt connected to the transfer thyristor T is also in the off-state.

The cathode of the light emitting thyristor L is connected to the lighting signal line 75 of "H". Therefore, the anode and the cathode of the light emitting thyristor L both go to "H", and the light emitting thyristor L is in the off-state.

Except for the first gate Gtf of the transfer thyristor T1 described later, the first gate Gtf of the transfer thyristor T is connected to the power supply line 71 of the power voltage Vg ("L" (−3.3 V)) through the resistor Rg. Thus, the threshold voltage is −4.8 V.

The gate G1 of the light emitting thyristor L is connected to the voltage setting line 74 of −0.94 V through the resistor Rm. Thus, the threshold voltage is −2.44 V.

The gate Gt of the transfer thyristor T1 is connected to the φ2 terminal of "H" (0 V) through the start resistor Rs. Therefore, as in the first exemplary embodiment, the first gate Gtf of the transfer thyristor T1 has −0.55 V, and the threshold voltage is −2.05 V.

(2) Time b

At time b, the transfer signal φ1 transitions from "H" (0 V) to "L" (−3.3 V). Thus, the light emitting chip V1 enters an operating state.

Then, the transfer signal line 72*a* transitions from "H" to "L" through the resistor R1. The transfer thyristor T1 having a threshold voltage of −2.05 V is turned on. The odd-numbered transfer thyristor T with the number of 3 or more are not turned on because the threshold voltage is −4.8 V. On the other hand, the even-numbered transfer thyristors T are not turned on because the transfer signal line 72*b* is at "H" (0 V).

When the transfer thyristor T1 is turned on, the first gate Gtf goes to −0.2 V, and the second gate Gts goes to −1.5 V. In addition, the cathode goes to −1.8 V. Then, the first collector Cf and the second collector Cs of the coupling transistor Qt1 go to −0.2 V.

Thus, in the light emitting thyristor L1 connected to the first collector Cf of the coupling transistor Qt1, the gate G1 goes to −0.2 V and the threshold voltage goes to −1.7 V.

Further, in the transfer thyristor T2, the first gate Gtf is connected to the second collector Cs of the coupling transistor Qt1 through the coupling resistor Rc, and is connected to the power supply line 71 by the resistor Rg. Since the coupling resistor Rc has 2 kΩ, and the resistor Rg has 10 kΩ, the first gate Gtf goes to −0.72 V, and the threshold voltage goes to −2.22 V.

Immediately after time b, the transfer thyristor T1 is in the on-state.

(3) Time c

At time c, the lighting signal φI1 transitions from "H" (0 V) to "L" (−3.3 V).

Then, the lighting signal line 75 transitions from "H" to "L". Then, the light emitting thyristor L1 having a threshold voltage of −1.7 V is turned on. The light emitting thyristor L1 with a threshold voltage (−1.7 V) higher than −2.44 V is turned on, and the lighting signal line 75 is set to −1.8 V, so the other light emitting thyristors L with a threshold voltage of −2.44 V is not turned on.

The voltage setting line 74 is set to −2.16 V obtained by dividing the power supply line 71 of "L" (−3.3 V) and the lighting signal line 75 of −1.7 V by the resistors Rd1, Rd2.

Immediately after time c, the transfer thyristor T1 is in the on-state, and the light emitting thyristor L1 is lit in an on-state.

(4) Time d

At time d, the lighting signal φI1 transmitted to the light emitting chip V1 transitions from "L" (−3.3 V) to "H" (0 V).

Then, the lighting signal line 75 transitions from "L" to "H". Then, the anode and the cathode of the light emitting thyristor L1 in the on-state go to "H", and are turned off and lit off (non-lit).

That is, the light emitting thyristor L1 of the light emitting chip V1 is turned on and lit on at the timing when the lighting signal p11 transitions from "H" to "L" at time c, and is turned off and lit off at the timing when the lighting signal p11 transitions from "L" to "H" at time d. The period from time c to time d corresponds to the lighting (light emitting) period of the light emitting thyristor L1 of the light emitting chip V1.

Immediately after time d, the transfer thyristor T1 is in the on-state.

(5) Time e

At time e, the transfer signal φ2 transitions from "H" (0 V) to "L" (−3.3 V).

Then, when the transfer signal line 72*b* transitions from "H" to "L", the transfer thyristor T2 whose threshold voltage is −2.22 V is turned on. However, even-numbered transfer thyristors T whose numbers are 4 or more are not turned on because the threshold voltage is −4.8 V.

When the transfer thyristor T2 is turned on, the coupling transistor Qt2 transitions from the off-state to the on-state, as in the case where the transfer thyristor T1 is turned on at time b. Then, the first collector Cf and the second collector Cs of the coupling transistor Qt2 go to −0.2 V. Then, in the light emitting thyristor L2, the gate G1 goes to −0.2 V, and the threshold voltage goes to −1.7 V.

The transfer thyristor T3 has a threshold voltage of −2.22 V because the first gate Gtf is connected to the second collector Cs of the coupling transistor Qt2 through the coupling resistor Rc.

Immediately after time e, the transfer thyristors T1, T2 are in the on-state.

(6) Time f

At time f, the transfer signal q 1 transitions from "L" (−3.3 V) to "H" (0 V).

Then, the transfer signal line 72*a* transitions from −1.8 V to "H" (0 V). The transfer thyristor T1 in the on-state is turned off because the cathode and the anode both go to "H". Thus, in the transfer thyristor T1, the first gate Gtf goes to −3.3 V and the threshold voltage goes to −4.8 V.

Immediately after time f, the transfer thyristor T2 is in the on-state.

(7) Time g

At time g, the lighting signal φI1 transitions from "H" (0 V) to "L" (−3 V).

Then, the lighting signal line 75 transitions from "H" to "L". As at time c, the light emitting thyristor L2 having a threshold voltage of −1.7 V is turned on.

Immediately after time g, the transfer thyristor T2 is in the on-state, and the light emitting thyristor L2 is lit in an on-state.

The operation at following time h is similar to the operation at time d, the operation at time i is similar to the operation at time e, and the operation at time j is similar to the operation at time f Therefore, the description thereof is omitted.

When the light emitting thyristor L is not lit, the lighting signal φI1 may be maintained at "H" (0 V) as shown at time k. Even when the threshold voltage of the light emitting thyristor L3 is −1.7 V, the light emitting thyristor L3 is not turned on and is not lit.

In the above, the operation of the light emitting chip V has been described, focusing on the light emitting thyristor L for lighting control. However, the light emitting chip V is provided with plural light emitting thyristors L, and the cathode is connected to the lighting signal line 75. Then, the gate G1 of the light emitting thyristor L is connected to the voltage setting line 74 through the resistor Rm.

As described above, the voltage on the lighting signal line 75 changes to "H" (0 V) when none of the light emitting thyristors L are lit, and −1.7 V when one light emitting thyristor L is lit. For example, in a case where the light emitting chip U includes 512 light emitting thyristors L, 512 light emitting thyristors L are connected in parallel to the lighting signal line 75. Then, the light emitting thyristor L in the off-state works as a load capacitor against the fluctuation of the voltage on the lighting signal line 75.

Here, the light emitting chip V' of the comparative example will be described.

Figure 18:
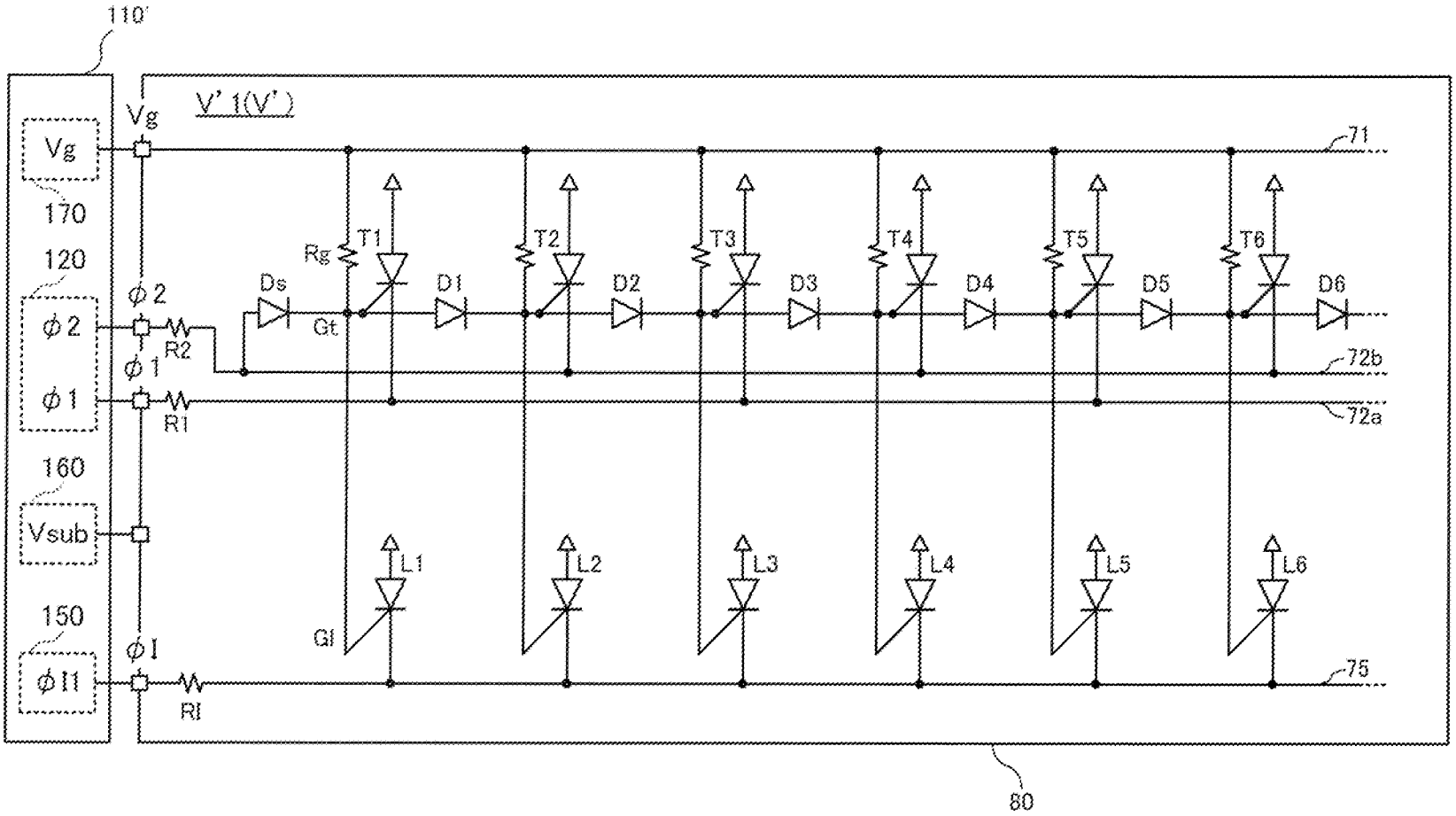
FIG. 18 is an example of an equivalent circuit diagram for explaining a configuration of a light emitting chip shown as a comparative example.

FIG. 18 is an example of an equivalent circuit diagram for explaining a configuration of a light emitting chip V' shown as a comparative example; The light emitting chip U' in the comparative example is configured to be able to replace the light emitting chip U to which the second exemplary embodiment is applied.

Here, the light emitting chip V' will be described by using the light emitting chip V'1 as an example in relation to the signal generation circuit 110'. Therefore, although the light emitting chip is denoted by V'1 (V') in FIG. 18, the light emitting chip is denoted by V' below. The same parts as those of the light emitting chip V are denoted by the same reference numerals and the description thereof is omitted.

Unlike the light emitting chip V according to the second exemplary embodiment shown in FIG. 16, in the light emitting chip V', the transfer thyristor T includes only the first gate Gtf. In the following, the gate is described as a gate Gt. A coupling diode D is provided instead of the coupling transistor Qt, and a start diode Ds is provided instead of the start resistor Rs. The voltage setting line 74 is not provided. Thus, the gate G1 of each light emitting thyristor L is directly connected to the gate Gt of the light emitting thyristor L. Therefore, the configuration of the light emitting chip V' is simplified as compared to the light emitting chip V.

The light emitting chip V' operates according to the timing chart shown in FIG. 17 in the same manner as the light emitting chip V. The voltage on the gate Gt of the transfer thyristor T and the voltage on the gate G1 of the light emitting thyristor L are different from the light emitting chip V as described below.

That is, at time a, in the transfer thyristor T1, the gate Gt is at −1.5 V and the threshold voltage is −3 V by the start diode Ds. The same applies to the light emitting thyristor L1. The transfer thyristor T2 has a gate Gt of −3 V and a threshold voltage of −4.5 V. The same applies to the light emitting thyristor L2. The transfer thyristors T with the number of 3 or more have the threshold voltage of −4.8 V because the gate Gt is at "L" (−3.3 V) through the resistor Rg. The same applies to the light emitting thyristors L with the number of 3 or more.

Then, at time b, when the transfer signal φ1 goes to "L" (−3.3 V), the transfer thyristor T1 having a threshold voltage of −3 V is turned on. Then, the gate Gt of the transfer thyristor T1 goes to −0.2 V. Then, the light emitting thyristor L has a threshold voltage of −1.7 V. Further, the gate Gt of the transfer thyristor T2 connected by the coupling diode D1 goes to −1.7 V. Thus, the transfer thyristor T2 has a threshold voltage of −3.2 V.

The operations at times c and d are the same as the light emitting chip V. Further, at times e and f, the voltage on the gate Gt of the on-state transfer thyristor T is controlled by the coupling diode D differently from the coupling transistor Qt of the light emitting chip V.

Here, the operation of the portion (light emitting unit 102) of the light emitting thyristor L of the light emitting chip V' will be described.

Figure 19A:
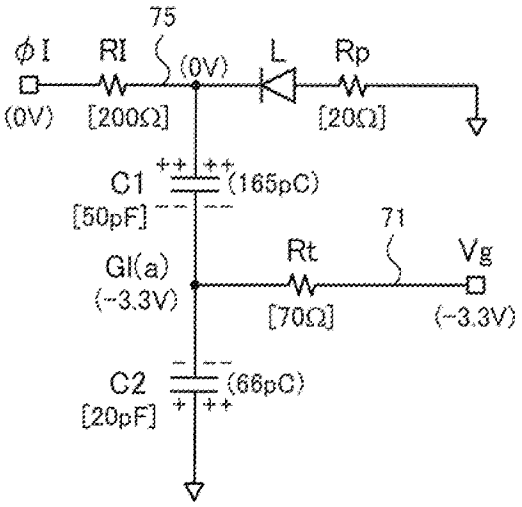
FIGS. 19A to 19D are diagrams for explaining operations before and after lighting the light emitting thyristors in the light emitting chip shown as the comparative example.
Figure 19B:
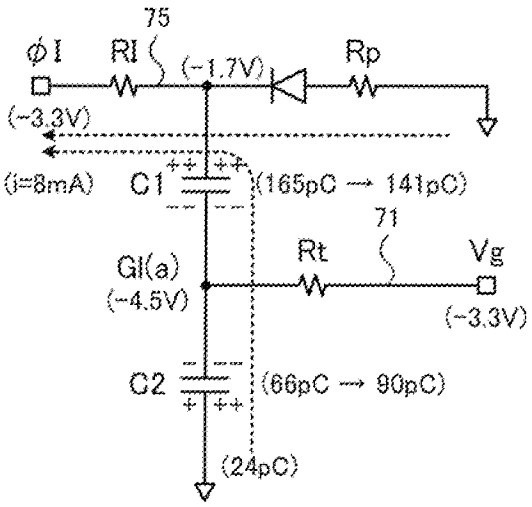
Figure 19C:
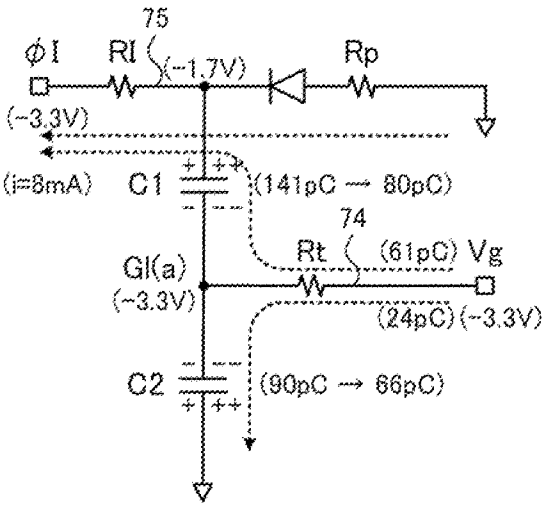
Figure 19D:
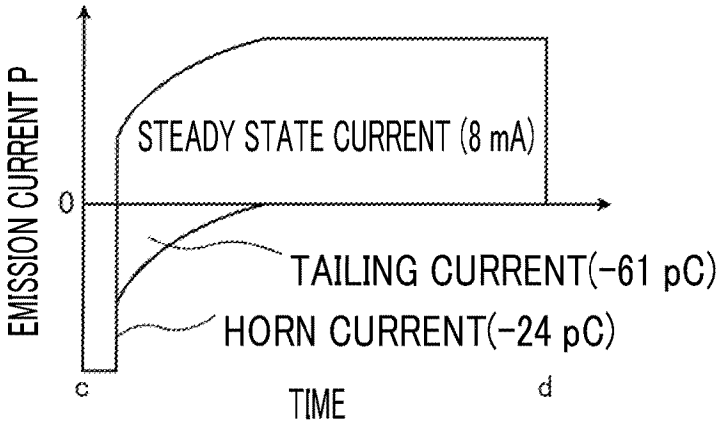

FIGS. 19A to 19D are diagrams for explaining operations before and after lighting the light emitting thyristor L in the light emitting chip V' shown as the comparative example. FIG. 19A shows a state before lighting, FIG. 19B shows a state immediately after lighting, FIG. 19C shows a steady state, and FIG. 19D shows a change of an emission current P over time. As described in FIGS. 9 and 11, the gates G1 are collectively referred to as a gate G1(*a*). The light emitting thyristor L in the on-state is approximated by one diode. The internal resistor Rp is an internal resistor of the light emitting thyristor L in the on-state. As described above, the internal resistor Rp has 20Ω. Further, the resistor RI has 200Ω. A total capacitance C1 of the capacitance $C_{GA}$ between the gate G1 and the anode of the light emitting thyristor L is 50 pF, and a total capacitance C2 of the capacitance $C_{GK}$ between the gate G1 and the cathode is 20 pF. Further, since the resistor Rm has 36 kΩ, the resistor Rt has 70Ω.

The state before lighting shown in FIG. 19A corresponds to the state between time b and time c in the timing chart shown in FIG. 17. At this time, the lighting signal φI is "H" (0 V), and the lighting signal line 75 is at "H" (0 V). Since the light emitting thyristor L is in the off-state, no current flows. Further, the gate G1(*a*) is connected to the Vg terminal of the power voltage Vg ("L" (−3.3 V)) through the resistor Rt. Therefore, the gate G1(*a*) is at "L" (−3.3 V). Therefore, −3.3 V is applied between both terminals of the capacitor C1. Therefore, the charge of 165 pC is accumulated in the capacitor C1. Similarly, −3.3 V is applied between both terminals of the capacitor C2. Therefore, the charge of 66 pC is accumulated in the capacitor C2. The polarity is indicated by + and − in FIGS. 10A to 10D, and the amount of charge is indicated by the number of + and −. The same is applied to the other cases.

The state immediately after lighting shown in FIG. 19B is a state immediately after time b in FIG. 17. When one light emitting thyristor L transitions to the on-state, as described above, the lighting signal line 75 goes to −1.7 V. Then, a voltage difference (−1.6 V) between "L" (−3.3 V) of the φI terminal and −1.7 V of the lighting signal line 75 is applied to the resistor RI of 200Ω. Therefore, 8 mA (=−1.6 V/200Ω) flows in the resistor RI as the current i. The current i steadily flows as long as the light emitting thyristor L is in the on-state. This is the steady state current (8 mA) shown in FIG. 19D.

At the initial stage where the light emitting thyristor L transitions to the on-state, a displacement current flows through the capacitors C1, C2. The displacement current changes the voltage between both terminals of series capacitor Cp (=C1×C2/(C1+C2)) of the capacitor C1 and the capacitor C2 from 0 V to −1.7 V by −1.7 V. In this example, the series capacitance Cp is 14.3 pF. Therefore, a total of 24 pC of charges flow from the capacitors C1, C2 to the φI terminal. This current changes the charge of the capacitor C1 from 165 pC to 141 pC and the charge of the capacitor C2 from 66 pC to 90 pC. Then, the gate G1 goes to −4.5 V.

Since the steady state current is constant, this current reduces the current flowing to the light emitting thyristor L.

In addition, this current flows with a time constant (RI×Cp) determined by the series capacitor Cp and the resistor RI. In this example, the time constant is about 2.9 ns. This is a current shown as a horn current in FIG. 19D.

Next, the steady state shown in FIG. 19C is the state after the end of the horn current in FIG. 19D.

Since the voltage difference between the gate G1(*a*) (−4.5 V) and the Vg terminal ("L" (−3.3 V)) occurs even when the horn current ends, a current due to the movement of the charge flows to the φI terminal side and the Vsub terminal side until the voltage on the gate G1(*a*) goes to −3.3 V. At this time, a charge of 61 pC flows through the resistor RI through the capacitor C1. Further, a charge of 24 pC flows to the Vsub terminal through the capacitor C2. Thus, the charge stored in the capacitor C1 changes from 141 pC to 80 pC by 61 pC. Similarly, the charge stored in the capacitor C2 changes from 90 pC to 66 pC by 24 pC. Since the steady state current is constant, the charge flowing to the resistor RI through the capacitor C1 reduces the current flowing to the light emitting thyristor L.

The charge flows with a time constant (C1×(Rt+RI)) determined by the capacitor C1, the resistor Rt, and the resistor RI. In this example, it is 13.5 ns. This is the tailing current shown in FIG. 19D.

As shown in FIG. 19D, in the light emitting chip V', when one light emitting thyristor L transitions from the off-state to the on-state at time b or the like in the timing chart of FIG. 17, as the emission current P, the current flowing to the light emitting thyristor L is reduced due to a large horn current which flows through the resistor RI immediately after transition to the on-state, and a tailing current flowing to pull tailing following the horn current.

Therefore, it takes time until the emission current P flowing to the light emitting thyristor L goes to a steady state current, that is, until the fluctuation of the light emission amount of the light emitting thyristor L decreases.

Next, the operation of the portion (light emitting unit 102) of the light emitting thyristor L in the light emitting chip V in the second exemplary embodiment will be described.

Figure 20A:
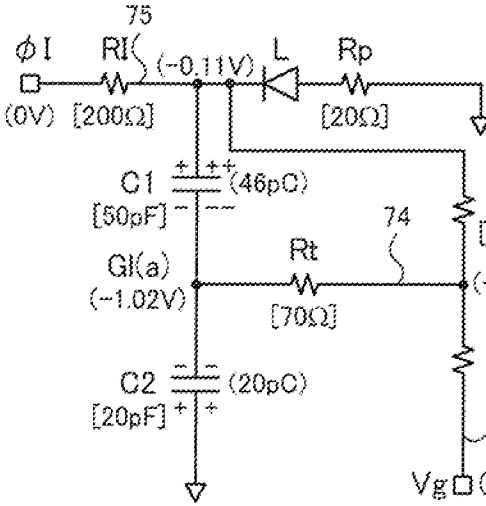
FIGS. 20A to 20D are diagrams for explaining operations before and after lighting the light emitting thyristors in the light emitting chip to which the second exemplary embodiment is applied.
Figure 20B:
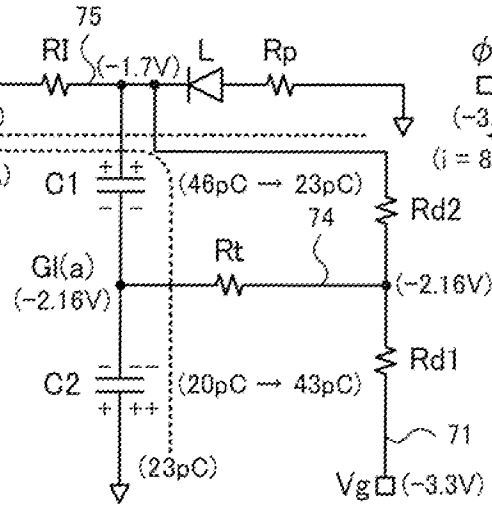
Figure 20C:
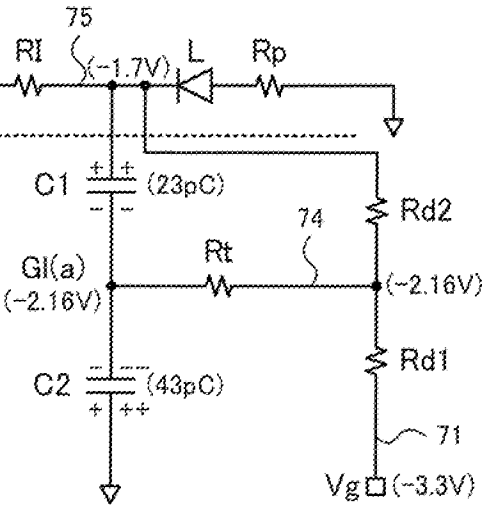
Figure 20D:
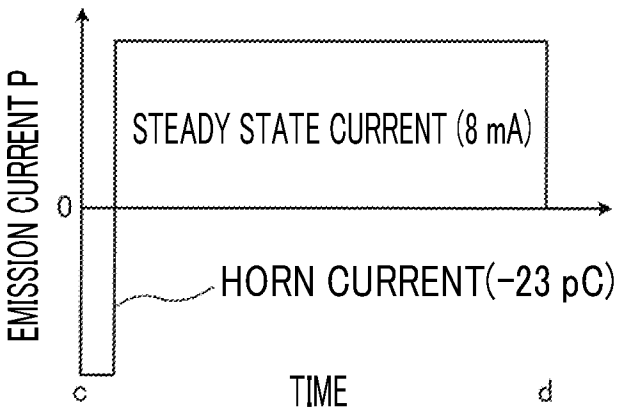

FIGS. 20A to 20D are diagrams for explaining operations before and after lighting the light emitting thyristor L in the light emitting chip V to which the second exemplary embodiment is applied. FIG. 20A shows a state before lighting, FIG. 20B shows a state immediately after lighting, FIG. 20C shows a steady state, and FIG. 20D shows a change of an emission current P over time. In addition, the gates G1 are collectively referred to as a gate G1(*a*). In addition, the light emitting thyristor L in the on-state is approximated by one diode. Others are the same as the case of the light emitting chip V' described above. The resistors Rd1, Rd2 provided between the lighting signal line 75 and the power supply line 71 have 4 kΩ and 1.6Ω, respectively.

In the state before lighting shown in FIG. 20A, since the lighting signal φI is set to "H" (0 V) and none of the light emitting thyristors L are lit, the lighting signal line 75 is set to −0.11 V obtained by dividing "H" (0 V) of the lighting signal φI and "L" (−3.3 V) of the Vg terminal by resistance RI: Rd1+resistance Rd2. Similarly, the voltage setting line 74 is set to −1.02 V obtained by dividing "H" (0 V) of the lighting signal φI and "L" (−3.3 V) of the Vg terminal by resistance RI+resistance Rd2: resistance Rd1. Thus, the capacitor C1 stores a charge of 46 pC because the potential difference is 0.91 V, and the capacitor C2 stores a charge of 20 pC because the potential difference is 1.02 V.

In the state immediately after lighting shown in FIG. 20B, when one light emitting thyristor L is turned on, as described above, the lighting signal line 75 goes to −1.7 V. Then, a voltage difference (−1.6 V) between "L" (−3.3 V) of the φI terminal and −1.7 V of the lighting signal line 75 is applied to the resistor RI of 200Ω, so 8 mA (=−1.6 V/200Ω) flows to the resistor RI as the current i. The current i steadily flows as long as the light emitting thyristor L is in the on-state. This current i is a steady state current (8 mA) shown in FIG. 12D.

Further, as in FIG. 20B, at the initial stage when the light emitting thyristor L is turned on, a displacement current flows through the capacitors C1, C2. Here, the lighting signal line 75 changes from −0.11 V to −1.7 V by −1.59 V. Therefore, a charge of 23 pF flows to the φI terminal through the resistor RI through the capacitors C1, C2. Since the steady state current is constant, the current due to the flow of charge reduces the current flowing to the light emitting thyristor L. Further, due to the flow of charge, the capacitance C1 changes from 46 pC to 23 pC and the capacitance C2 changes from 20 pC to 43 pC. Then, the gate G1(*a*) goes to −2.16 V. The gate G1(*a*) is connected to the connection point between resistors Rd1 and Rd2 connected in series provided between the lighting signal line 75 (−1.7 V) and the power supply line 71 ("L" (−3.3 V)). Here, since the resistor Rd1 has 4 kΩ and the resistor Rd2 has 1.6 kΩ, the voltage at the connection point goes to −2.16 V.

The current due to the flow of charge is a horn current shown in FIG. 20D.

In the steady state shown in FIG. 20C, the voltage (−2.16 V) of the gate G1(*a*) and the voltage (−2.16 V) of the voltage setting line 74 are the same, so that no current flows through the resistor Rt. This state is the same as the pseudo floating state, which allows following the voltage on the gate G1(*a*). Then, a steady state current (8 mA) flows through the light emitting thyristor L.

In order to obtain such a voltage relationship, the resistance values of the resistors Rd1, Rd2 may be set based on the capacitances of the capacitors C1, C2. That is, when resistance values of the resistors Rd1, Rd2 are Rd1, Rd2 and capacitances of the capacitors C1, C2 are C1, C2, Rd1: Rd2=C1:C2 may be set. In the above example, since C1 is 50 pF and C2 is 20 pF, Rd1 is 4 kΩ and Rd2 is 1.6 kΩ.

As shown in FIG. 20D, in the light emitting chip V, when the light emitting thyristor L transitions from the off-state to the on-state, as the emission current P, a steady state current which continues to flow over the on-state period and a large horn current which flows immediately after transition to the on-state flow, but a tailing current seen in the light emitting chip V' is suppressed.

Therefore, the time until the emission current P of the light emitting thyristor L goes to a steady state current, that is, the time until the fluctuation of the light emission amount of the light emitting thyristor L decreases becomes shorter as compared to the light emitting chip V'.

Here, although the voltage on the gate G1(*a*) and the voltage on the voltage setting line 74 are described to be the same, the voltage difference may be smaller than the light emitting chip U'. As the voltage difference decreases, the tailing current decreases, and the time until the emission current P of the light emitting thyristor L goes to a steady state, that is, the time until the fluctuation of the light emission amount of the light emitting thyristor L decreases becomes shorter. The voltage on the voltage setting line 74 can be set arbitrarily by the resistors Rd1, Rd2.

In the second exemplary embodiment shown in FIG. 16, the configuration using the coupling diode D shown in FIG. 18 is not adopted, because in a case where the gate G1 of the light emitting thyristor L and the gate Gt of the transfer thyristor T are connected, the gate Gt of the transfer thyristor T goes to −1.02 V, and becomes smaller than the diffusion voltage Vd (1.5 V) of the coupling diode D in the absolute value.

In the first and second exemplary embodiments, it has been described that thyristors (the transfer thyristor T, the light emitting thyristor L, the setting thyristor W (first exemplary embodiment), and the light-off thyristor RT (first exemplary embodiment)) are anode common in which the anode is connected to the substrate 80, and transistors (the coupling transistor Qt (first exemplary embodiment and second exemplary embodiment) and the setting transistor Qw (first exemplary embodiment)) are pnp bipolar transistors.

By changing the polarity of the circuit, thyristors (the transfer thyristor T, the light emitting thyristor L, the setting thyristor W (first exemplary embodiment), and the light-off thyristor RT (first exemplary embodiment)) may be cathode common in which the cathode is connected to the substrate 80, and transistors (the coupling transistor Qt (first exemplary embodiment and second exemplary embodiment) and the setting transistor Qw (first exemplary embodiment)) may be npn bipolar transistors.

Further, the coupling transistor Qt and the setting transistor Qw are pnp bipolar transistors or npn bipolar transistors, but three-terminal switching devices such as field effect transistors (FETs) may be used.

Further, the coupling resistor Rc may be a resistor (parasitic resistor) inherent to the collector of the coupling transistor Qt, or may be a resistor (parasitic resistor) inherent to the first gate Gtf of the transfer thyristor T.

Further, in the first exemplary embodiment and the second exemplary embodiment, the transfer thyristors T are driven by two phases of the transfer signals φ1, φ2, but transfer signals of three or more phases may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light emitter comprising:

a plurality of light emitting thyristors that each have an anode, a cathode, and a gate and are connected in parallel between a reference voltage line to which a reference voltage is supplied and a lighting voltage line to which a lighting start voltage for starting lighting is supplied, in which the anode and the cathode are connected respectively to the reference voltage line and the lighting voltage line; and a gate voltage setting section that, when at least one of the plurality of light emitting thyristors transitions from an off-state to an on-state, sets a voltage on the gate of each of the plurality of light emitting thyristors in the off-state to a voltage between the lighting start voltage and an on-state voltage of the light emitting thyristor.

2. The light emitter according to claim 1, wherein the gate voltage setting section sets the voltage on the gate according to a relationship between a first parasitic capacitance between the gate and the cathode in the plurality of light emitting thyristors and a second parasitic capacitance between the gate and the anode.

3. The light emitter according to claim 2, wherein the voltage on the gate is set to a value obtained by dividing a difference between the lighting start voltage and the on-state voltage by a ratio between the first parasitic capacitance and the second parasitic capacitance.

4. The light emitter according to claim 2, wherein the gate voltage setting section sets the voltage on the gate based on series resistors that are connected in series between the lighting voltage line and a power supply line for supplying the lighting start voltage and form a connection point connected to the gate.

5. The light emitter according to claim 4, wherein the resistance value of the series resistors is set based on a ratio between the first parasitic capacitance between the gate and the cathode in the plurality of light emitting thyristors and the second parasitic capacitance between the gate and the anode.

6. A light source device comprising:

a light emitting unit including the light emitter according to claim 1; and a transfer unit including a plurality of transfer elements that are respectively connected to the plurality of light emitting thyristors in the light emitting unit and are sequentially turned on, wherein the light emitting thyristors in the light emitting unit become ready to turn into an on-state when the transfer elements in the transfer unit are turned on.

7. A light emitting device comprising:

at least one light emitting unit including the light emitter according to claim 1;

a transfer unit including a plurality of transfer elements that are respectively connected to a plurality of light emitting thyristors in the light emitting unit and are sequentially turned on; and at least one setting unit including, between the light emitting unit and the transfer unit, a plurality of setting elements respectively connected to the plurality of transfer elements in the transfer unit and respectively connected to the plurality of light emitting thyristors in the light emitting unit, wherein the setting elements become ready to turn into an on-state when the connected transfer elements are turned on, and turn the connected light emitting thyristors into an on- state when turned on.

8. The light emitting device according to claim 7, wherein the at least one light emitting unit includes a plurality of light emitting units and the at least one setting unit includes a plurality of setting units, the transfer elements in the transfer unit are connected to the setting elements in each of the plurality of setting units, and the setting elements in each of the plurality of setting units are connected to the light emitting thyristors in each of the plurality of light emitting units.

9. A print head comprising:

the light source device according claim 6; and an optical unit that forms an image from light emitted from the light emitting device.

10. An image forming apparatus comprising:

an image holding member;

a charging unit that charges the image holding member;

an exposure unit that includes the print head according to claim 9 and exposes, to light, the image holding member charged by the charging unit;

a developing unit that develops an electrostatic latent image formed on the image holding member exposed to light by the exposure unit; and a transfer unit that transfers the image developed on the image holding member to a transfer target.

11. The light emitter according to claim 1, wherein the gate voltage setting section includes a first line connected to gates of one group of the plurality of light emitting thyristors and a second line connected to gates of another group of the plurality of light emitting thyristors.

12. A light emitter comprising:

a plurality of light emitting thyristors that each have an anode, a cathode, and a gate and are connected in parallel between a reference voltage line to which a reference voltage is supplied and a lighting voltage line to which a lighting start voltage for starting lighting is supplied, in which the anode and the cathode are connected respectively to the reference voltage line and the lighting voltage line; and a gate voltage setting section that brings the gate into a pseudo floating state by allowing a voltage on the gate of each of the plurality of light emitting thyristors in an off- state to follow a voltage on the gate of the light emitting thyristor in an on-state.

13. A light emitter comprising:

a plurality of light emitting thyristors that each have an anode, a cathode, and a gate and are connected in parallel between a reference voltage line to which a reference voltage is supplied and a lighting voltage line to which a lighting start voltage for starting lighting is supplied, in which the anode and the cathode are connected respectively to the reference voltage line and the lighting voltage line; and a gate voltage setting section that, when at least one of the plurality of light emitting thyristors transitions from an off-state to an on-state, sets a voltage on the gate of each of the plurality of light emitting thyristors to a voltage between the lighting start voltage and an on-state voltage of the light emitting thyristor, wherein the gate voltage setting section sets the voltage on the gate according to a relationship between a first parasitic capacitance between the gate and the cathode in the plurality of light emitting thyristors and a second parasitic capacitance between the gate and the anode.

* * * * *